US011476616B2

(12) United States Patent
Patel et al.

(10) Patent No.: US 11,476,616 B2
(45) Date of Patent: Oct. 18, 2022

(54) MODULAR COMMUNICATIONS PLUG

(71) Applicant: Panduit Corp., Tinley Park, IL (US)

(72) Inventors: Satish I. Patel, Roselle, IL (US); Roman J. Churnovic, Joliet, IL (US); Vytas J. Vaitkus, Orland Park, IL (US); Robert E. Fransen, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 29 days.

(21) Appl. No.: 17/155,460

(22) Filed: Jan. 22, 2021

(65) Prior Publication Data

US 2021/0242623 A1 Aug. 5, 2021

Related U.S. Application Data

(60) Provisional application No. 62/970,471, filed on Feb. 5, 2020, provisional application No. 63/030,499, filed on May 27, 2020.

(51) Int. Cl.

| | |
|---|---|
| ***H01R 13/58*** | (2006.01) |
| ***H01R 13/506*** | (2006.01) |
| ***H01R 4/2433*** | (2018.01) |

(52) U.S. Cl.

CPC ..... *H01R 13/582* (2013.01); *H01R 13/506* (2013.01); *H01R 13/5829* (2013.01); *H01R 4/2433* (2013.01)

(58) Field of Classification Search

None

See application file for complete search history.

(56) References Cited

U.S. PATENT DOCUMENTS

| | | | | |
|---|---|---|---|---|
| 5,571,035 | A * | 11/1996 | Ferrill | H01R 24/64 439/894 |
| 5,830,005 | A | 11/1998 | Watanable | |
| 6,402,559 | B1 | 6/2002 | Marowsky et al. | |
| 6,811,445 | B2 | 11/2004 | Caveney et al. | |
| 6,932,641 | B1 * | 8/2005 | Liao | H01R 13/58 439/418 |
| 7,175,468 | B1 | 2/2007 | Chang | |
| 7,374,450 | B1 | 5/2008 | Chang | |
| 7,425,159 | B2 | 9/2008 | Lin | |
| 7,979,183 | B2 | 7/2011 | Toda | |
| 8,033,863 | B2 | 10/2011 | Gutter et al. | |
| 8,684,763 | B2 | 4/2014 | Mattson et al. | |
| 8,845,359 | B2 | 9/2014 | Taylor et al. | |
| 8,992,261 | B2 | 3/2015 | Mattson | |
| 9,033,725 | B2 | 5/2015 | Fransen | |
| 9,413,154 | B2 | 8/2016 | Taylor et al. | |
| 9,601,886 | B1 | 3/2017 | Fransen et al. | |
| 9,865,975 | B2 | 1/2018 | Plamondon et al. | |

(Continued)

FOREIGN PATENT DOCUMENTS

| | | | |
|---|---|---|---|
| EP | 0899823 | A2 | 3/1999 |
| EP | 1313178 | A2 | 5/2003 |

(Continued)

*Primary Examiner* — Oscar C Jimenez

(74) *Attorney, Agent, or Firm* — Christopher S. Clancy; James H. Williams; Peter S. Lee

(57) ABSTRACT

A modular communications plug is disclosed having a simplified design that allows for more efficient termination of a cable into the plug. The plug includes modular components that are applicable to different applications.

20 Claims, 55 Drawing Sheets

(56) References Cited

U.S. PATENT DOCUMENTS

| | | | | |
|---|---|---|---|---|
| 9,935,411 | B2 | 4/2018 | White | |
| 9,960,529 | B2 | 5/2018 | Maranto et al. | |
| 10,411,398 | B2 | 9/2019 | Pepe et al. | |
| 10,530,106 | B2 | 1/2020 | Baum et al. | |
| 2005/0106929 | A1* | 5/2005 | Meckley ..... | H01R 13/5825<br>439/418 |
| 2006/0246780 | A1 | 11/2006 | Bert et al. | |
| 2012/0094525 | A1 | 4/2012 | Maranto et al. | |
| 2012/0329320 | A1 | 12/2012 | Taylor et al. | |
| 2019/0237920 | A1 | 8/2019 | Baum et al. | |
| 2020/0176932 | A1* | 6/2020 | Anderson ..... | H01R 13/6463 |

FOREIGN PATENT DOCUMENTS

| | | | |
|---|---|---|---|
| EP | 1988611 | A1 | 11/2008 |
| EP | 2333911 | A1 | 6/2011 |
| WO | 201702722 | A1 | 1/2017 |

* cited by examiner

CONFIGURATION A (CABLE END A)

CONFIGURATION A (CABLE END B)

CONFIGURATION A (CABLE END A)

CONFIGURATION A (CABLE END B)

CONFIGURATION B (CABLE END A)

CONFIGURATION B (CABLE END B)

CONFIGURATION B (CABLE END A)

CONFIGURATION B (CABLE END B)

MODULAR COMMUNICATIONS PLUG

CROSS-REFERENCE TO RELATED APPLICATION(S)

This application claims benefit to U.S. Provisional Patent Application No. 62/970,471, filed on Feb. 5, 2020, and to U.S. Provisional Patent Application No. 63/030,499, filed on May 27, 2020, the entirety of both of which are hereby incorporated by reference herein.

FIELD OF TECHNOLOGY

This disclosure relates to a modular communications plug having a simplified design that allows for more efficient termination of a cable into the plug.

BACKGROUND

Communication plugs are used to terminate cables and provide an interface for communicating data with a device having a communication jack for receiving the plug. During an installation process for attaching the plug to a data cable, a technician may cut open an end of the cable, couple individual wires carried in the cable through a conductor manager component of the plug, and secure the finished plug assembly together. However, when the plug design is complicated or comprised of many pieces, this adds further complexity to the installation process for the technician which increases installation times and chances of faulty installations.

Thus, it is desirable to provide a plug with a simplified design that allows for a more efficient installation process.

SUMMARY

This disclosure relates to a modular communications plug having a simplified design that allows for more efficient termination of a cable into the plug. The plug includes modular components that may be interchangeable to be applied for different field applications.

According to some embodiments, a plug for terminating a cable including twisted pairs of conductors is disclosed. The plug comprising: a plug housing including a cavity; a conductor manager configured to fit, at least in part, within the cavity. The conductor manager comprising: a plurality of first horizontal channels on a first surface of the conductor manager; a plurality of first vertical channels on a first side of the conductor manager that are coupled to the plurality of first horizontal channels, wherein the plurality of first horizontal channels are angled to the plurality of first vertical channels; a plurality of second horizontal channels on a second surface of the conductor manager, wherein the second surface is opposite the first surface; a plurality of second vertical channels on the first side of the conductor manager that are coupled to the plurality of second horizontal channels, wherein the plurality of second horizontal channels are angled to the plurality of second vertical channels; and a plurality of boot mounts. The plug further comprising a boot including a plurality of latch arms for engaging the plurality of boot mounts.

According to some embodiments, a plug for terminating a cable including twisted pairs of conductors is disclosed. The plug comprising: a plug housing including a plurality of contacts held within contact openings and a cavity; and a conductor manager configured for insertion into the cavity along an insertion axis. The conductor manager comprising: a plurality of vertical channels configured to hold a respective conductor and each including a first side opening facing the plurality of contacts within the cavity, wherein the plurality of contacts are configured to pierce, through the first side openings, insulation covering the respective conductor held within the plurality of vertical channels when the conductor manager has been inserted into the cavity along the reception axis to a termination state.

According to some embodiments, a plug for terminating a cable including twisted pairs of conductors is disclosed. The plug connector comprising a housing including a cavity; a load bar; and a conductor manager assembly comprising a boot, a body, and a divider.

According to some embodiments, a plug for terminating a cable including twisted pairs of conductors is disclosed. The plug comprising a plug housing including a plurality of contacts held within contact openings and a cavity, and a conductor manager configured for insertion into the cavity along an insertion axis. The conductor manager comprising a plurality of vertical channels configured to hold a respective conductor from the twisted pair of conductors, wherein each vertical channel includes a first side opening facing the plurality of contacts within the cavity when the conductor manager has been inserted into the cavity along the insertion axis to a termination state.

According to some embodiments a plug for terminating a cable including twisted pairs of conductors is disclosed. The plug comprising a plug housing including a plurality of contacts held within contact openings and a cavity, and a conductor manager configured for insertion into the cavity along an insertion axis. The conductor manager comprising a flexible boot portion including an opening configured to receive the cable, and a conductor routing portion comprising a plurality of vertical channels configured to hold a respective conductor from the twisted pair of conductors, wherein each vertical channel includes a first side opening facing the plurality of contacts within the cavity when the conductor manager has been inserted into the cavity along the insertion axis to a termination state.

According to some embodiments a plug for terminating a cable including a twisted pair of conductors is disclosed. The plug comprising a plug housing comprising a cavity, a latch window, and a plurality of contact openings configured to hold a plurality of contacts. The plug further comprising a load bar comprising a plurality of conductor holes for holding the conductors included in the twisted pair of conductors, and a plurality of contact slots for receiving the plurality of contacts and coupling to the conductors held in the conductor holes. The plug further comprising a conductor manager assembly comprising a flexible boot, a conductor manager body including a latch configured to engage the latch window when the conductor manager assembly is inserted into the cavity along an insertion axis in an assembled state, and a divider configured to route the twisted pair of conductors.

According to some embodiments a plug for terminating a cable including a twisted pair of conductors is disclosed. The plug comprising a plug housing comprising a cavity, and a plurality of contact openings configured to hold a plurality of contacts. The plug further comprising a conductor manager configured for insertion into the cavity along an insertion axis, the conductor manager comprising a flexible boot portion including an opening configured to receive the cable, and a conductor routing portion comprising a plurality of holding posts configured to hold a respective conductor from the twisted pair of conductors, wherein each holding post includes a front side opening facing towards the plurality of contacts held by the plug housing when the conductor manager has been inserted into the cavity along the insertion axis to a termination state.

According to some embodiments a plug for terminating a cable including a twisted pair of conductors is disclosed. The plug comprising a plug housing comprising a cavity, and a plurality of contact openings configured to hold a plurality of contacts. The plug further comprising a flexible boot portion, and a conductor manager configured for insertion into the cavity along an insertion axis, the conductor manager comprising a conductor routing portion including a plurality of holding posts configured to hold a respective conductor from the twisted pair of conductors, wherein each holding post includes a front side opening facing the plurality of contacts held by the plug housing when the conductor manager has been inserted into the cavity along the insertion axis to a termination state.

DETAILED DESCRIPTION

This disclosure describes a simplified plug (e.g., RJ45 plug) having a modular design. The plug includes a plug housing having preassembled insulation piercing contacts (IPCs), a conductor manager, and a strain-relief boot. By reducing the number of distinct components making up the plug, a simplified design is achieved that may result in greater installation efficiencies.

Figure 1:
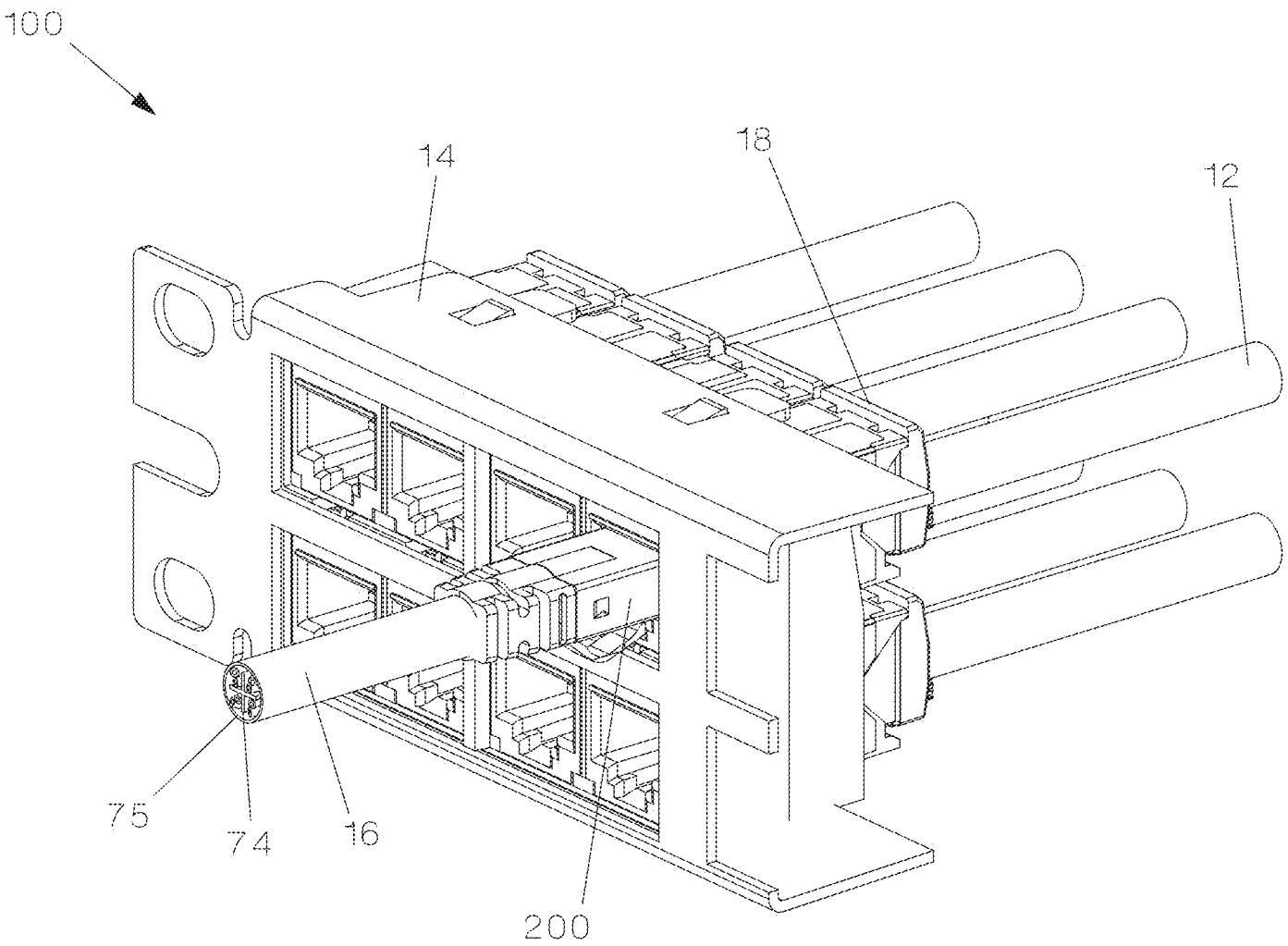
FIG. 1 is a front perspective view of a communication system including a plug, according to an embodiment.

FIG. 1 illustrates an exemplary communication system 100 where the plug 200 is configured to communicate with electrical equipment 14 through a corresponding jack 18. The jack 18 may be a punch down jack or other types of jacks. The portion of the electrical equipment 14 illustrated in FIG. 1 includes a patch panel, where the electrical equipment 14 may be passive or active equipment. Examples of passive equipment include modular patch panels, punch down patch panels, coupler patch panels, or wall jacks. Examples of active equipment include ethernet switches, routers, servers, physical layer management systems, power-over Ethernet (POE) equipment, security devices (e.g., cameras or other sensor devices), door access equipment, telephones, computers, fax machines, printers, or other workstation peripherals. The communication system 100 may further include cabinets, racks, cable management components, overhead routing systems, or other such equipment. While the communication system 100 is shown to be a CAT6A communication system, the communication system 100 may further be configured for use in any CAT5E, CAT6, CAT7, CAT7A, CAT8, or other category of communication system standard.

The communication system 100 further includes cable 16, where the cable 16 includes an outer jacket 75, a plurality of twisted pairs of conductors (e.g., insulated wires), and a separator 74 for separating the twisted wire pairs from each other. By terminating the cable 16 with the plug 200, the plug 200 is inserted into the jack 18 and communicate data transmitted within the cable 16 to internal cable 12 of the electrical equipment 14, as well as receive data transmitted from the internal cable 12.

Figure 2:
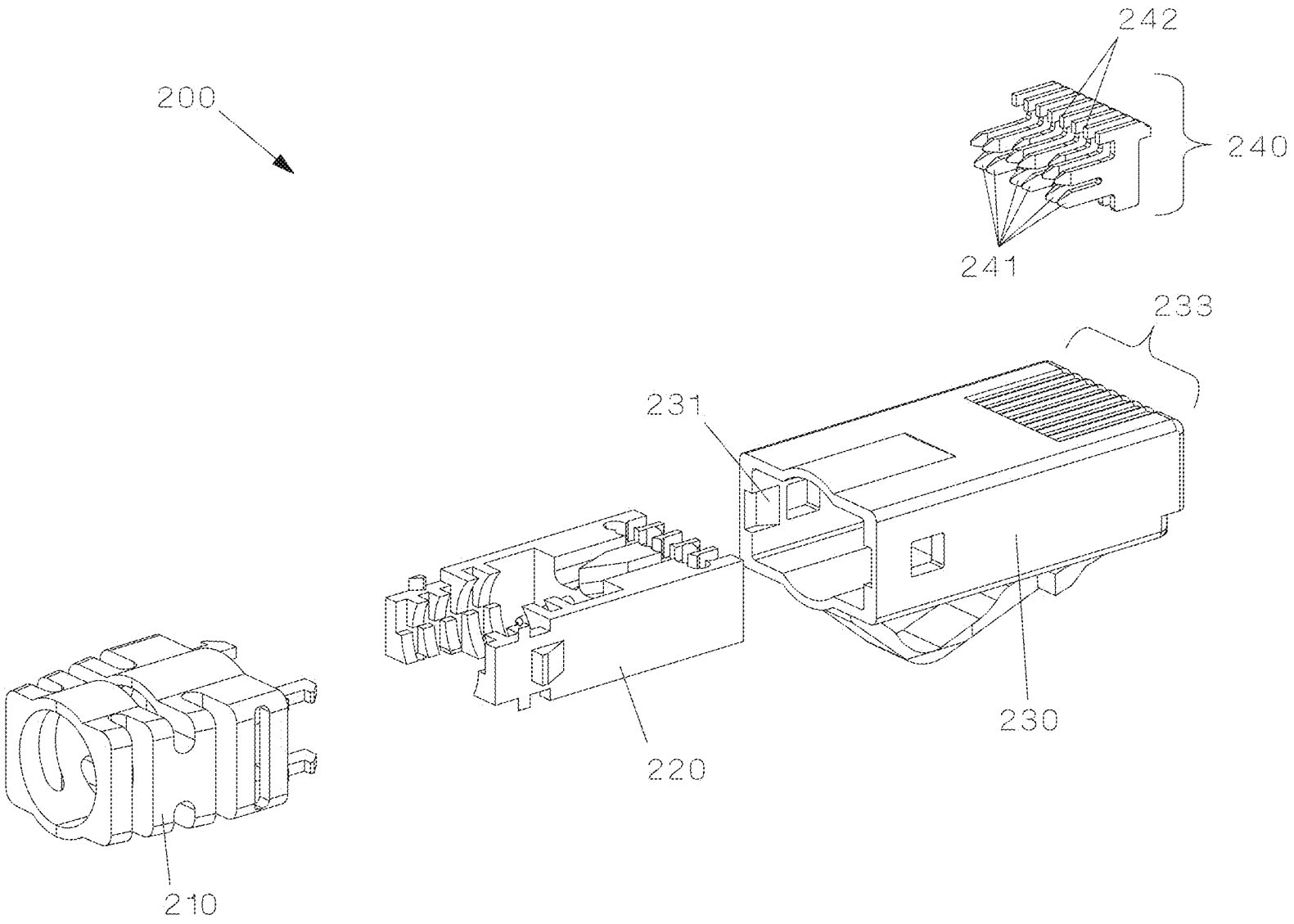
FIG. 2 is an exploded view of the plug shown in FIG. 1.
Figure 3:
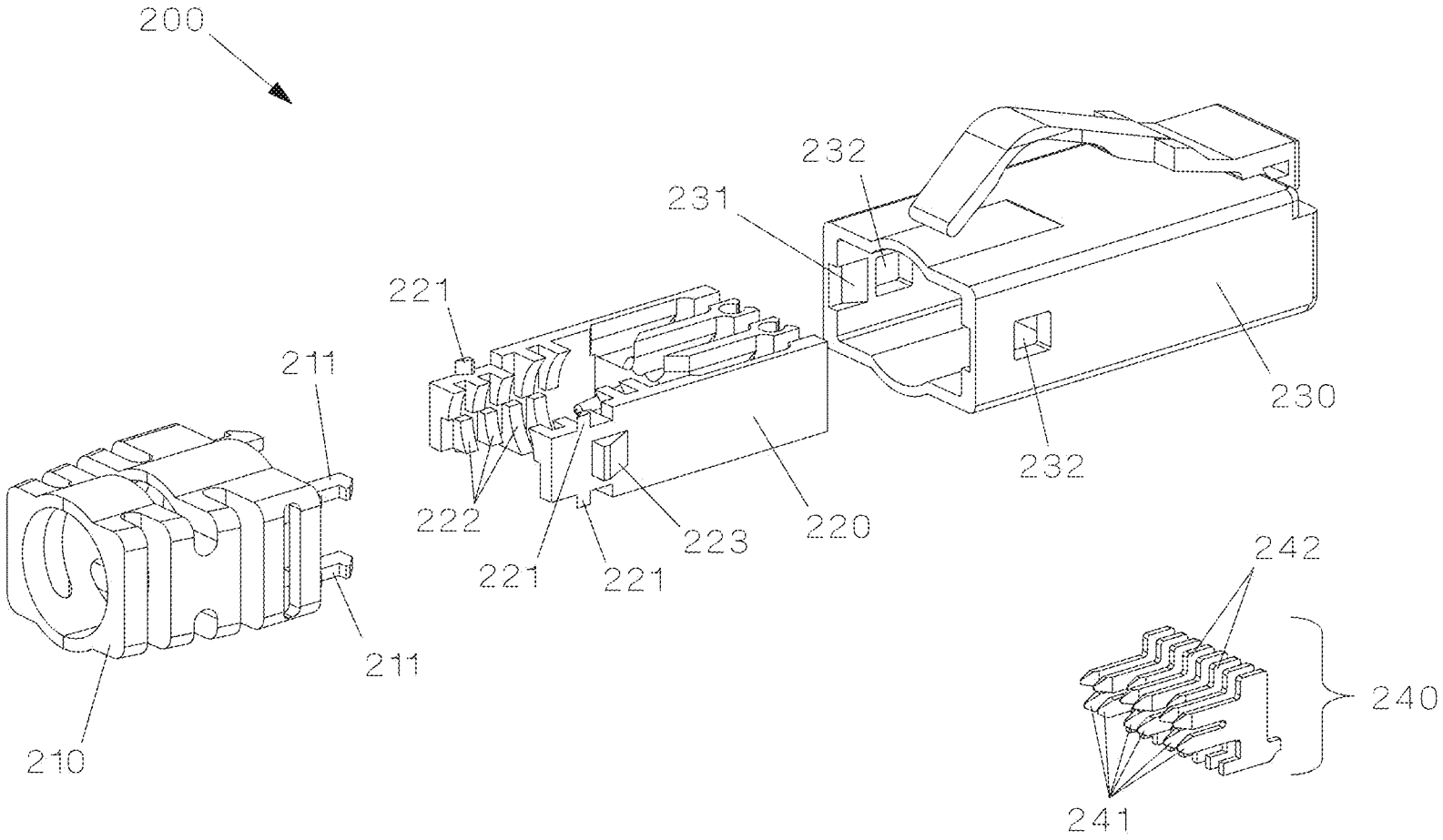
FIG. 3 is an exploded view of the plug shown in FIG. 2 that is rotated top to bottom from the view shown in FIG. 2.

FIG. 2 illustrates an exploded view of the plug 200 showing the individual components that comprise the plug 200, including a strain-relief boot 210, a conductor manager 220, and a plug housing 230. The plug 200 further includes a plurality of insulation piercing connectors (IPCs) 240 that fit into their respective IPC openings 233 in the plug housing 230. The IPCs include four long tine IPCs 241 and two short tine IPCs 242, where the tines of the IPCs 240 are for piercing an insulation layer covering a conductor (e.g., wire) in the cable 16. FIG. 3 illustrates the plug 200 shown in a top to bottom rotated view from the view shown in FIG. 2.

The boot 210 includes a plurality of latch arms 211 for engaging with, and latching onto, a plurality of boot mounts 221 on the conductor manager 220. Although four latch arms 211 are provided on the boot 210 to correspond to the four boot mounts 221 on the conductor manager 220, other combinations of latch arms 211 and boot mounts 221 are also within the scope of the plug 200 design.

The conductor manager 220 includes a latch 223 on a first side, and a latch 223 on an opposite second side, where the latches 223 are provided for engaging, and latching onto, corresponding latch windows 232 included on the plug housing 230. With the boot 210 attached to the conductor manager 220, the conductor manager 220 is configured to be inserted into an inner cavity of the plug housing 230 along an insertion axis until the latches 223 engage the latch windows 232. When the plug housing 230, having the IPCs 240 installed, and the conductor manager 220 are brought together such that the conductor manager 220 is inserted into the inner cavity of the plug housing 230 until the latches 223 are engaged with the latch windows 232, the IPCs 240 are brought into piercing contact with the conductors held in the conductor manager 220 such that the tines will pierce through the insulation covering the conductors and make electrical contact with the conductors. In this installed state, at least a majority portion (if not all) of the conductor manager 220 will be housed within the plug housing 230. Although the conductor manager 220 is shown to include two latches 223 for engaging the two latch windows 232 of the plug housing 230, a different combination of latches 223 and latch windows 232 are also within the scope of the plug 200 design. Housing lead-ins 231 minimize a peak force time duration during the installation process when the latches 223 of the conductor manager 220 are engaging the latch windows 232. The installation process for terminating the cable 16 with plug 200 is provided with more detail with reference to a termination tool 80 shown in FIG. 15.

Figure 4:
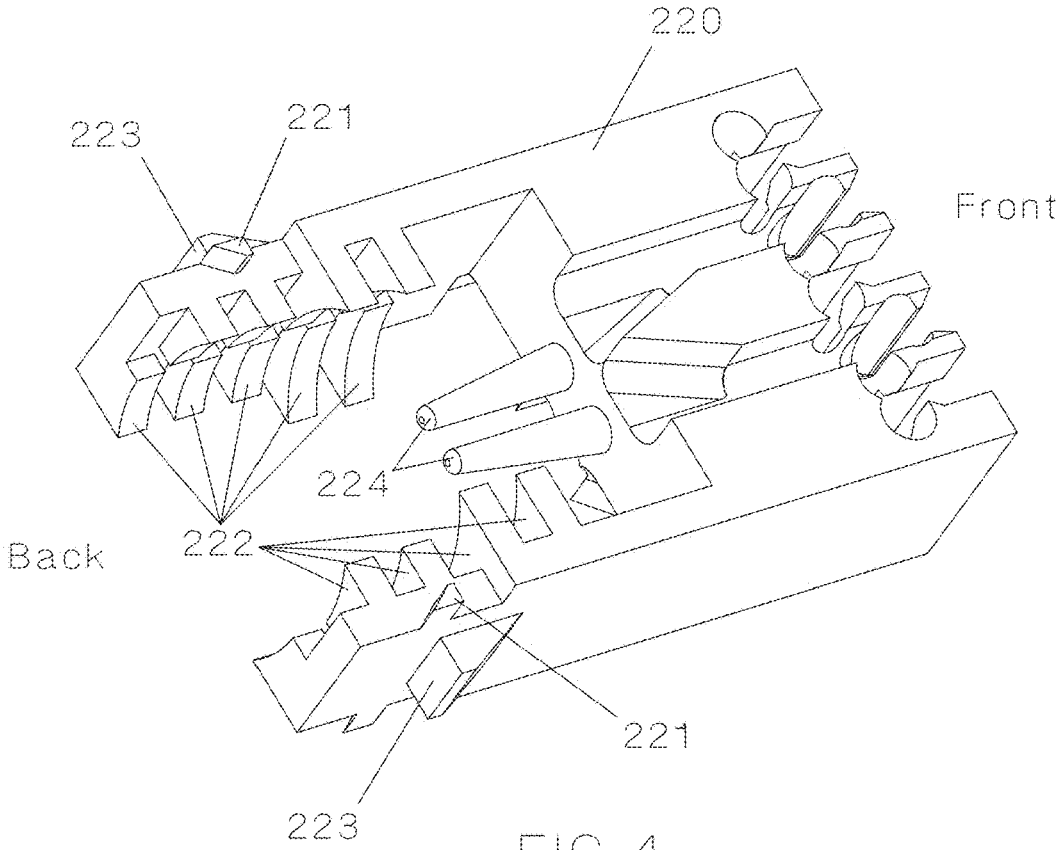
FIG. 4 is a front perspective view of a conductor manager included in the plug shown in FIG. 2.

FIG. 4 shows a more detailed perspective view of the conductor manager 220. For descriptive purposes, the end of the conductor manager 220 facing the plug housing 230 will be referred to as a front end of the conductor manager 220, whereas the end of the conductor manager 220 facing the boot 210 will be referred to as a back end of the conductor manager 220. At the back end of the conductor manager 220, a plurality of annular ribs 222 are found. The annular ribs are designed to provide an interference fit for the cable 16 by abutting against, and gripping onto, the outer jacket 75 of cable 16. By gripping the outer jacket 75, the annular ribs 222 withstand movement of the outer jacket 75 for the portion of cable 16 sitting between the annular ribs 222, and provide strain relief. The strain relief is provided by transferring a pulling force on the cable 16 outside of the plug 200 to be transferred to the annular ribs 222 grip on the outer jacket 75, thereby reducing and/or preventing the pull force from disturbing the electrical connection between the IPCs 240 and the conductors held by the conductor manager 220. The annular ribs 222 are shown to include five sets of opposing ribs of varying sizes. However, the annular ribs 222 may be comprised of one or more set of opposing ribs in any combination of sizes for abutting against and gripping onto the outer jacket 75 of cable 16.

The conductor manager 220 is further shown to include a plurality of positioners 224 designed to abut against the separator 74 found inside the cable 16 to withstand forward axial movement of the separator 74 within the conductor manager 220. The positioners 224 are shown to be cone shaped, and include two distinct pieces. However, the positioners 224 may be comprised of one or more pieces that are either cone shaped as illustrated in FIG. 4, or take on another shape for abutting against the separator 74.

Figure 5:
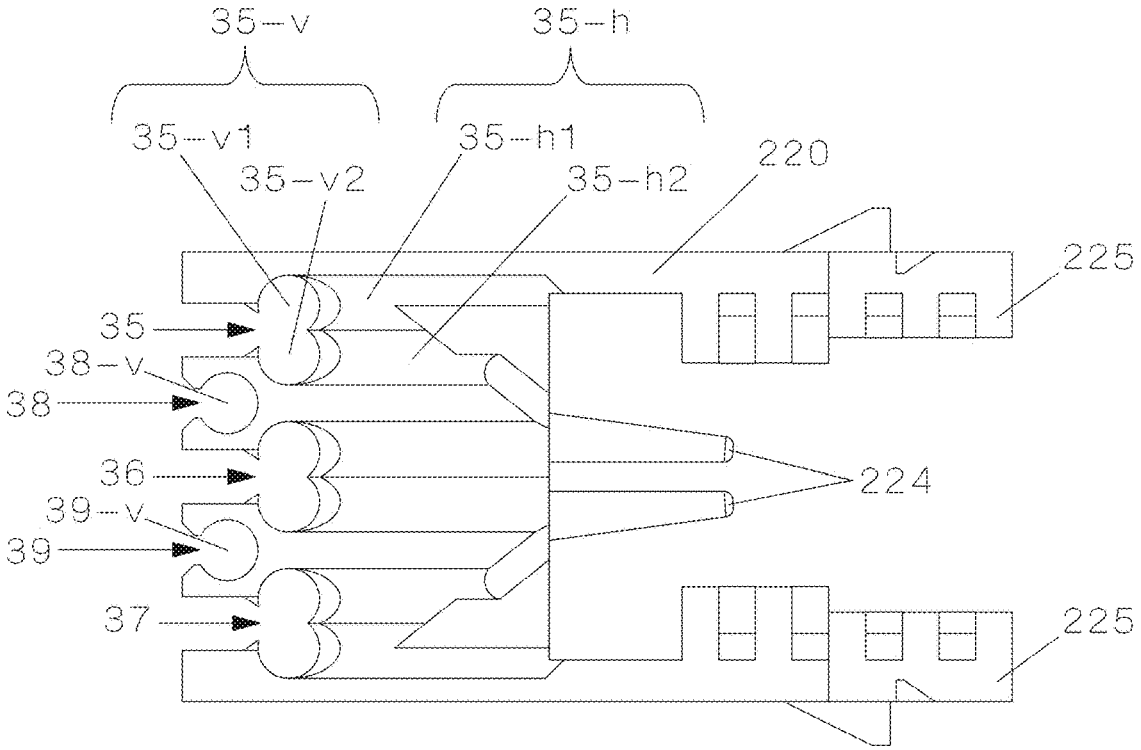
FIG. 5 is a top view of the conductor manager shown in FIG. 4.

FIG. 5 shows a top view of the conductor manager 220. From this top view, a plurality of distinct conductor channels can be seen for carrying conductors from the twisted pairs of conductors included in the cable 16. The plurality of distinct conductor channels includes a first conductor channel 35, a second conductor channel 36, a third conductor channel 37, a fourth conductor channel 38, and a fifth conductor channel 39. FIG. 5 also shows abutment arms 225 at the back of the conductor manager 220, where the abutment arms 225 will be described in more detail with reference to a termination process implemented by the termination tool 80 described in FIG. 15.

Each of the first conductor channel 35, the second conductor channel 36, the third conductor channel 37, the fourth conductor channel 38, and the fifth conductor channel 39 are provided with both a horizonal channel portion and a vertical channel portion. Each of the first conductor channel 35, the second conductor channel 36, and the third conductor channel 37 are provided for carrying conductors from their own respective wire pair (e.g., wire pairs 1-3). The fourth conductor channel 38 and the fifth conductor channel 39 are provided to respectively carry an individual conductor from a common twisted pair (e.g., individual conductors from wire pair 4). The channels described herein may further be described as posts, pads, partially-enclosed pathways, fully-enclosed pathways, routing surfaces, or other features that enabling the routing of the conductors. Furthermore, although the channels are described as being horizontal and vertical (e.g., substantially orthogonal channel axes), this description is provided for exemplary purposes only as the channels may be provided at various different relative angles to each other (e.g., non-orthogonal channel axes).

From this top view of the conductor manager 220, the first conductor channel 35 is shown to include a horizontal channel 35-*h* and a vertical channel 35-*v*. As the first conductor channel 35 is provided for carrying both conductors in a twisted pair, the horizontal channel 35-*h* includes both a first horizonal channel 35-*h*1 and a second horizontal channel 35-*h*2. Coupled to these horizonal channels are the corresponding first vertical channel 35-*v*1 and second channel 35-*v*2, respectively. From this top view of the conductor manager 220, only a vertical channel 38-*v* for the fourth conductor channel 38 is shown as the corresponding horizontal channel 38-*h* is located on a bottom side of the conductor manager 220. Further description for these conductor channels in the conductor manager 220 is provided with reference to FIGS. 11-12.

Figure 6:
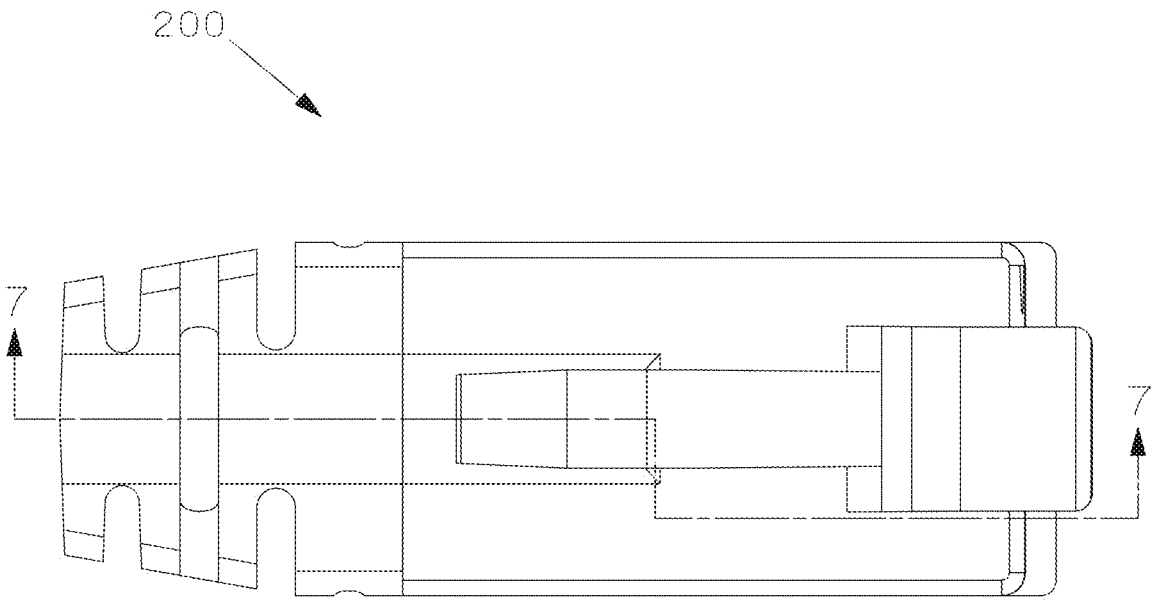
FIG. 6 is a side view of the plug shown in FIG. 1.
Figure 7:
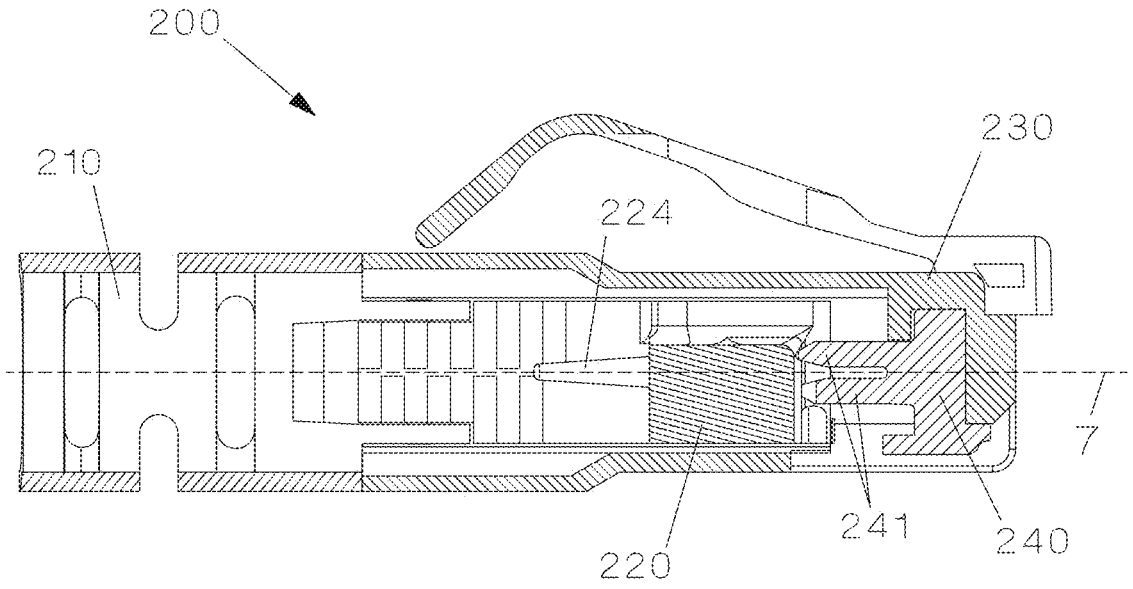
FIG. 7 is a cross sectional view of the plug shown in FIG. 6 taken along line 7-7.

FIG. 6 shows a side view of the plug 200 in a fully assembled state. FIG. 7 shows a cross-section view of the plug 200, where the cross-section is taken along line 7-7 from FIG. 6. FIG. 7 also shows a center line 7 for the conductor manager 220, where the conductor manager 220 is designed so that the center line 7 goes through positioners 224, as well as the IPCs 240. The internal view provided by FIG. 7 also shows how IPCs 240 are installed horizontally such that the tines of the IPCs 240 pierce into conductors laying in vertical conductor channels that open up to face the front end of the conductor manager 220.

Figure 8:
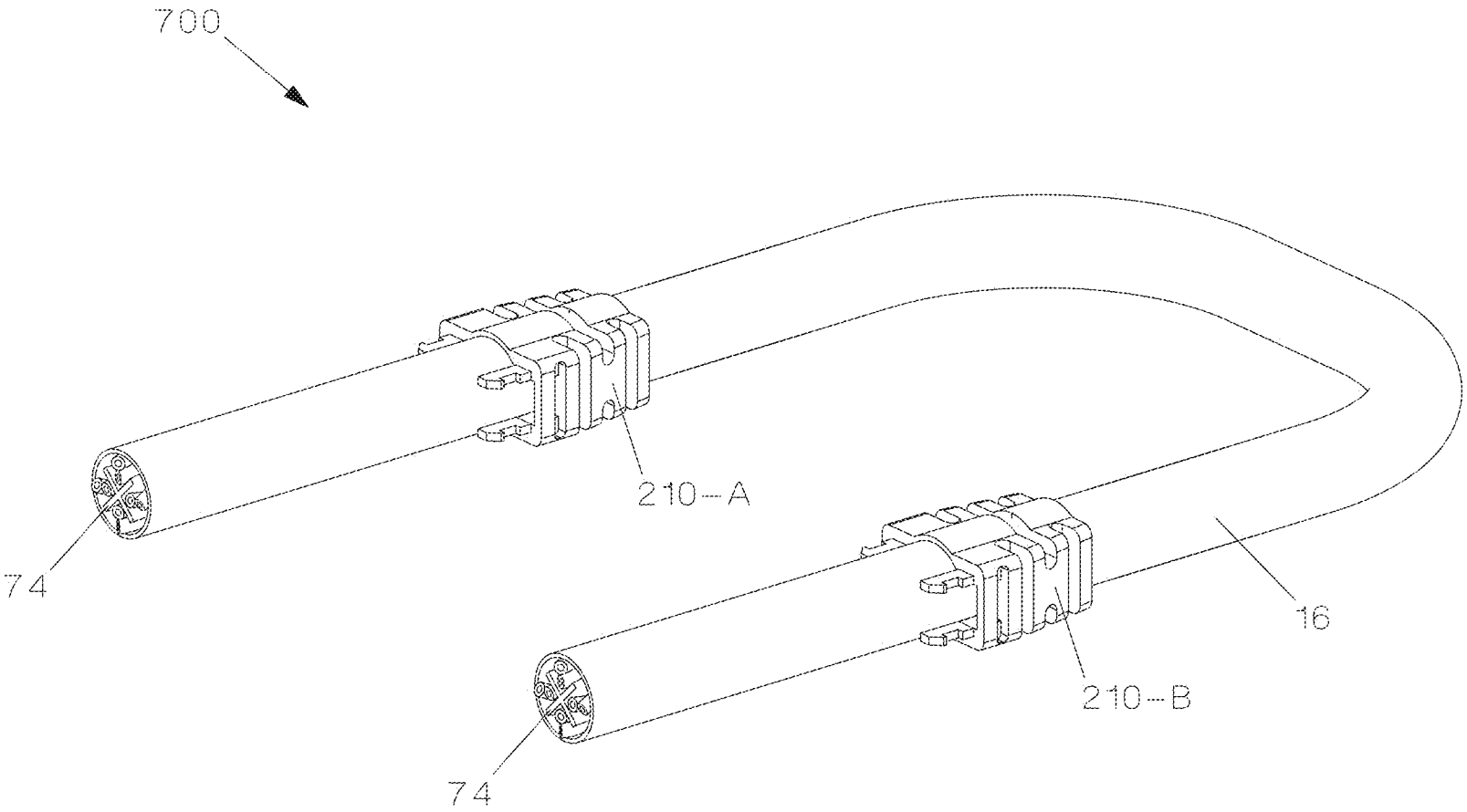
FIG. 8 is a front perspective view of a cabling system including a cable having a portion of the plug from FIG. 2 attached to each end of the cable.

FIG. 8 shows a perspective view of a cabling system 700 that includes the cable 16, a first boot 210-A, and a second boot 210-B. The first boot 210-A and the second boot 210-B are copies of the same boot 210 described previously. The cable 16 is shown to have been cut to length during an installation process, and has the first boot 210-A and the second boot 210-B threaded onto its respective ends. While the cable 16 has been cut and before it is terminated by a plug, the four twisted pairs of conductors are exposed, as well as the separator 74 for separating the twisted pairs of conductors.

Figure 9:
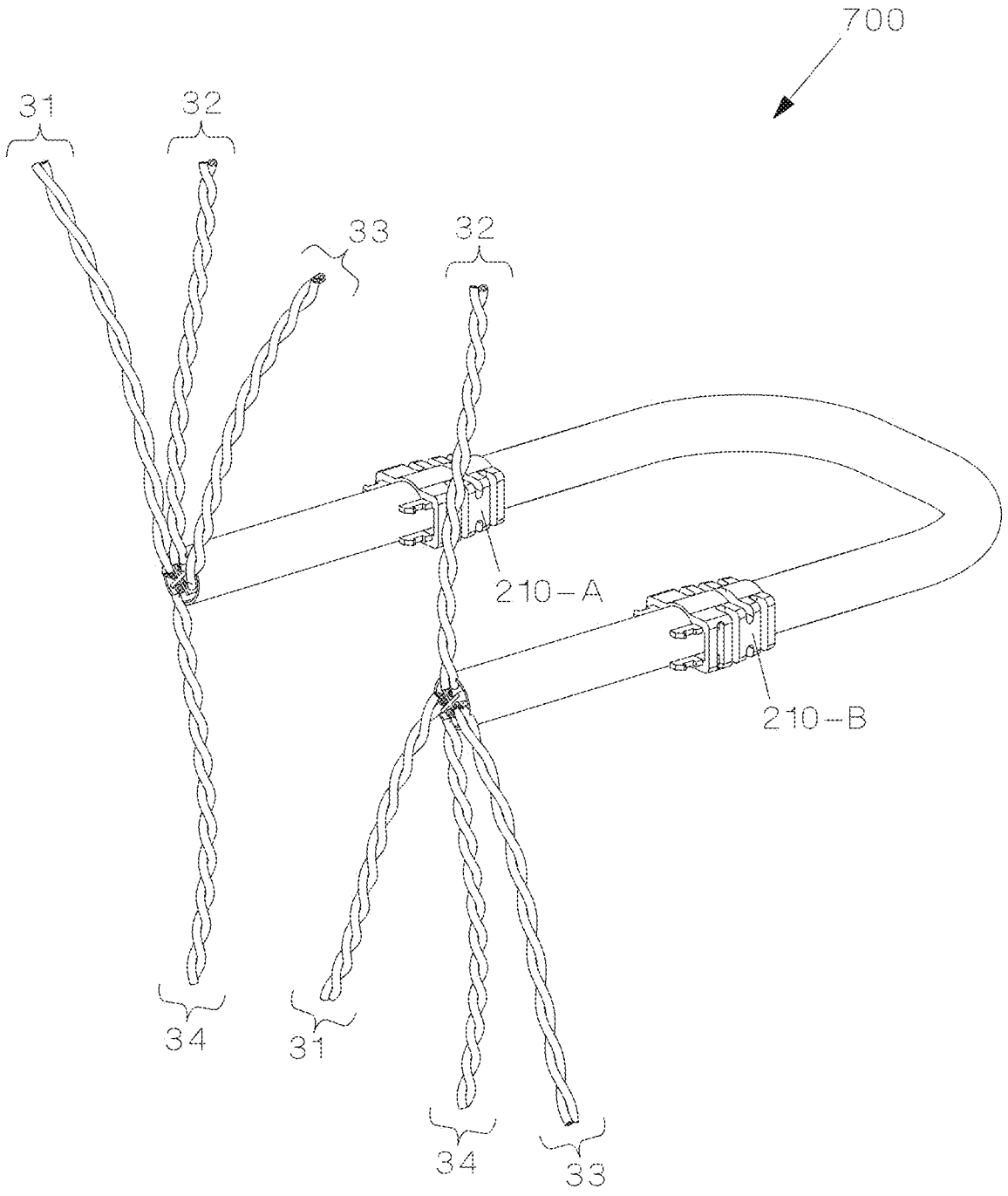
FIG. 9 is a front perspective view of the cabling system shown in FIG. 8 having a section of wires included in the cable exposed.

FIG. 9 shows the same cabling system 700 from FIG. 8 prior to a trimming step in the installation process, where a longer portion of the twisted pairs of conductors are still exposed out from the cable 16. The twisted pairs of conductors include a first twisted pair 31, a second twisted pair 32, a third twisted pair 33, and a fourth twisted pair 34 (hereinafter collectively "the twisted pairs 31-34").

Figure 10:
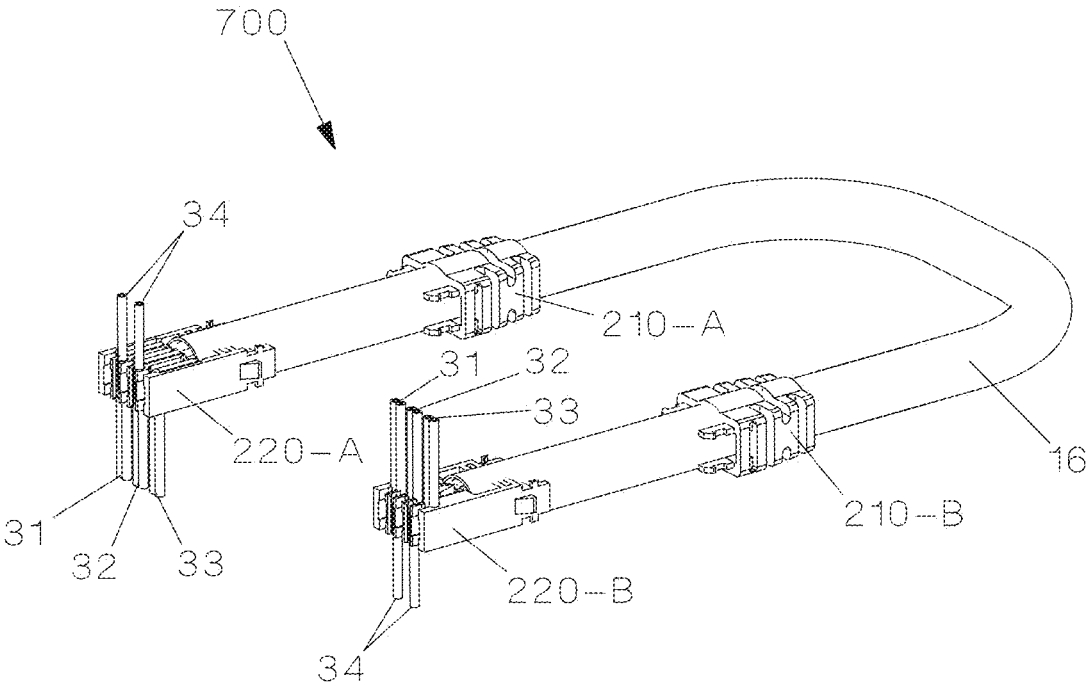
FIG. 10 is a front perspective view of the cabling system shown in FIG. 9 and further including the conductor manager shown in FIG. 4.
Figure 11:
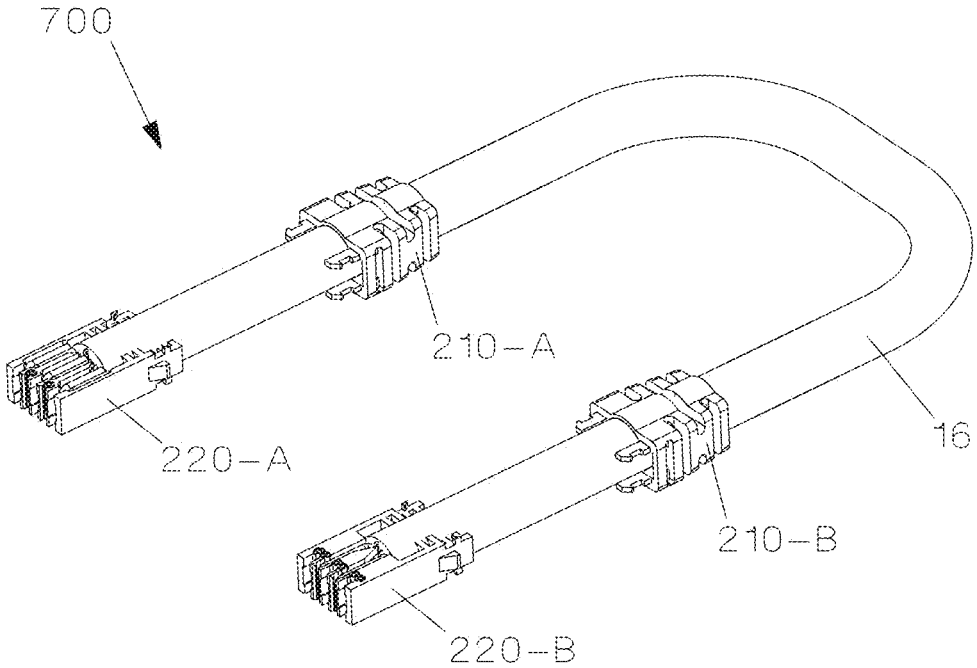
FIG. 11 is a front perspective view of the cabling system shown in FIG. 10 where excess conductor portions have been trimmed.

FIG. 10 shows the cabling system 700 where the conductors in the cable 16 have been trimmed and routed through horizontal channels in conductor manager 220-A and conductor manager 220-B. FIG. 11 shows a progression of the installation, where remaining portions of the conductors have now been routed through vertical channels in the conductor manager 220-A and the conductor manager 220-B.

Figure 12:
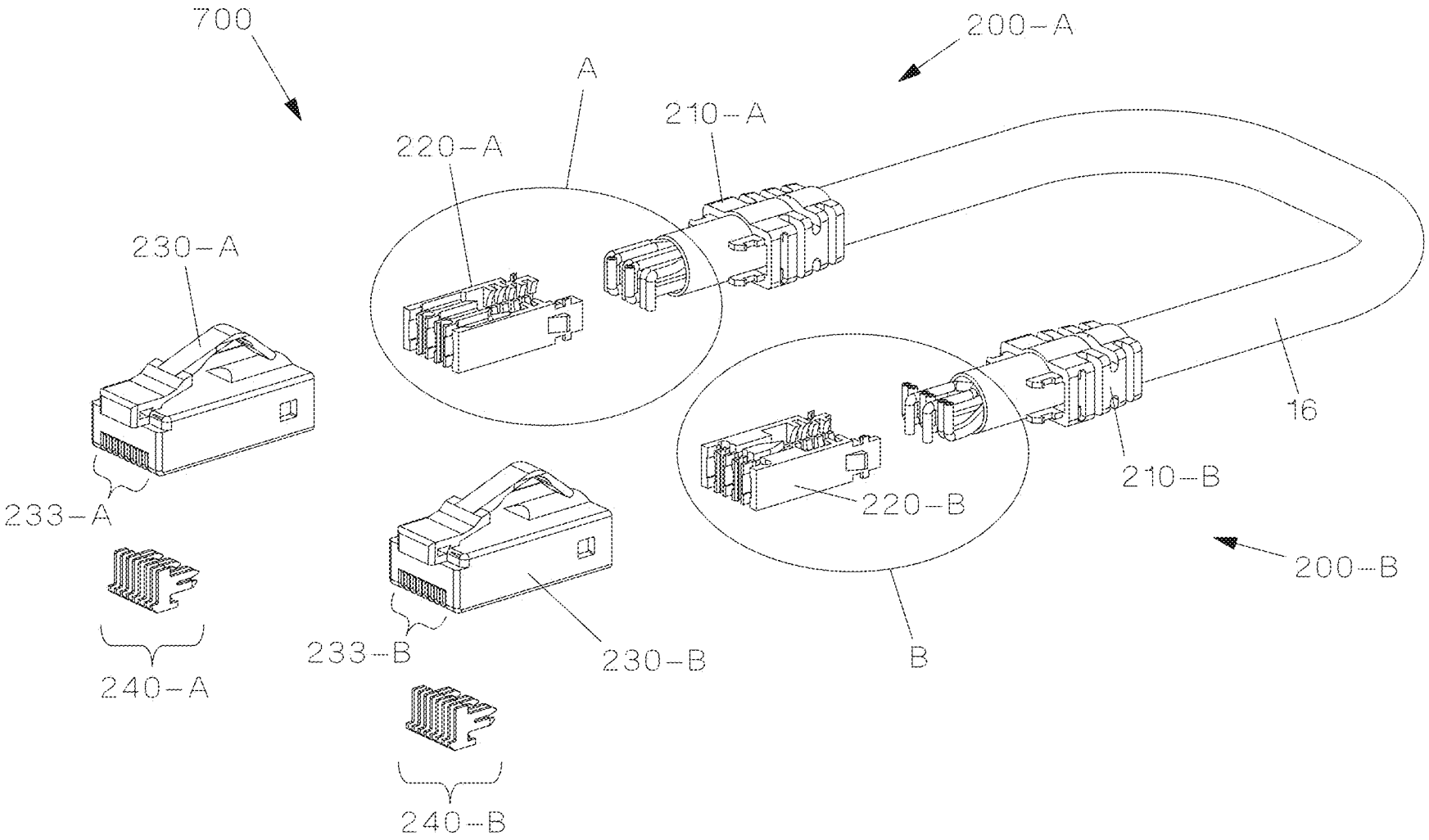
FIG. 12 is a front perspective of the cabling system shown in FIG. 11 including an exploded view of the plug and further including the plug housing shown in FIG. 3.

FIG. 12 shows an exploded view of the cabling system 700 from FIG. 10, where the conductors coming out of the cable 16 are shown in various bent configurations to represent how the conductors would be held within their respective conductor manager 220-A or conductor manager 220-B. FIG. 12 further illustrates the components making up first plug 200-A at a first end of the cable 16, and the components making up the second plug 200-B at a second end of the cable 16. Both the first plug 200-A and the second plug 200-B are copies of the plug 200 described previously, and the reference numbers for both the first plug 200-A and the second plug 200-B have been assigned to refer to respective components of the plug 200 accordingly.

Figure 13:
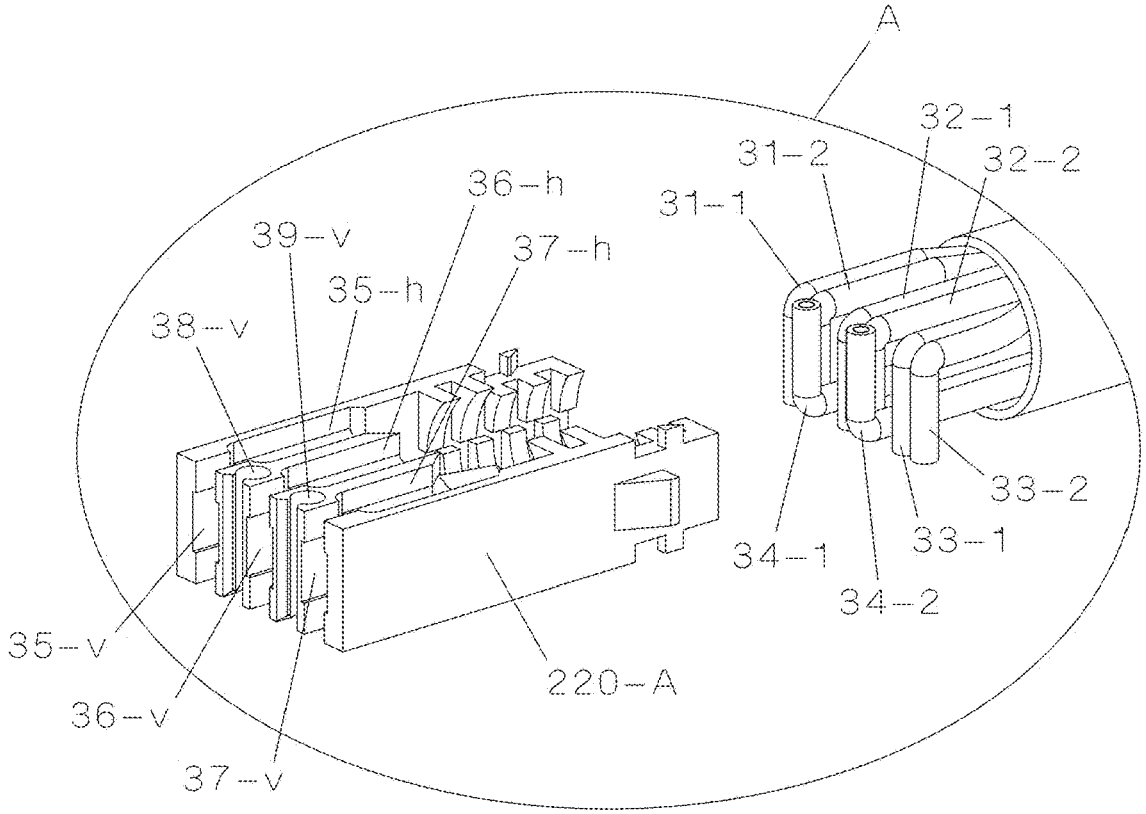
FIG. 13 is an enlarged view of the area A shown in FIG. 12.

FIG. 13 is an enlarged view for the area A shown in the cabling system 700 from FIG. 10. The conductor manager 220-A includes the plurality of conductor channels 35-39, as described previously with reference to conductor manager 220. FIG. 13 specifically shows a top view of the conductor manager 220-A that includes the following three horizontal channels provided on the top-side surface of the conductor manager 220-A: the horizontal channel 35-*h* of the first conductor channel 35, the horizontal channel 36-*h* of the second conductor channel 36, and the horizontal channel 37-*h* of the third conductor channel. Conductors that are held within horizontal channels 35-*h* to 37-*h* are bent 90 degrees to fit through their respective vertical channels 35-*v* to 37-*v*. For example, conductors 31-1 and 31-2 from the first twisted pair 31 are routed through first conductor channel 35, conductors 32-1 and 32-2 from the second twisted pair 32 are routed through second conductor channel 36, and conductors 33-1 and 33-2 from twisted pair 33 are routed through third conductor channel 37. Once in their respective vertical channels 35-*v* to 37-*v*, the conductors are in position to be pierced by their respective long tine IPCs 241.

Figure 14:
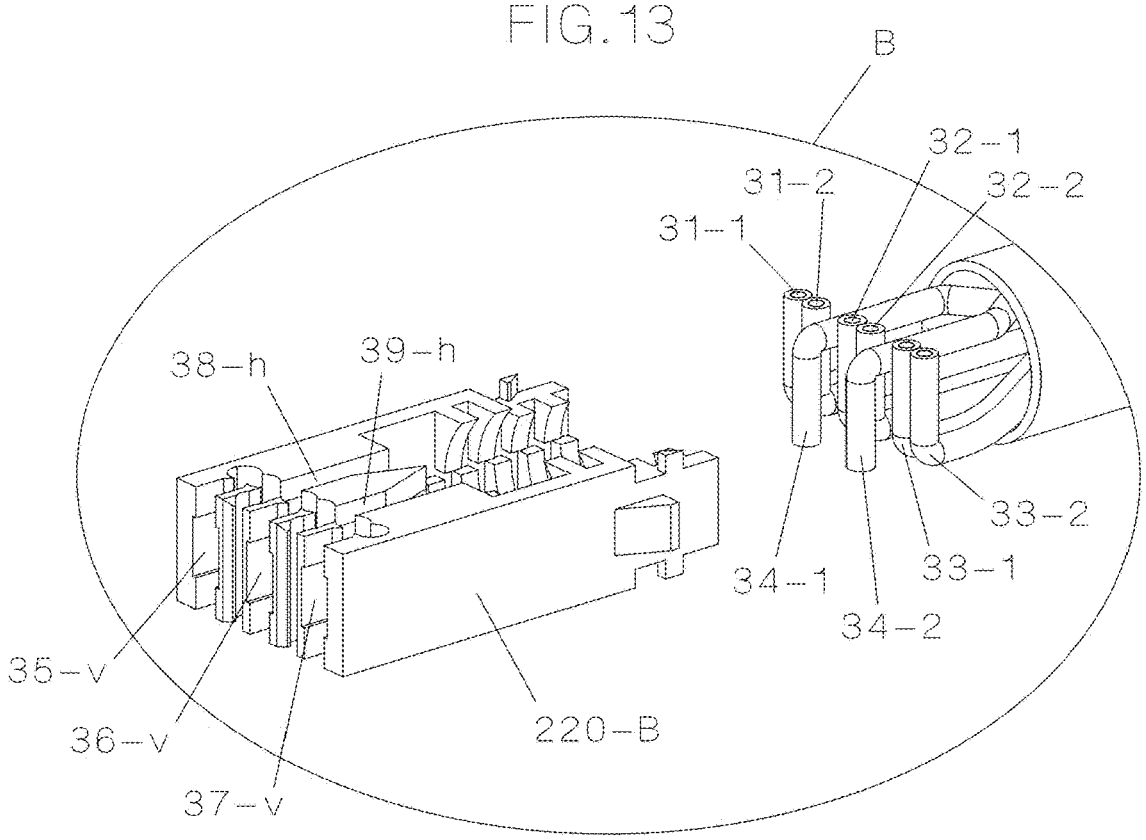
FIG. 14 is an enlarged view of the area B shown in FIG. 12.

FIG. 14 is an enlarged view for the area B shown in the cabling system 700 from FIG. 12. The conductor manager 220-B includes the plurality of conductor channels 35-39, as described previously with reference to conductor manager 220. FIG. 14 specifically shows a bottom-side view of the conductor manager 220-B that includes the following two horizontal channels provided on the bottom-side surface of the conductor manager 220-B: the horizontal channel 38-*h* of the fourth conductor channel 38, and the horizontal channel 39-*h* of the fifth conductor channel 39. Conductors that are held within horizontal channels 38-*h* to 39-*h* are bent 90 degrees to fit through their respective vertical channels 38-*v* to 39-*v*. For example, conductors 34-1 and 34-2 from the fourth twisted pair 34 are routed through conductor channels 38 and 39, respectively. Once in their respective vertical channels 38-*v* to 39-*v*, the conductors are in position to be pierced by their respective short tine IPCs 242.

The front-side of the conductor manager 220-A, as well as the front-side of the conductor manager 220-B, is also shown to include exposed openings for each of the vertical channels 35-*v* to 39-*v* of the first to fifth conductor channels. These exposed openings allow a tine of an IPC 240 to be inserted to make electrical contact with a conductor held within the respective vertical channel.

Figure 15:
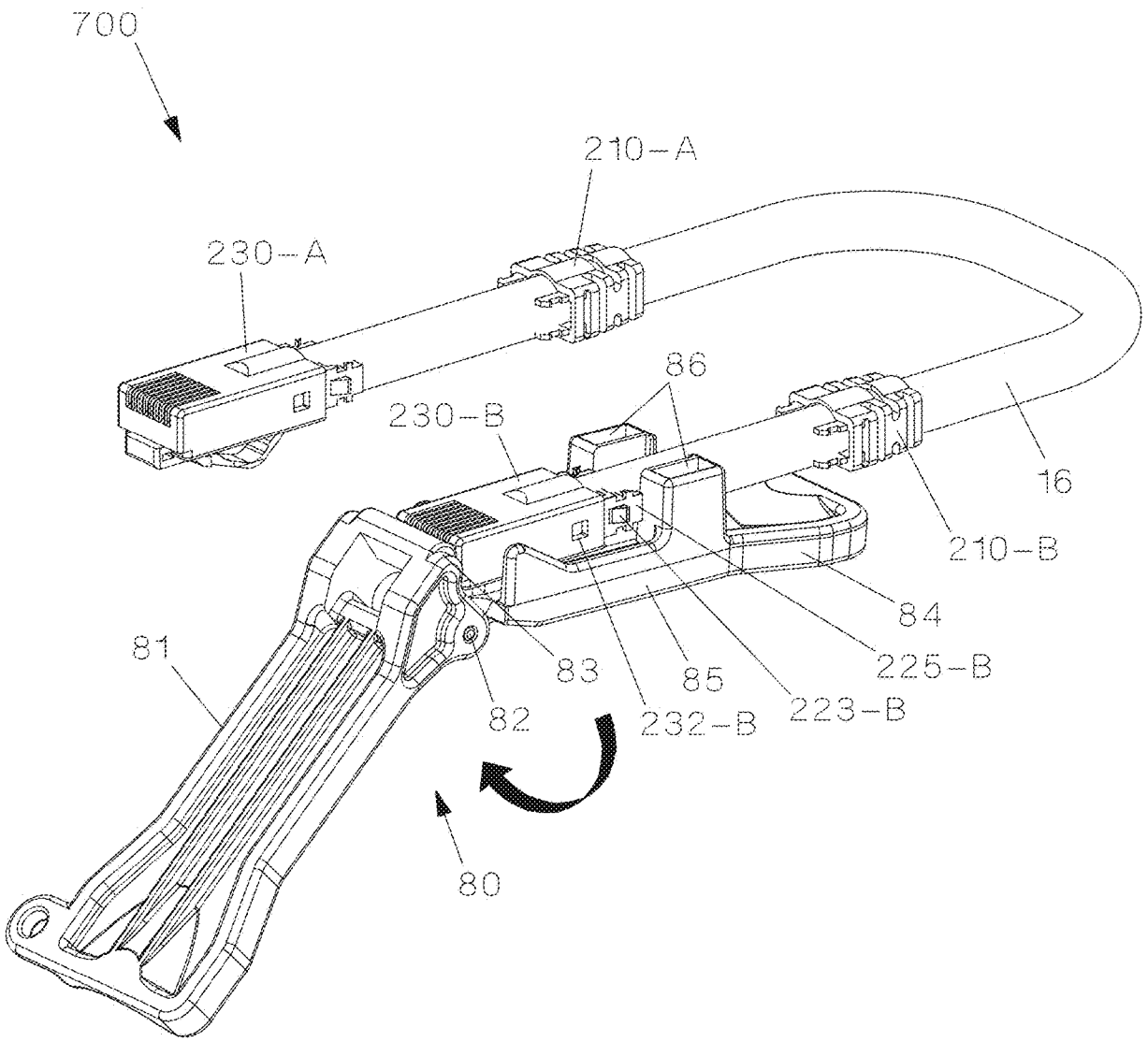
FIG. 15 is a front perspective view of the cabling system shown in FIG. 12 and further including a termination tool for assembling the complete plug assembly.

FIG. 15 shows a termination tool 80 for completing the termination installation process by bringing the plug housing 230-B (being loaded with the IPCs 240) and the conductor manager 220-B together into an assembled state. In this assembled state, the IPCs 240 loaded into their respective IPC openings 233 will move into contact with the conductors held in the conductor manager 220-B to pierce an insulation layer on the conductors and bring the IPCs 240 into electrical contact with the conductors.

The termination tool 80 includes a tool lever 81, a pin 82, an anvil 83, a rotatable lever 84, a chamber 85, and abutments 86. To terminate each cable end of the cable 16, a partially assembled second plug 200-B that includes the plug housing 230-B and the conductor manager 220-B is placed into the chamber 85 as shown in FIG. 15. The second plug 200-B is described as being partially assembled as it only includes the plug housing 230-B and the conductor manager 220-B, where the conductor manager 220-B is not yet fully inserted into the plug housing 230-B.

The tool lever 81 is rotated as shown around pin 82. With the rotation of the tool lever 81, the anvil 83 abuts against the front surface of the plug housing 230-B, and pushes the plug housing 230-B back towards the abutments 86 at the back of the chamber 85. As the abutment arms 225-B of the conductor manager 220-B are held against the abutments 86 preventing further axial movement of the conductor manager 220-B, the plug housing 230-B continues its axial movement over the conductor manager 220-B until full engagement is achieved when the latches 223-B engage the windows 232-B. When full engagement is achieved, the IPCs 240 held in the plug housing 230-B will come into electrical contact with the conductors held in the conductor manager 220-B. So unlike other plug assemblies where IPCs may be the final installation step into an otherwise assembled plug, for the second plug 200-B the IPCs 240 are installed into the plug housing 230-B prior to the final termination step. Here, the axial movement of the plug housing 230-B with relation to the conductor manager 220-B to transition into the assembled state (e.g., fully assembled state of the plug housing 230-B with the conductor manager 220-B seen in FIG. 16) causes the IPCs 240 to pierce insulation and come into electrical contact with the conductors held in the conductor manager 220-B. Further with the rotation of the tool lever 81, annular ribs 222 of the conductor manager 220-B press against the outer jacket 75 of the cable 16 to grip the outer jacket 75 in position for strain relief.

Figure 16:
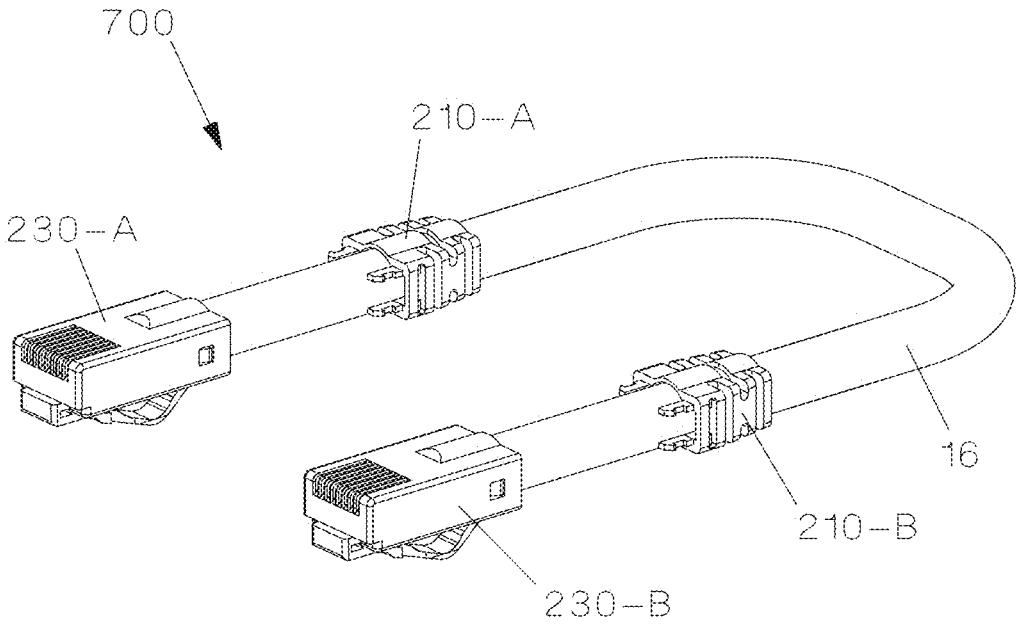
FIG. 16 is a front perspective view of the cabling system shown in FIG. 15 including the complete plug assembly.
Figure 17:
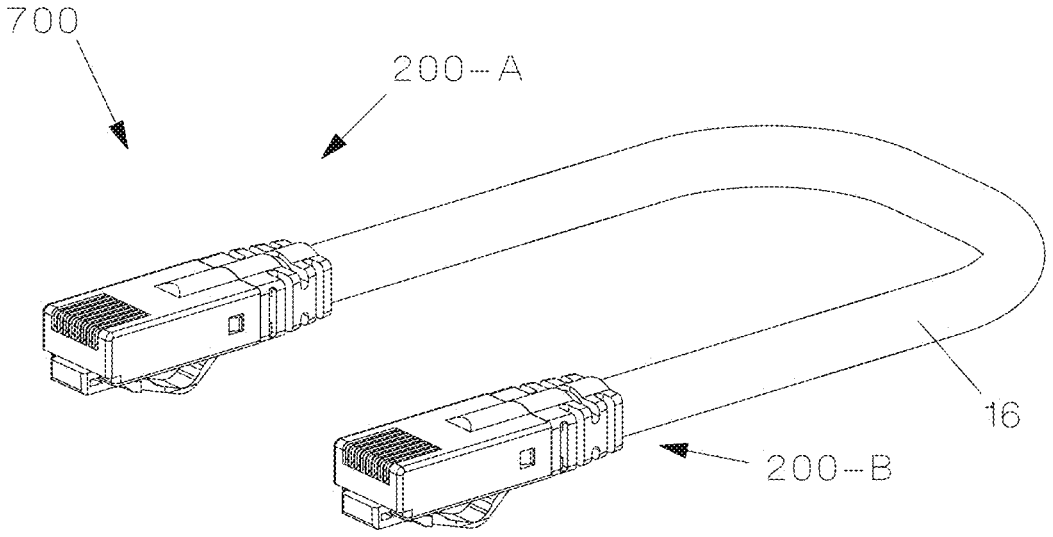
FIG. 17 is a front perspective view of the cabling system shown in FIG. 16 that is rotated top to bottom from the view shown in FIG. 16.

FIG. 16 shows cabling system 700 prior to the plug termination step implemented by the termination tool 80, and FIG. 17 shows cabling system 700 after the termination tool 80 has completed termination of the first plug 200-A and the second plug 200-B at their respective ends on the cable 16.

FIGS. 18-21 show an alternative embodiment of a conductor manager 90 that may replace the conductor manager 220 in the overall design of plug 200, while still managing conductors from cable 16. In this way, the conductor manager 90, as well as the conductor manager 220 and other alternative component designed disclosed herein, may be part of an overall modular plug system design where the conductor manager 90 may be swap out and replace other conductor manager designs.

Conductor manager 90 includes two detachable parts: a back piece 92 and a front piece 94. Enabling full detachment of the front piece 94 from the back piece 92 may allow for easier routing of conductors through the conductor manager 90, and an overall more efficient termination process. Attachment of the front piece 94 to the back piece 92 is provided by engaging latches 93 on the front piece 94 to latches 91 on the back piece 92.

Figure 18:
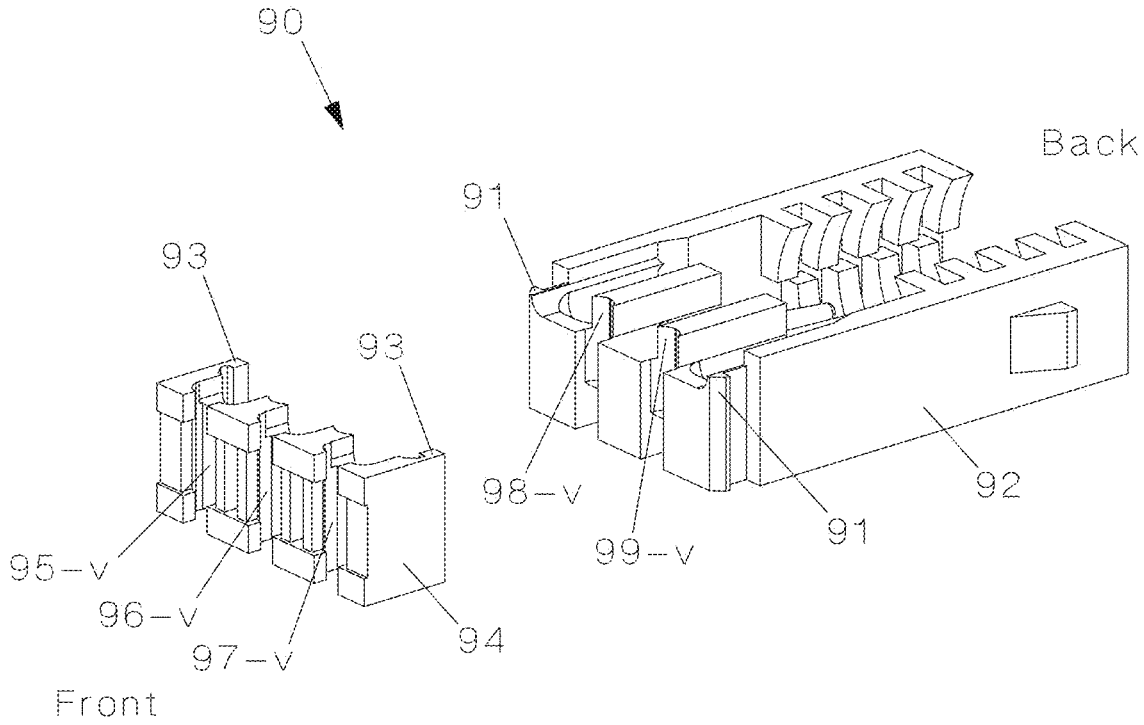
FIG. 18 is an exploded view of a conductor manager, according to another embodiment.
Figure 19:
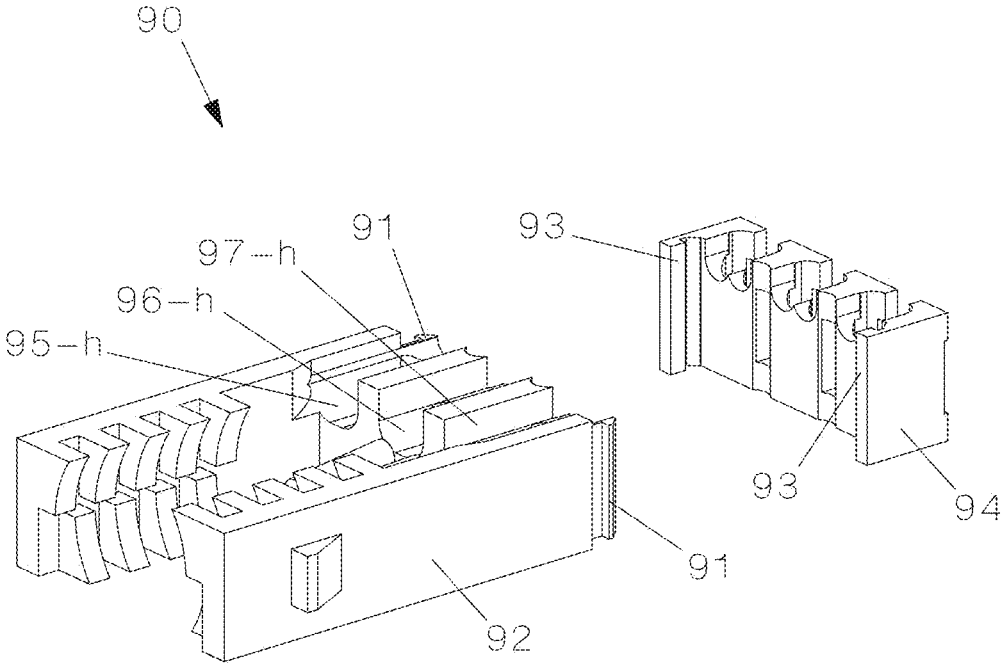
FIG. 19 is an exploded view of the conductor manager shown in FIG. 18 that has been rotated front to back from the view shown in FIG. 18.

Both FIGS. 18-19 show a top view of the conductor manager 90, where the conductor manager 90 in FIG. 19 is rotated front to back while showing the same top-side of the conductor manager 90. A first conductor channel 95 is comprised of a horizontal channel 95-*h* and a vertical channel 95-*v*, and is provided for holding the conductors in the first twisted pair 31. A second conductor channel 96 is comprised of a horizontal channel 96-*h* and a vertical channel 96-*v*, and is provided for holding the conductors in the second twisted pair 32. A third conductor channel 97 is comprised of a horizontal channel 97-*h* and a vertical channel 97-*v*, and is provided for holding the conductors in the third twisted pair 33. A fourth conductor channel 98 is comprised of a horizontal channel 98-*h* (located on a bottom-side surface of the conductor manager 90, not shown) and a vertical channel 98-*v*, and is provided for holding a first conductor in the fourth twisted pair 34. A fifth conductor channel 99 is comprised of a horizontal channel 99-*h* (located on a bottom-side surface of the conductor manager 90, not shown) and a vertical channel 99-*v*, and is provided for holding a second conductor in the fourth twisted pair 34.

Figure 20:
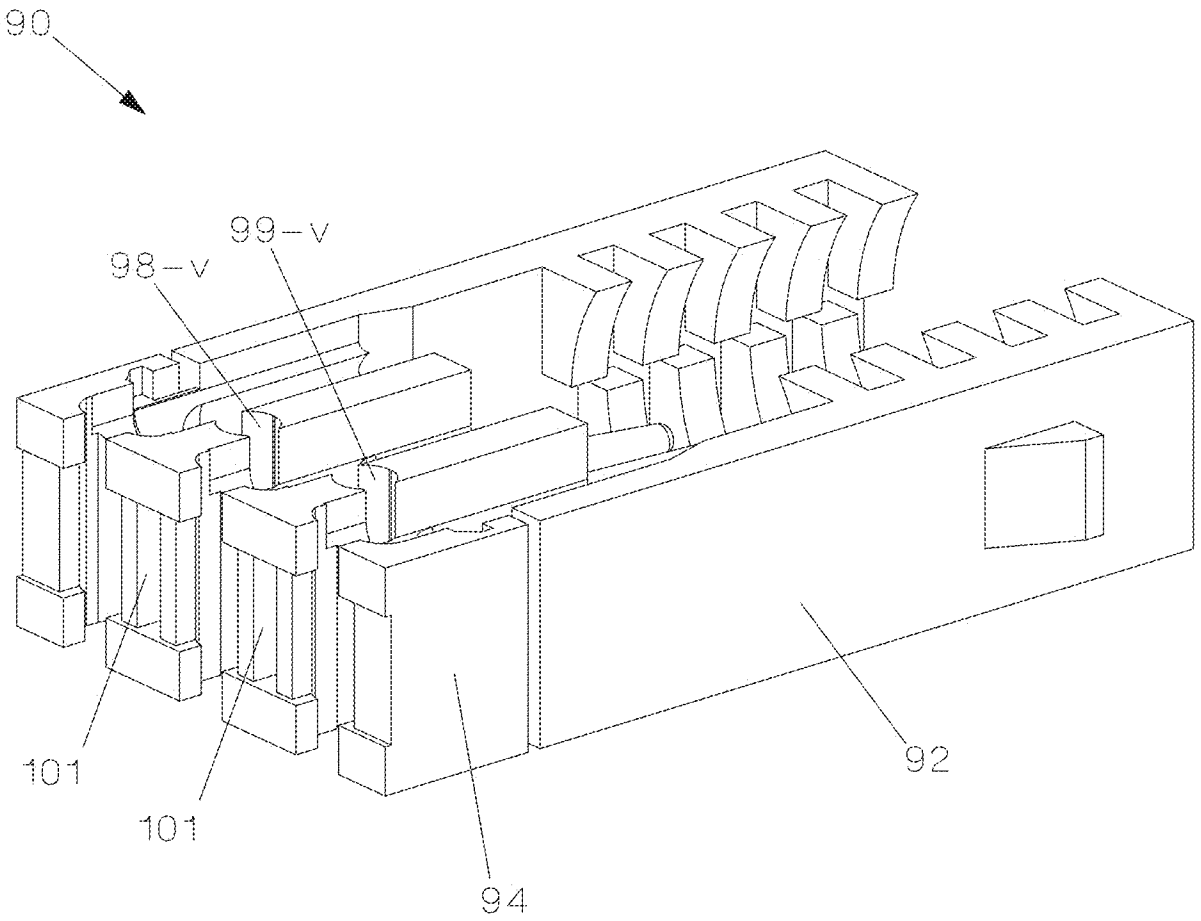
FIG. 20 is a front perspective view of the conductor manager shown in FIG. 18 in an assembled state.

FIG. 20 shows the conductor manager 90 in an assembled state where the front piece 94 is attached to the rear piece 92 via engagement of the latches 93 and latches 91. FIG. 20 further shows insertion holes 101 that are on a front-side surface of the front piece 94. The insertion holes 101 allow long tines of an alternative embodiment IPC to enter and make electrical contact with conductors housed within the vertical channel 98-*v* and the vertical channel 99-*v*. During an installation process, conductors 34-1 and 34-2 from the fourth twisted pair 34 may be routed into vertical channel 98-*v* and vertical channel 99-*v* prior to the remaining vertical channels 95-*v* to 97-*v*. Portions of the front piece 94 facing the front-side are left open to allow short tines of the alternative embodiment IPC to enter and make electrical contact with conductors within vertical channels 95-*v* to 97-*v*. The alternative embodiment IPC for making electrical contact with conductors held in the conductor manager 90 is similar to the IPC 240, however the alternative embodiment IPC is comprised of three short tine IPCs and two long tine IPCs.

Figure 21:
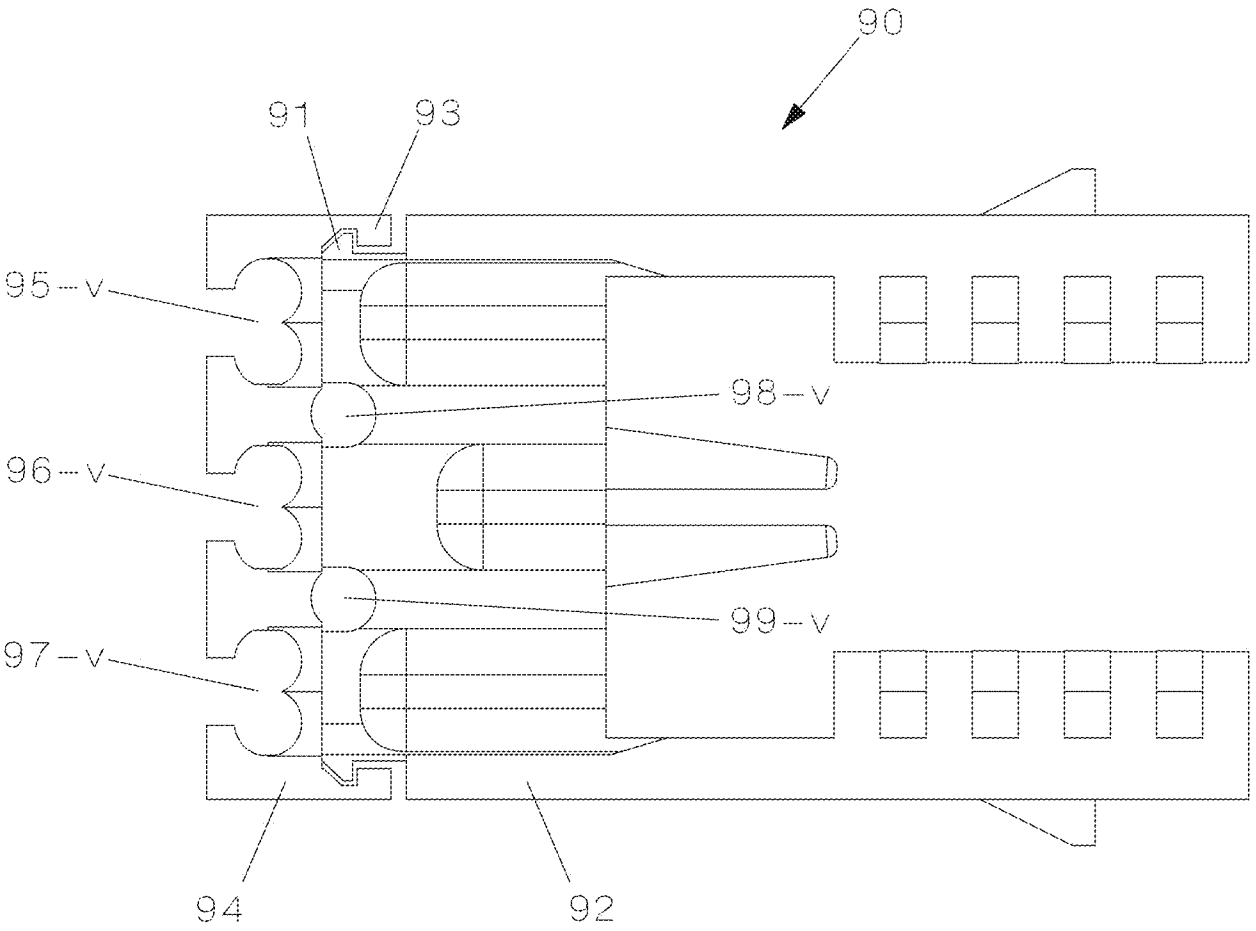
FIG. 21 is a top view of the conductor manager shown in FIG. 20.

FIG. 21 is a top view of the conductor manager 90. This top view illustrates how vertical channels 98-*v* and 99-*v* are staggered from the remaining vertical channels 95-*v* to 97-*v*.

Figure 22:
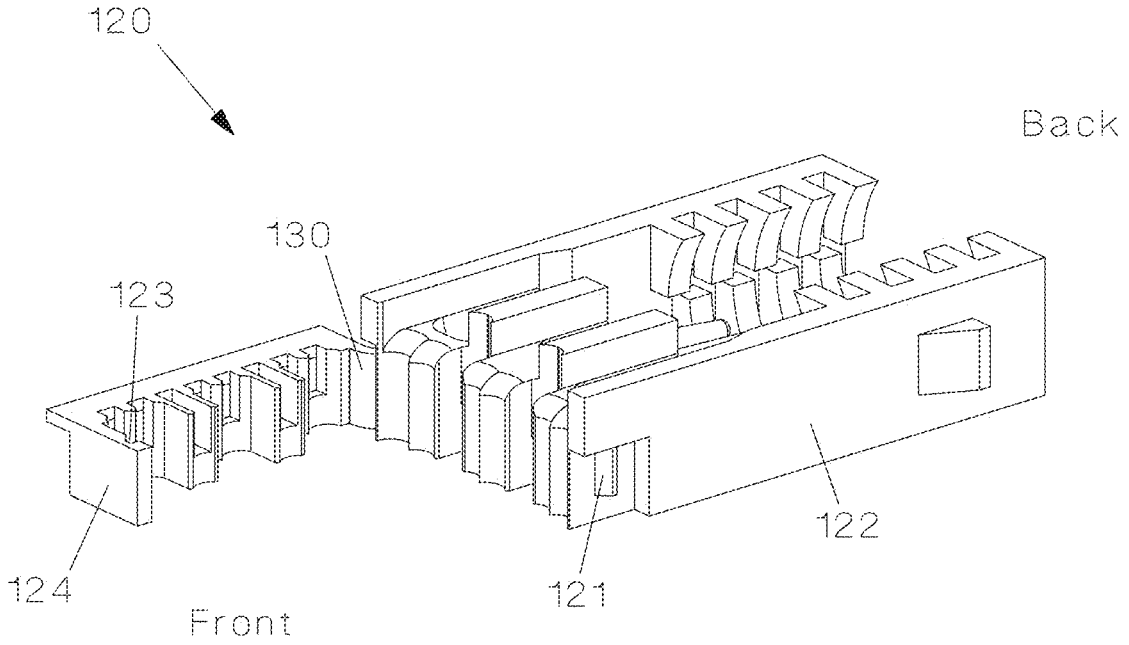
FIG. 22 is a front perspective view of a conductor manager, according to another embodiment.
Figure 23:
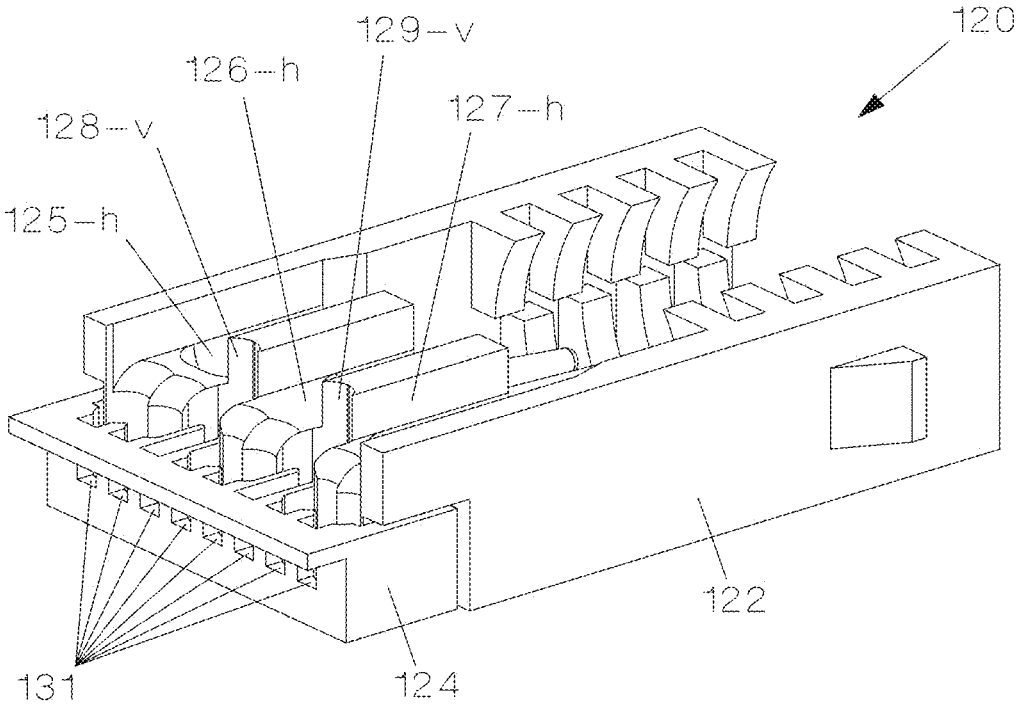
FIG. 23 is a front perspective view of the conductor manager shown in FIG. 22 in an assembled state.
Figure 24:
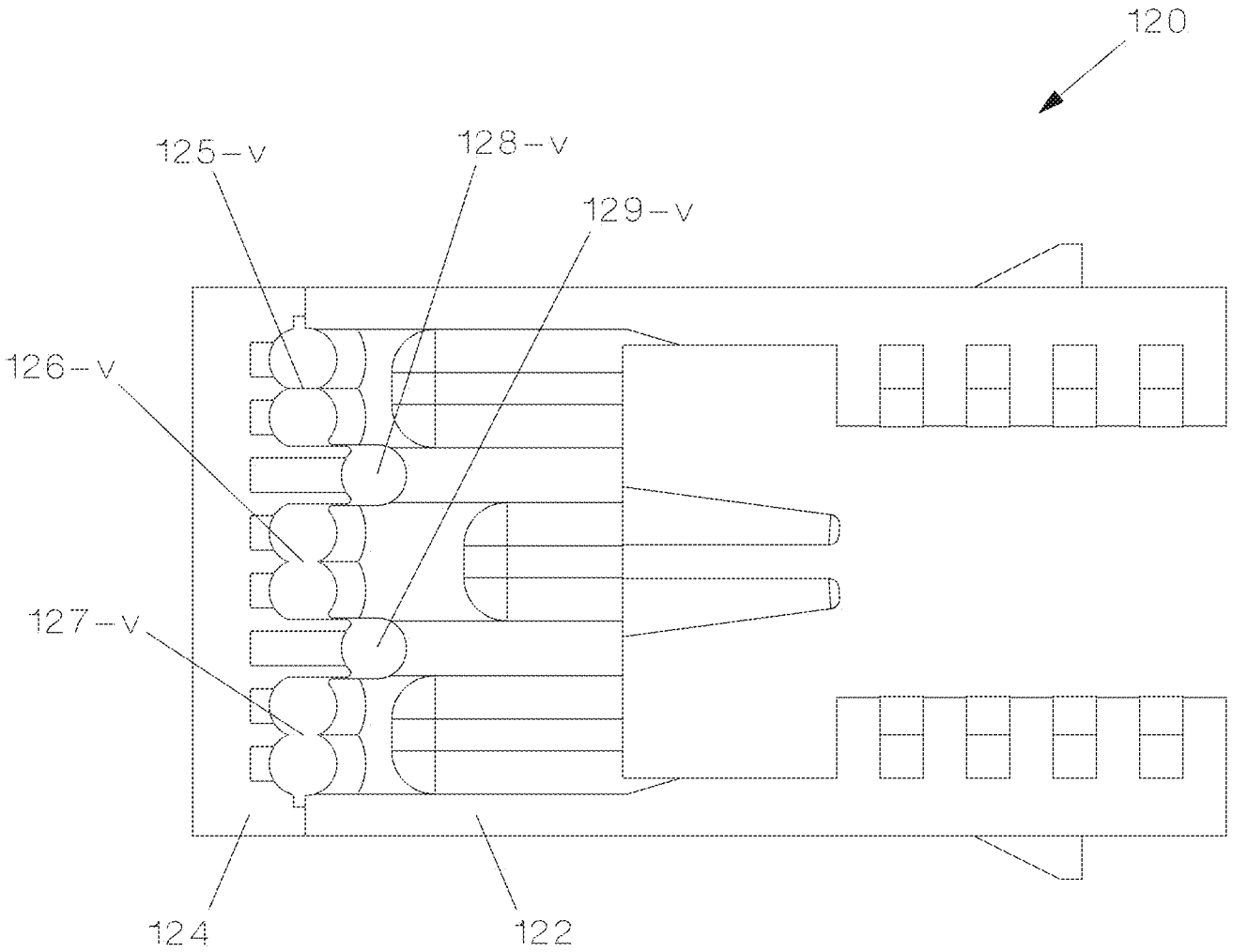
FIG. 24 is a top view of the conductor manager shown in FIG. 22.

FIGS. 22-24 show an alternative embodiment of a conductor manager 120 that may replace the conductor manager 220 in the overall design of plug 200, while still managing conductors from cable 16. The conductor manager 120 is comprised of a front piece 124 and a back piece 122, where the front piece 124 and the back piece 122 are connected via an integral hinge 130 at one end. FIG. 22 shows the conductor manager 120 in an open state where the front piece 124 is hinged open and detached from the back piece 122 at an unhinged end. FIG. 23 shows the conductor manager 120 in a closed state where the front piece 124 is attached to the back piece 122 at the unhinged end. The front piece 124 is attached to the back piece 122 at the unhinged end through engagement of latch 123 on the front piece 124 with latch 121 on the back piece 122.

FIG. 23 shows horizontal channels 125-*h* to 127-*h* for carrying conductors from twisted pairs 31-33, respectively, along a top-side surface of the conductor manager 120. FIG. 23 further shows vertical channels 128-*v* and 129-*v* for holding individual conductors from the fourth twisted pair 34. FIG. 23 further shows a plurality (e.g., eight) of insertion holes 131 for receiving the insulation piercing tines from the alternative embodiment IPC that comprises three short tine IPCs and two long tine IPCs. The short tine IPCs are inserted into the respective insertion holes 131 corresponding to vertical channels 125-*v* to 127-*v*, while the long tine IPCs are inserted into respective insertion holes 131 corresponding to vertical channels 128-*v* to 129-*v*. The vertical channels 125-*v* to 129-*v* are shown in the top view of FIG. 24.

Figure 25:
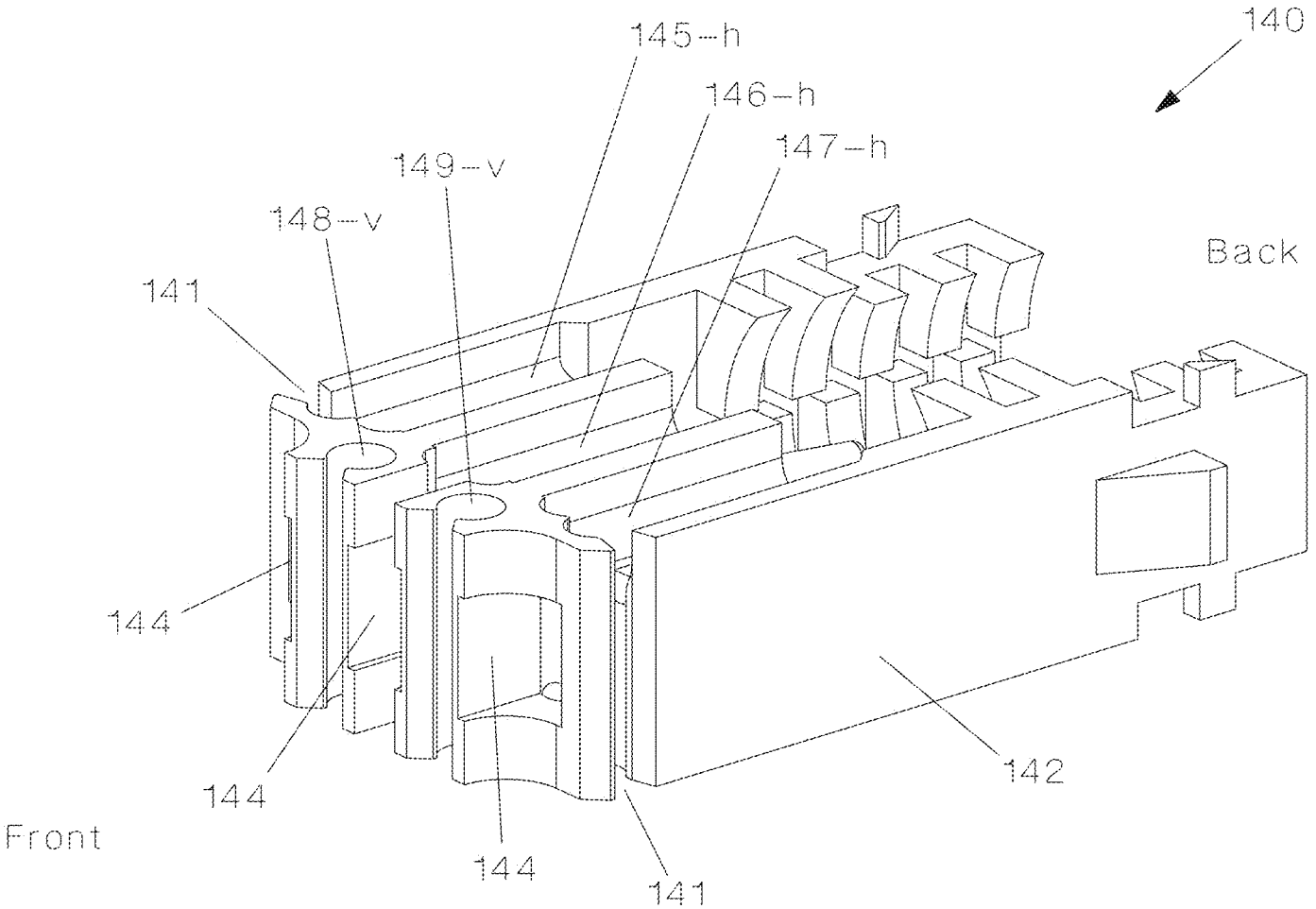
FIG. 25 is a front perspective view of a conductor manager, according to another embodiment.
Figure 26:
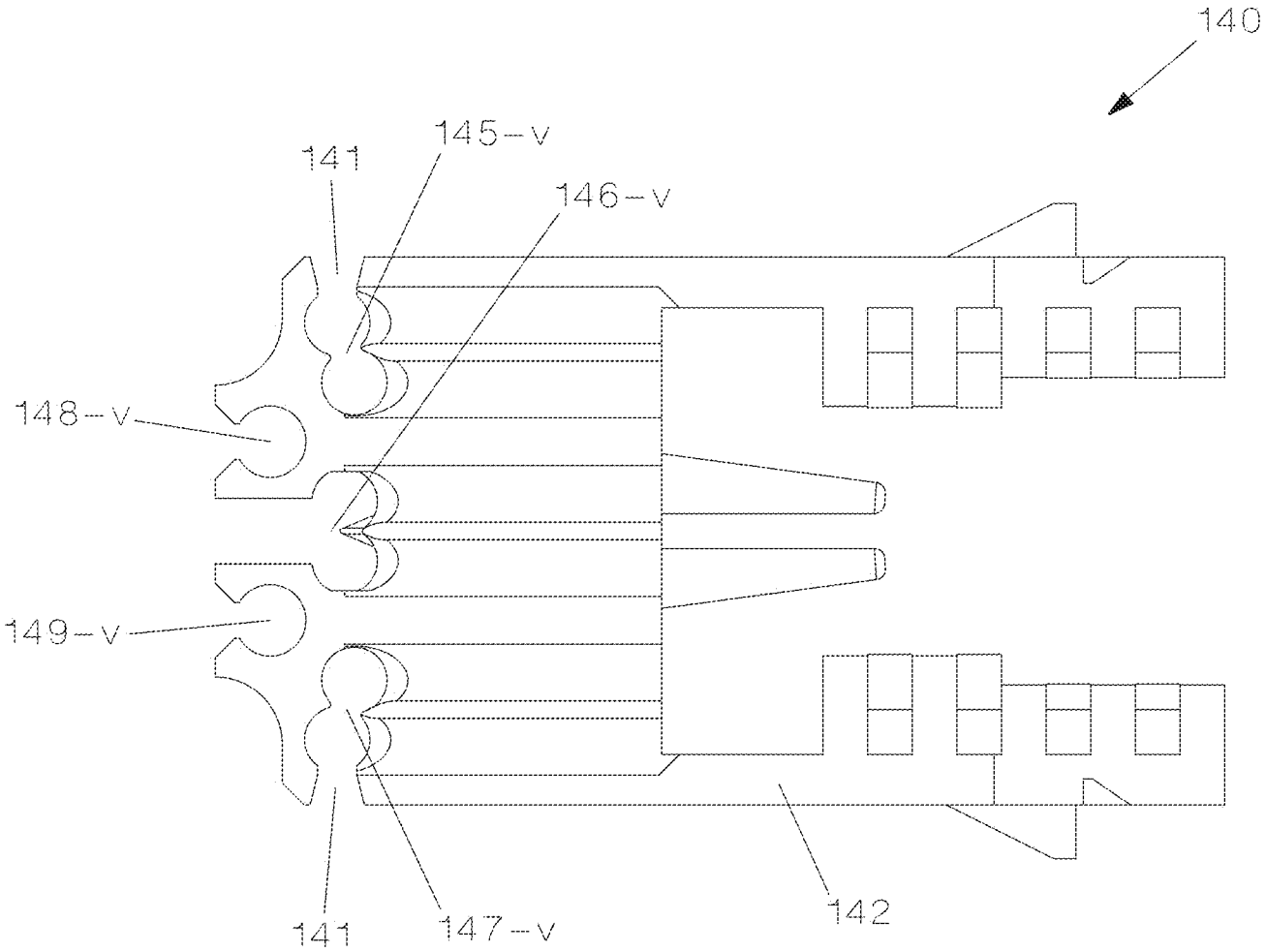
FIG. 26 is a top view of the conductor manager shown in FIG. 25.

FIGS. 25-26 show an alternative embodiment of a conductor manager 140 that may replace the conductor manager 220 in the overall design of plug 200, while still managing conductors from cable 16. The conductor manager 140 is comprised of a body 142 that includes a plurality of conductor channels. For example, conductor manager 140 includes a first conductor channel 145 comprised of horizontal channel 145-*h* and vertical channel 145-*v* for routing conductors in the first twisted pair 31. A second conductor channel 146 comprised of horizontal channel 146-*h* and vertical channel 146-*v* is also included for routing conductors in the second twisted pair 32. A third conductor channel 147 comprised of horizontal channel 147-*h* and vertical channel 147-*v* is also provided for routing conductors in the third twisted pair 33. A fourth conductor channel 148 comprised of horizontal channel 148-*h* and vertical channel 148-*v* is provided for routing a conductor from the fourth twisted pair 34, and a fifth conductor channel comprised of horizontal channel 149-*h* and vertical channel 149-*v* is provided for routing a conductor from the fourth twisted pair 34.

As shown by the top view in FIG. 26, side openings 141 are provided for vertical channel 145-*v* and 147-*v* to provide easier access for routing conductors. For example, when conductors from the first twisted pair 31 are routed into vertical channel 145-*v*, they may be bent 90 degrees and inserted through the side opening 141. Similarly, when conductors from the third twisted pair 33 are routed into vertical channel 147-*v*, they may be bent 90 degrees and inserted through the side opening 141. FIG. 25 also shows insertion openings 144. The insertion openings 144 allow the long tine IPCs 241 to enter and make electrical contact with conductors housed within the vertical channels 145-*v* to 147-*v*. Vertical channels 148-*v* and 149-*v* include an opened exposure towards the front-end of the conductor manager 140 to allow the short tine IPCs 242 to enter and make electrical contact with conductors housed within the vertical channels 148-*v* and 149-*v*.

FIG. 26 also illustrates the various offsets of the vertical channels with relation to each other. For example, vertical channels 145-*v* to 147-*v* are offset from vertical channels 148-*v* and 149-*v*. Further, vertical channels 145-*v* and 147-*v* are shown to be angled with comparison to vertical channel 146-*v*.

Figure 27:
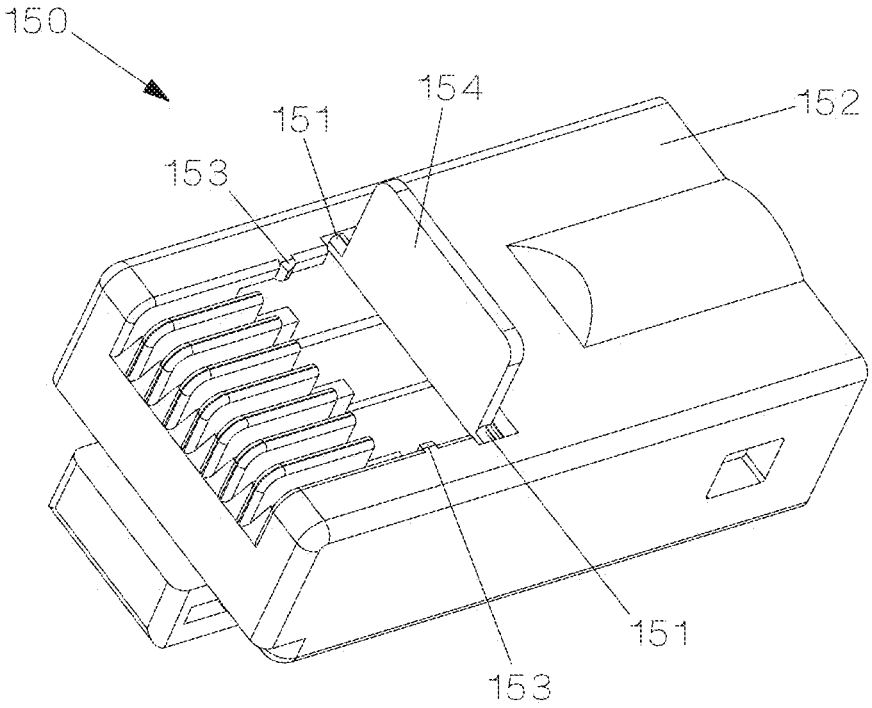
FIG. 27 is a front perspective view of a plug housing, according to another embodiment, where a cover is in an open state.
Figure 28:
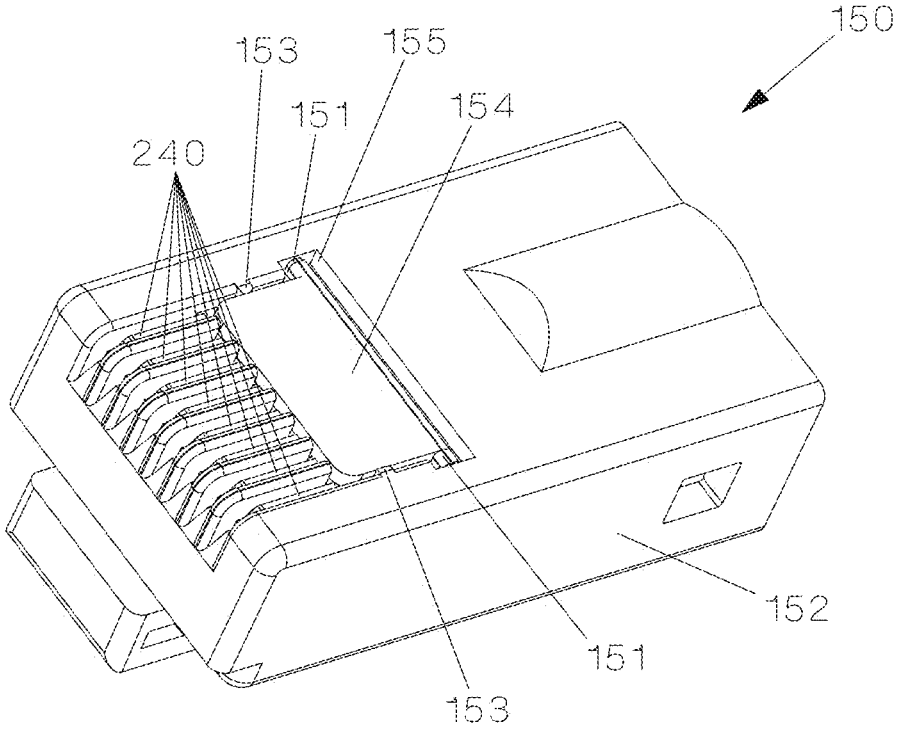
FIG. 28 is a front perspective view of the plug housing shown in FIG. 27, where the cover is in a closed state.

FIGS. 27-28 show an alternative embodiment for a plug housing 150 that may replace the plug housing 230 in the overall design of plug 200. The plug housing includes a housing body 152 and a cover 154 configured to rotate between an open position and a closed position. The cover 154 is shown in the open position in FIG. 27, and in the closed position in FIG. 28. The cover 154 is transitioned to the closed position in FIG. 28 after the IPCs 240 have been installed into the plug housing 150 to secure the IPCs 240 inside the plug housing 150. Any alternative embodiment IPC having a different combination of short tine and long tine IPCs may also be installed into the plug housing 150.

The cover 154 includes arms 151 at two opposite ends, where the arms 151 extend out and fit within a receiving cavity 155 provided on the housing body 152. The housing body 152 further includes retainers 153 that are provided to abut and push against the cover 154 when the cover 154 is in the closed position, as illustrated in FIG. 28.

Figure 29:
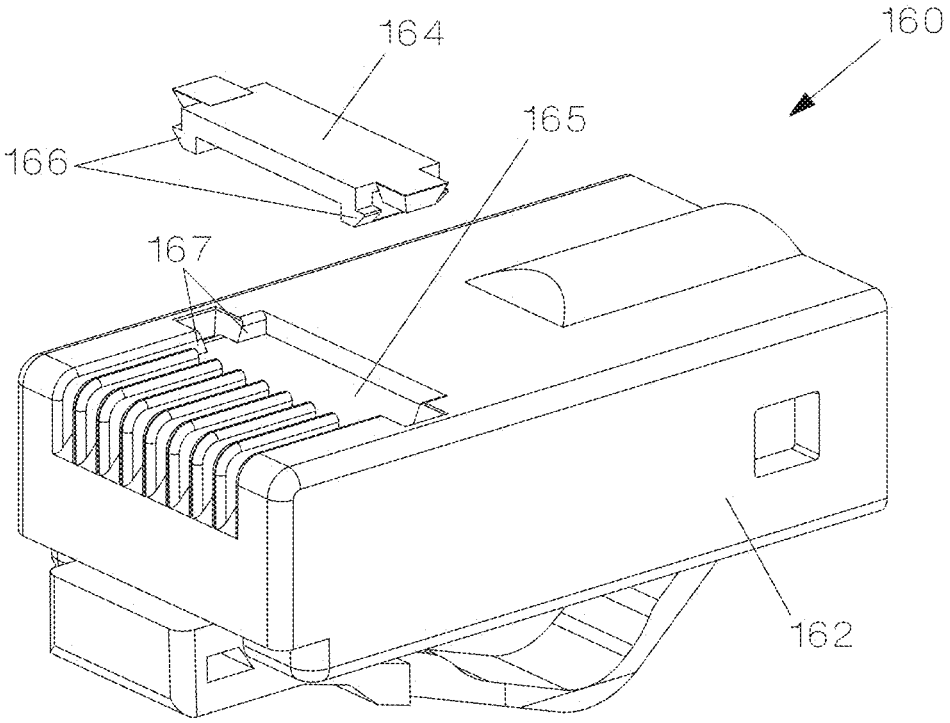
FIG. 29 is a front perspective view of a plug housing, according to another embodiment, where a detachable cover is in a detached state.
Figure 30:
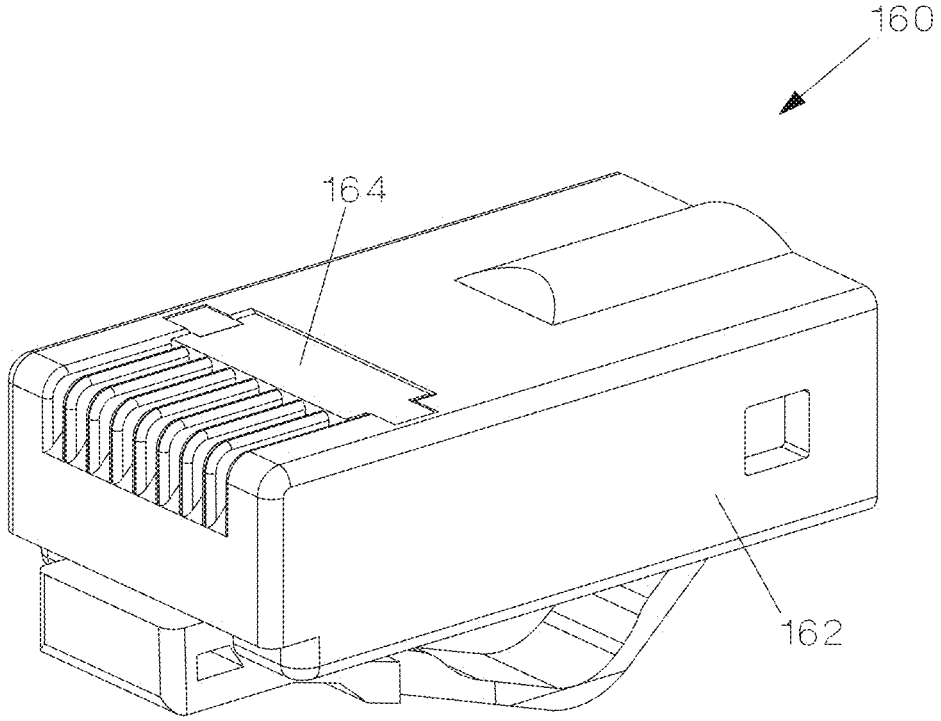
FIG. 30 is a front perspective view of the plug housing shown in FIG. 29, where the detachable cover is in an attached state.

FIGS. 29-30 shows an alternative embodiment for a plug housing 160 that may replace the plug housing 230 in the overall design of plug 200. The plug housing 160 includes a housing body 162 and a detachable cover 164. The detachable cover 164 is designed to fit and be secured into a receiving cavity 165 on the housing body 162. The detachable cover 164 includes latches 166 for engaging latch stops 167 on the housing body 162 when the detachable cover 164 is inserted into an attached closed position as shown in FIG. 30. The detachable cover 164 is placed into the closed position after the IPCs 240 have been installed into the plug housing 160 to secure the IPCs 240 inside the plug housing 160.

Figure 31:
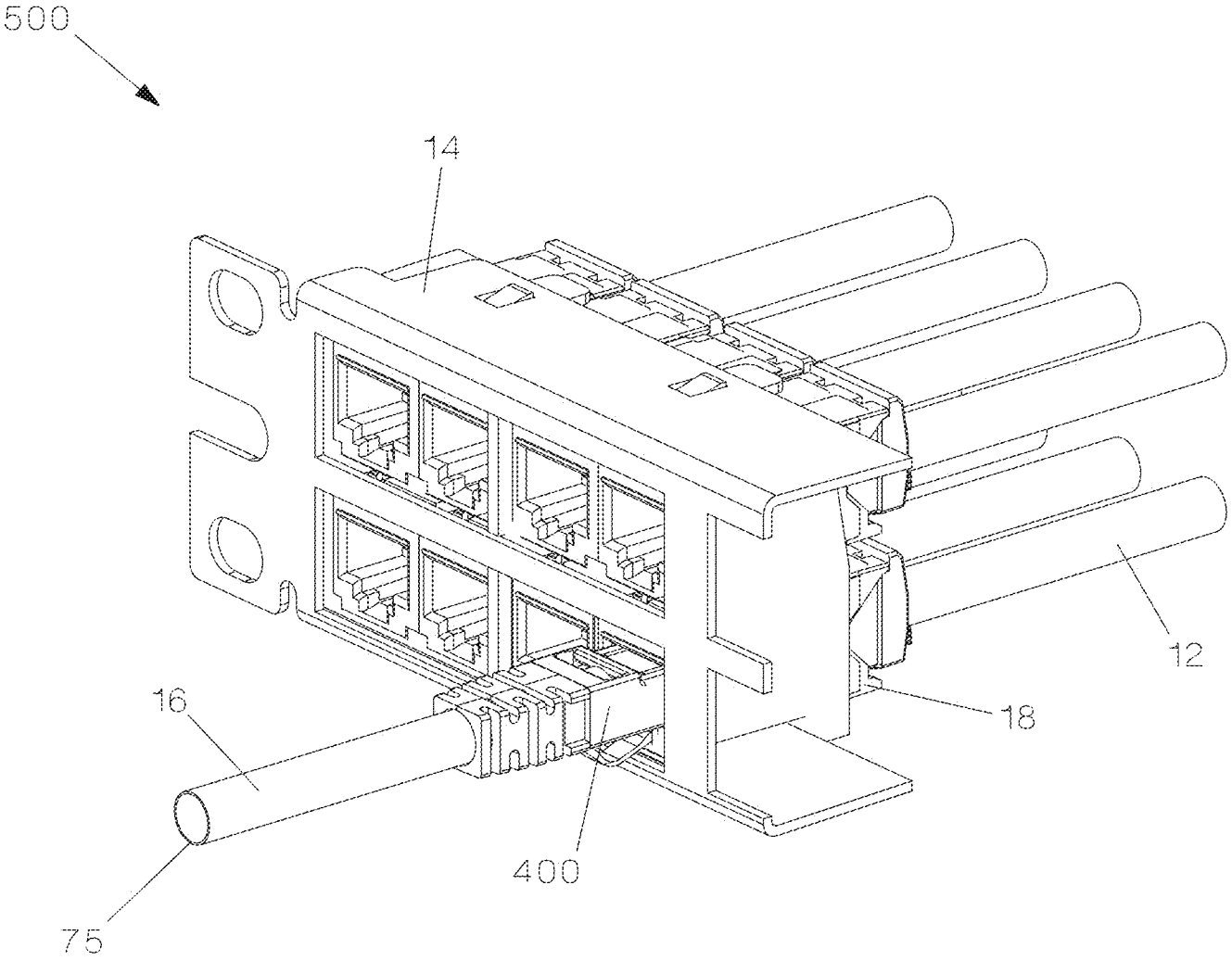
FIG. 31 is a front perspective view of a communication system including a plug, according to another embodiment.

FIG. 31 illustrates an exemplary communication system 500 according to an alternative embodiment, where the communication system 500 includes an alternative plug 400 that is configured to communicate with electrical equipment 14 through a corresponding jack 18. The communication system 500 further includes cable 16, where the cable 16 includes an outer jacket 75 for covering a plurality of twisted pairs of conductors (e.g., insulated wires). By terminating the cable 16 with the plug 400, the plug 400 is inserted into the jack 18 and communicate data transmitted within the cable 16 to internal cable 12 of the electrical equipment 14, as well as receive data transmitted from the internal cable 12. The electrical equipment 14 shown in FIG. 31 is the same as shown in FIG. 1.

Figure 32:
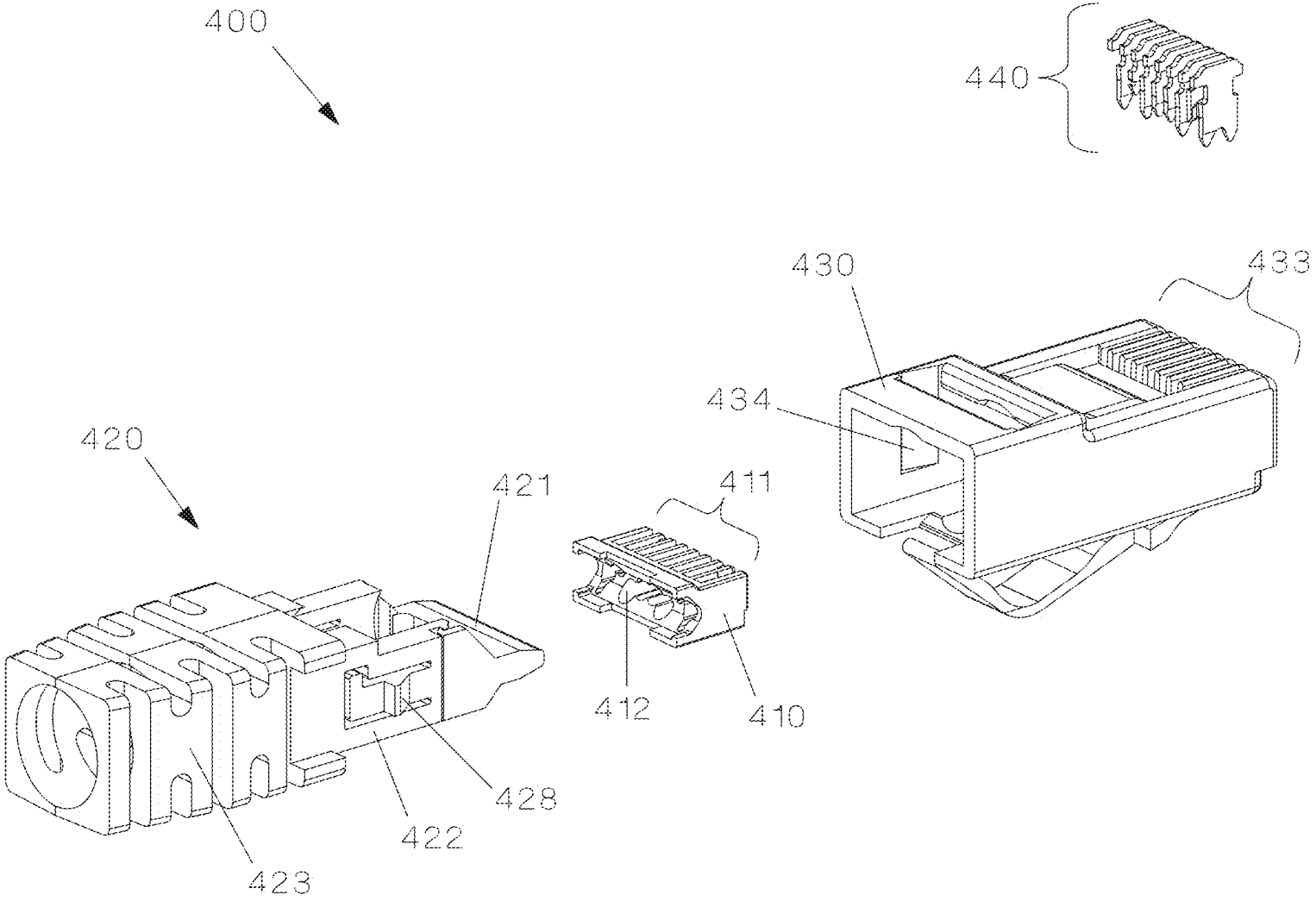
FIG. 32 is an exploded view of the plug shown in FIG. 31.

FIG. 32 illustrates an exploded view of the plug 400 showing the individual components that comprise the plug 400, including a plug housing 430, a load bar 410, a conductor manager assembly 420, and IPCs 440. To implement an assembled state, the conductor manager assembly 420 and load bar 410 holding the conductors are loaded into the plug housing 430 such that latches 428 on the conductor manager assembly 420 engage and fit into latch pockets 434 of the plug housing 430. In this assembled state, contact slots 411 included in the load bar 410 are aligned with their respective IPC openings 433 in the plug housing 430. With this alignment, when each IPC 440 is inserted into their respective IPC opening 433 as a final step in the plug termination process, each IPC 440 will also be received into their respective contact slot 411 to make contact with a conductor held in a respective conductor hole 412 of the load bar 410. So unlike plug 200, for plug 400 the insulation piercing step of the IPCs 440 is saved a final step in the termination process, where the IPCs 440 are inserted down into the IPC openings 433 of the plug housing 430 after the conductor manager assembly 420 and the load bar 410 holding the conductors are brought together into the assembled state.

Figure 33:
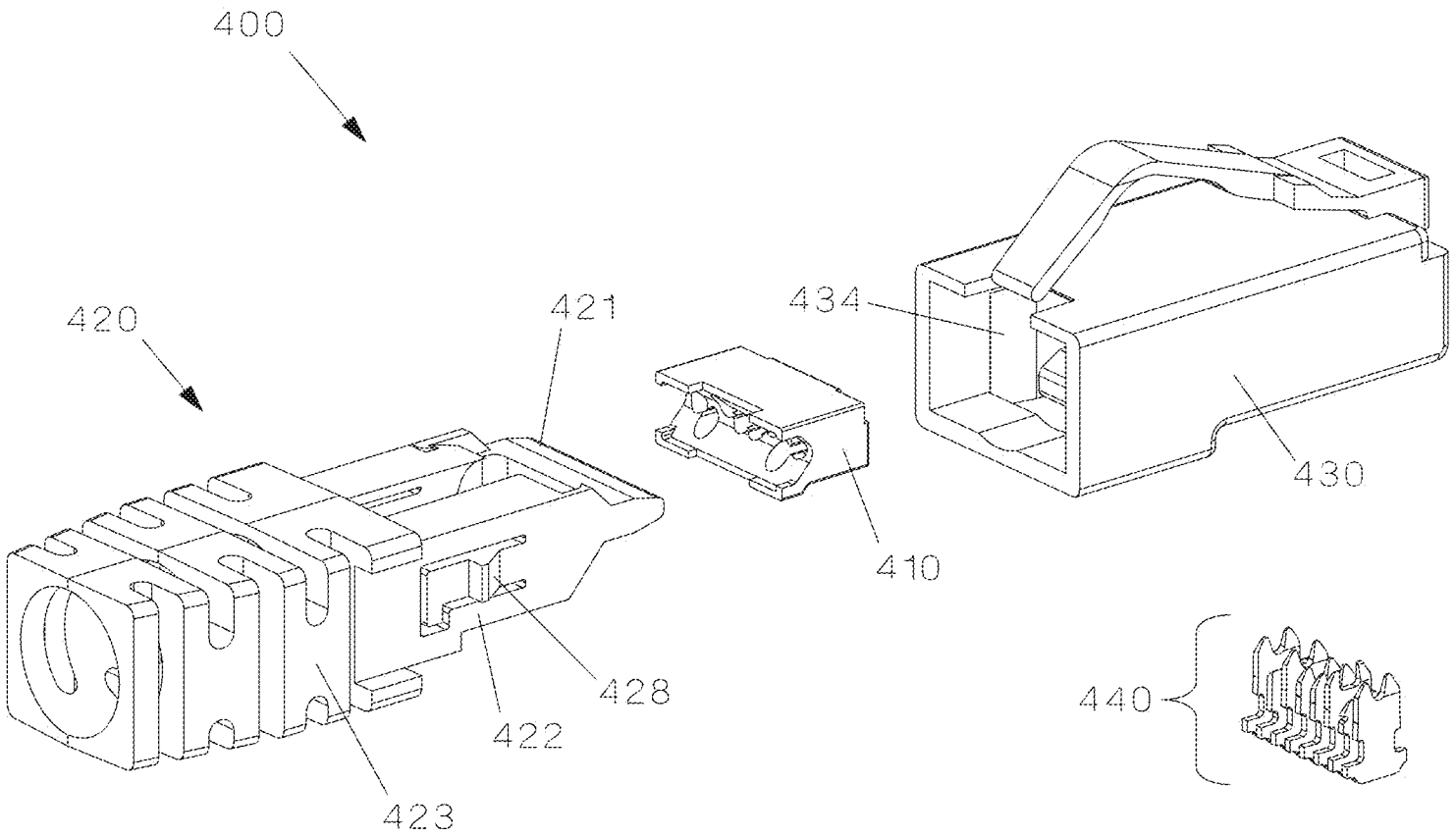
FIG. 33 is an exploded view of the plug shown in FIG. 32 that is rotated top to bottom from the view shown in FIG. 32.

The conductor manager assembly 420 is a single piece comprised of a strain relief boot 423, a body 422, and a divider 421. The body 422 includes latches 428 for engaging with latch pockets 434 found on an internal cavity surface of the plug housing 430. The conductor manager assembly 420 is configured to abut against the load bar 410 and push the load bar 410 into the cavity of the plug housing 430. When the conductor manager assembly 420 is pushed far enough into the cavity of the plug housing 430, the latches 428 on the body 422 will engage the latch pockets 434 found inside the cavity of the plug housing 430 to secure the conductor manager assembly 420 and the load bar 410 within the plug housing 430. FIG. 33 illustrates the plug 400 shown in a top to bottom rotated view from the view shown in FIG. 32.

Figure 34:
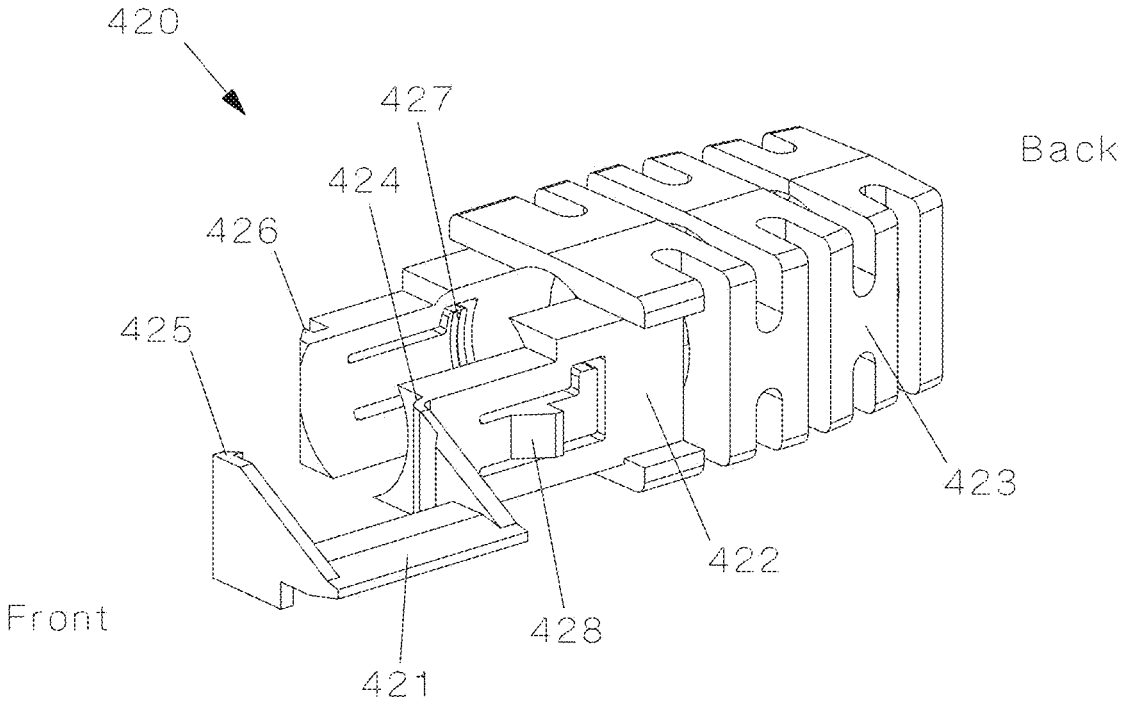
FIG. 34 is a front perspective view of a conductor manager assembly included in the plug shown in FIG. 32.
Figure 35:
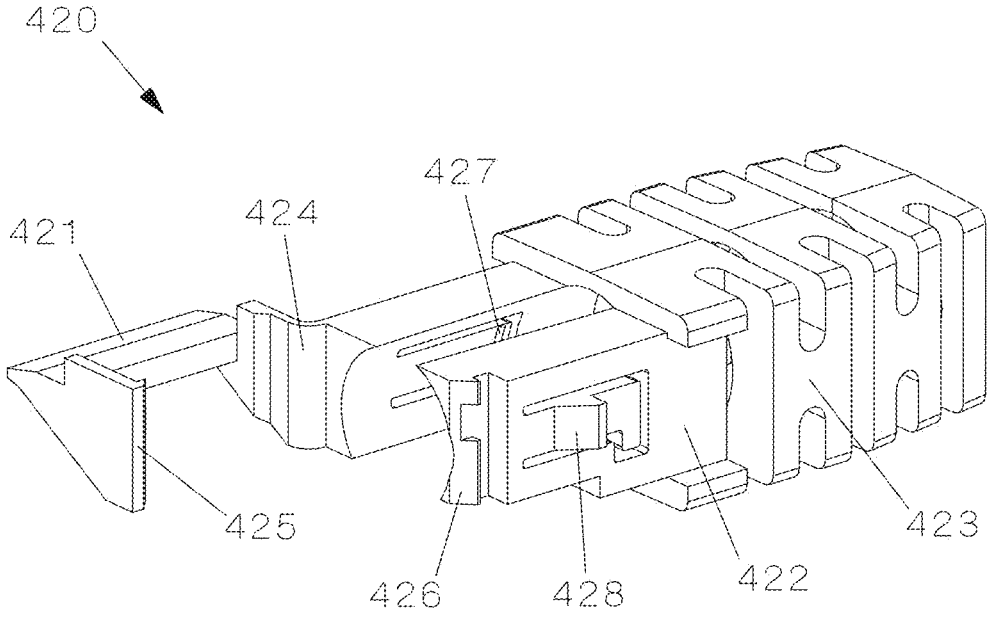
FIG. 35 is a front perspective view of the conductor manager assembly shown in FIG. 34 that has been rotated left to right from the view shown in FIG. 34.
Figure 40:
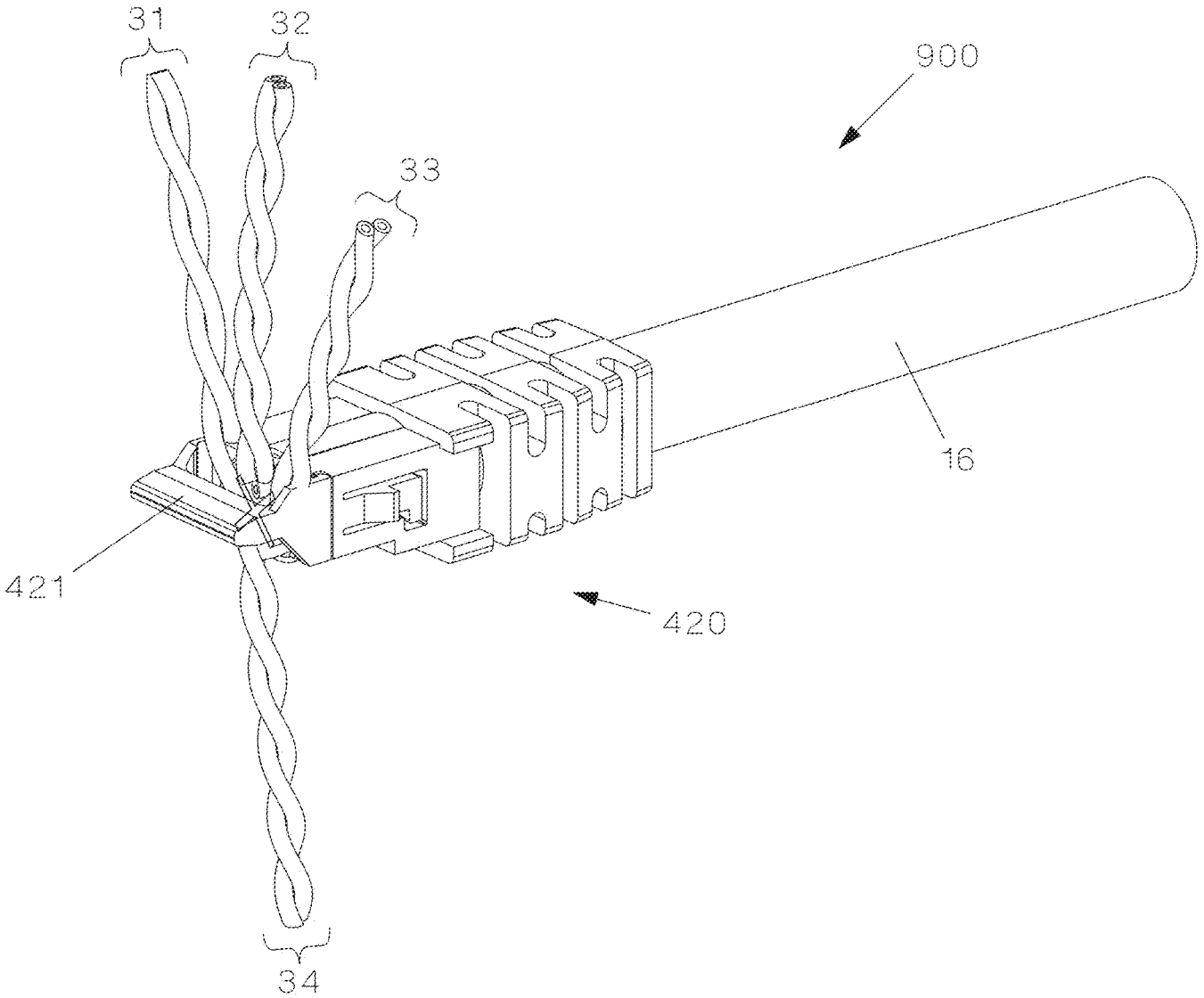
FIG. 40 is a front perspective view of the cabling system shown in FIG. 39 where the divider is in a closed state.

FIG. 34 shows a perspective view of the conductor manager assembly 420, where the divider 421 is shown in an open position. The divider 421 is attached to the body 422 at a first end by a hinge 424, and rotates about the hinge 424 between an open position (as shown in FIG. 34) to a closed position (as shown in FIG. 40). Opposite the hinged end of the divider 421 is a latch 425. The latch 425 is configured to rotate towards a latch stop 426 on the body 422, and engages with the latch stop 426 in the closed position. FIG. 35 shows the conductor manager assembly 420 in a view where the conductor manager assembly 420 has been rotated front to back from the view shown in FIG. 34.

Figure 36:
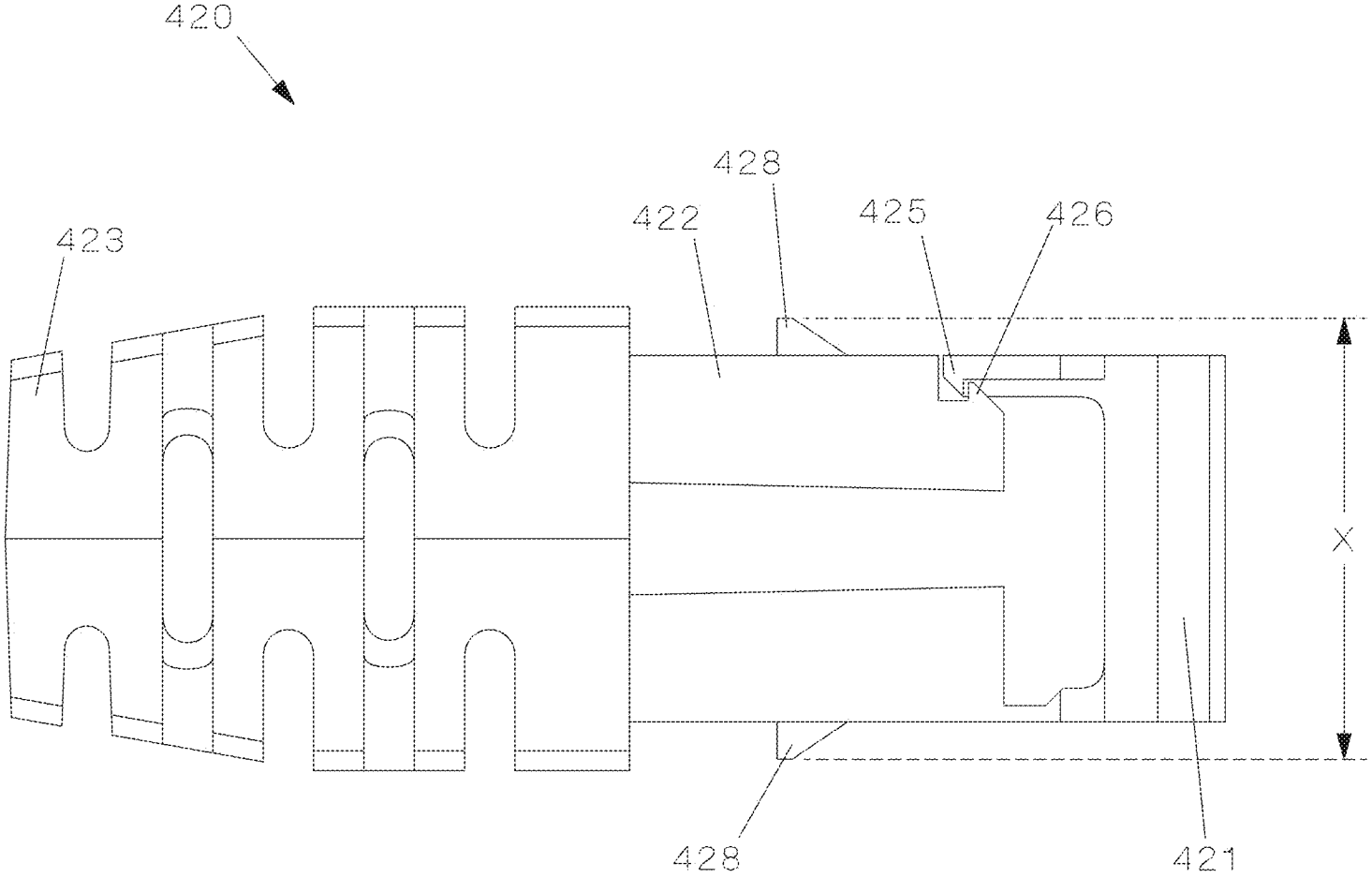
FIG. 36 is a side view of the conductor manager assembly shown in FIG. 34.

FIG. 36 shows a top view of the conductor manager assembly 420. From this top view, a distance between the tips of the latches 428 is shown to be a distance x. This top view in FIG. 36 also shows the engagement between latch 425 and latch stop 426 for attaching the divider 421 to the body 422 in the closed position.

Figure 37:
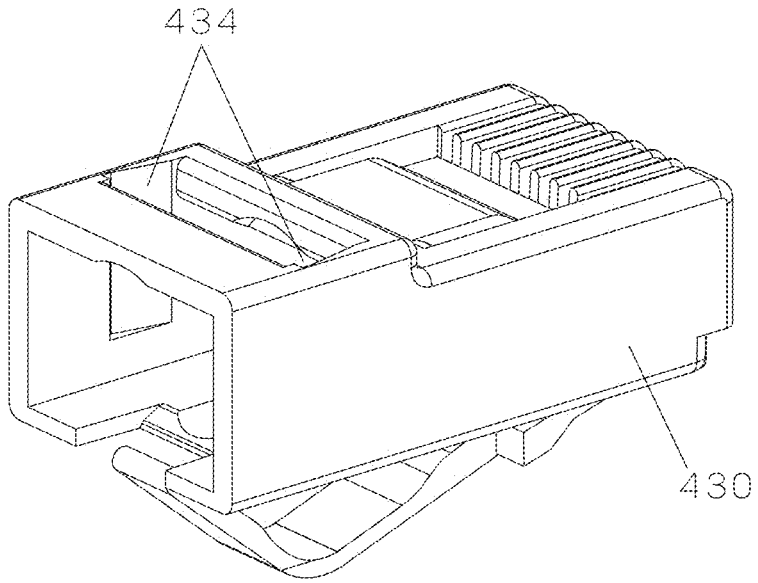
FIG. 37 is a front perspective view of a plug housing shown in FIG. 32.
Figure 38:
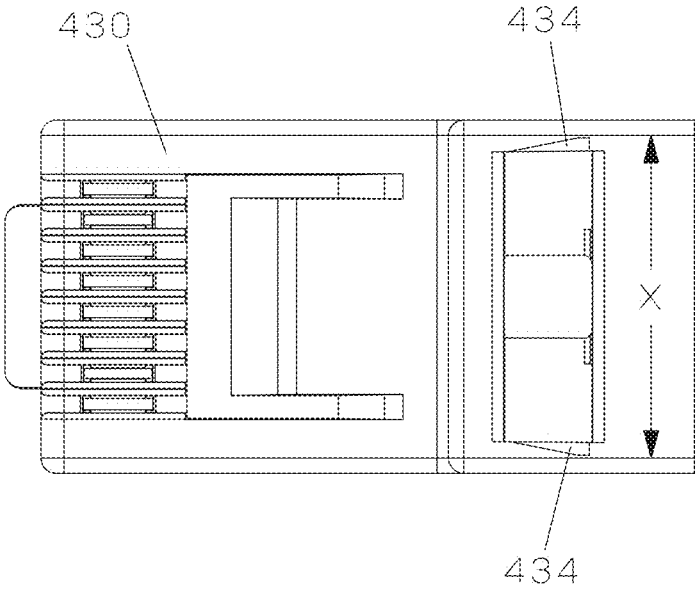
FIG. 38 is a top view of the plug housing shown in FIG. 37.

FIG. 37 shows a perspective view of the plug housing 430, and in particular the latch pockets 434 on the inside cavity of the plug housing 430. FIG. 38 shows a top view of the plug housing 430, and in particular a distance between tips of the latch pockets 434. As described, the latch pockets 434 are configured to receive and latch onto the latches 428 of the conductor manager assembly 420 when the conductor manager assembly 420 is inserted into the plug housing 430. To ensure proper grip, the distance x is made to be slightly larger than the distance y, where the difference between the dimension of x and y causes strain relief ribs 427 to push against the outer jacket 75 of the cable 16 to create a clamping force that provides strain relief on the cable 16.

Figure 39:
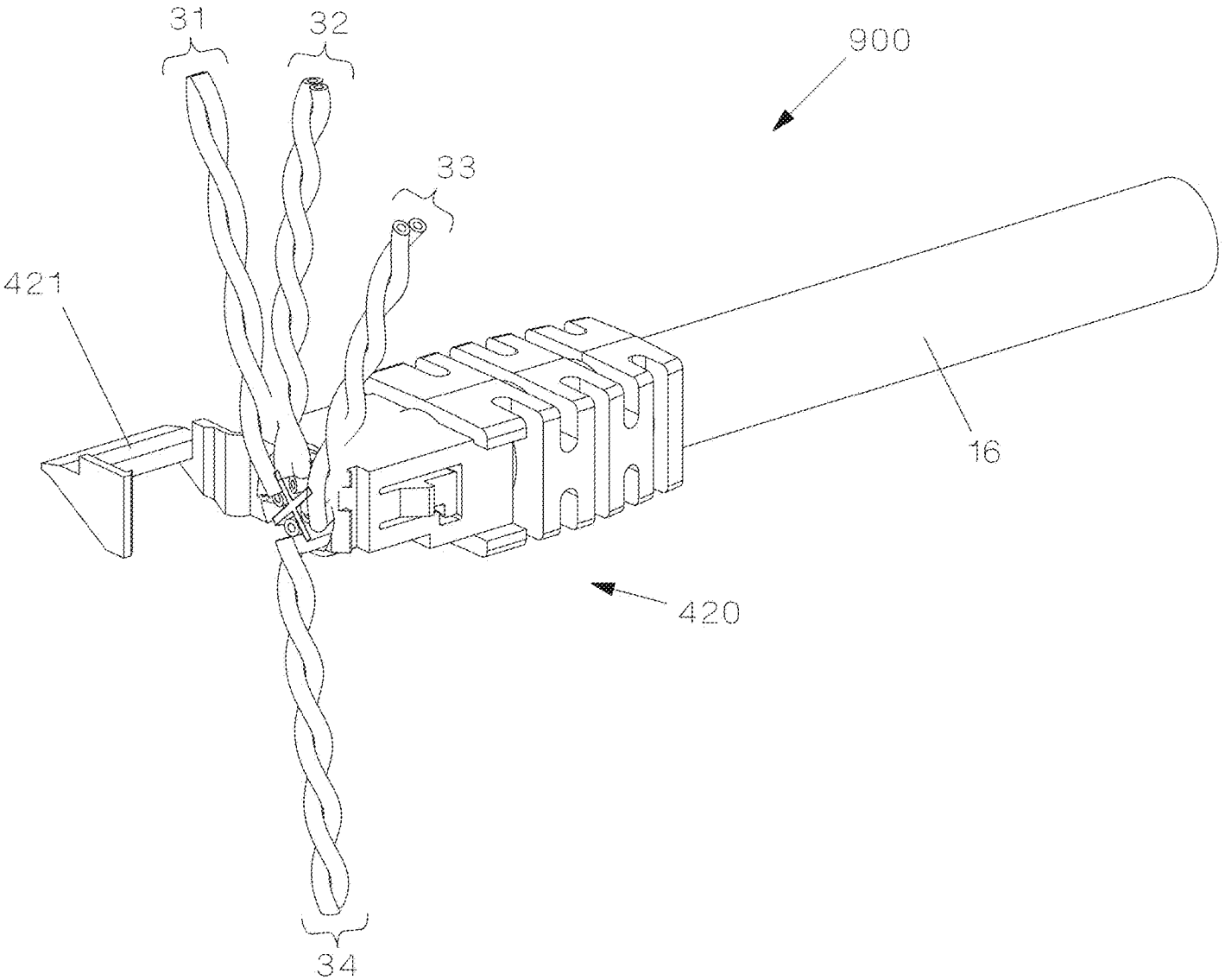
FIG. 39 is a front perspective view of a cabling system including the plug shown in FIG. 32 and showing a divider of the conductor manager assembly in an open state.

FIG. 39 shows a perspective view of cabling system 900 that includes the conductor manager assembly 420 and the cable 16. The divider 421 is shown in the open position to expose the insides of the cable 16 that includes the first twisted pair 31, the second twisted pair 32, the third twisted pair 33, the fourth twisted pair 34, and the separator 74. FIG. 40 shows a perspective view of the cabling system 900 from FIG. 39, where the divider 421 is now in the closed position.

Figure 41:
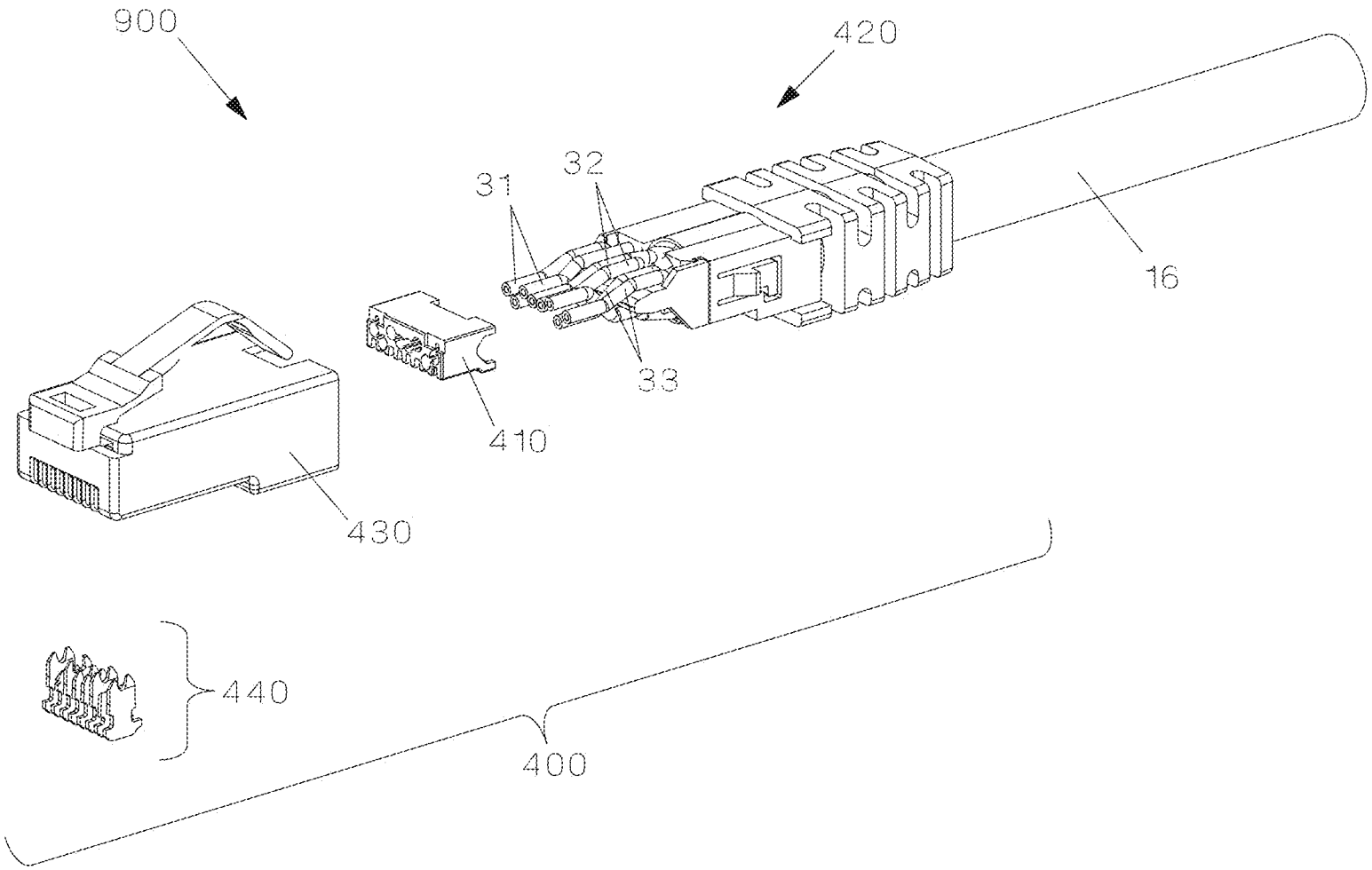
FIG. 41 is an exploded view of the cabling system shown in FIG. 40.
Figure 42:
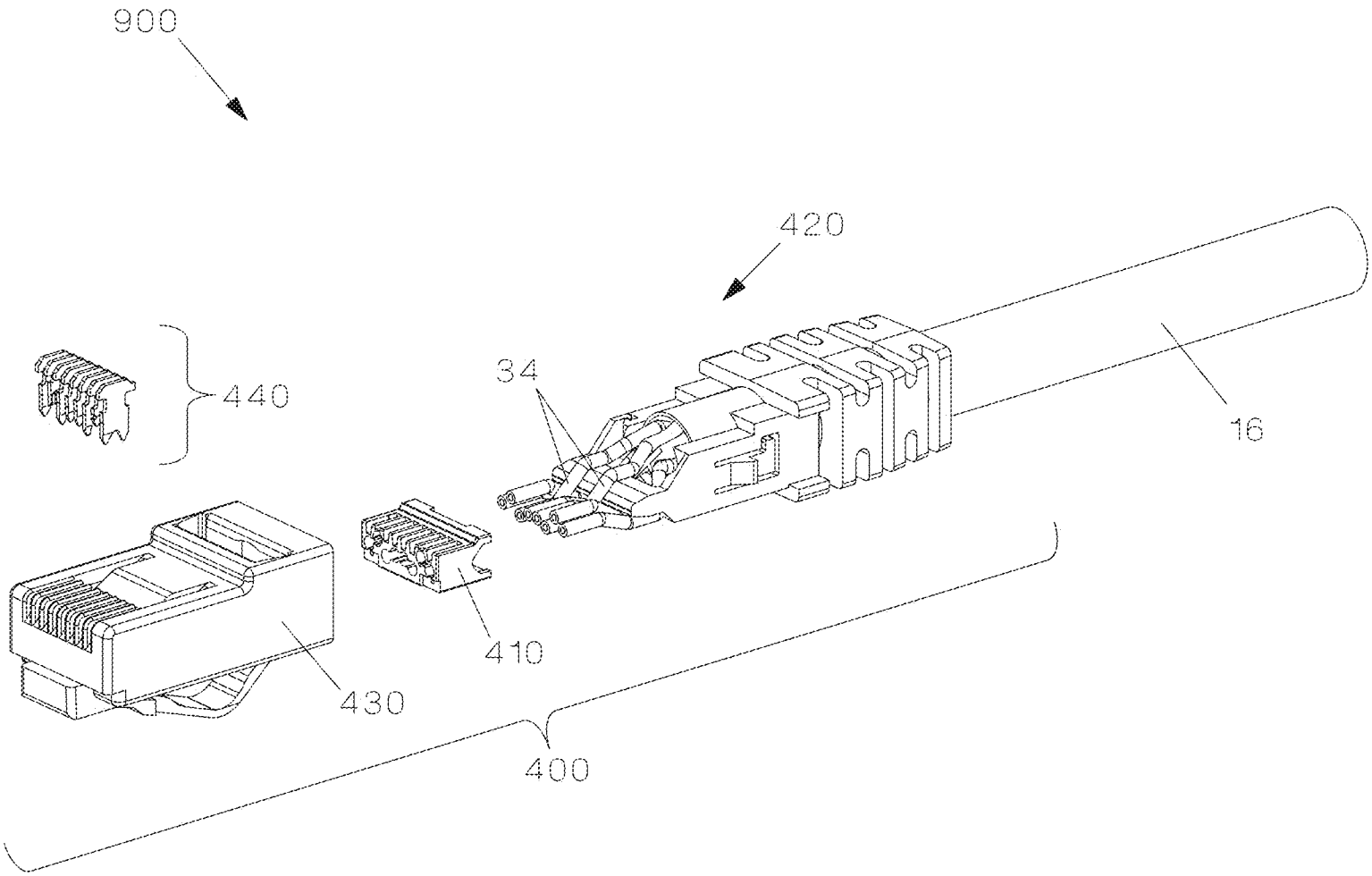
FIG. 42 is an exploded view of the cabling system shown in FIG. 41 that is rotated top to bottom from the view shown in FIG. 41.
Figure 43:
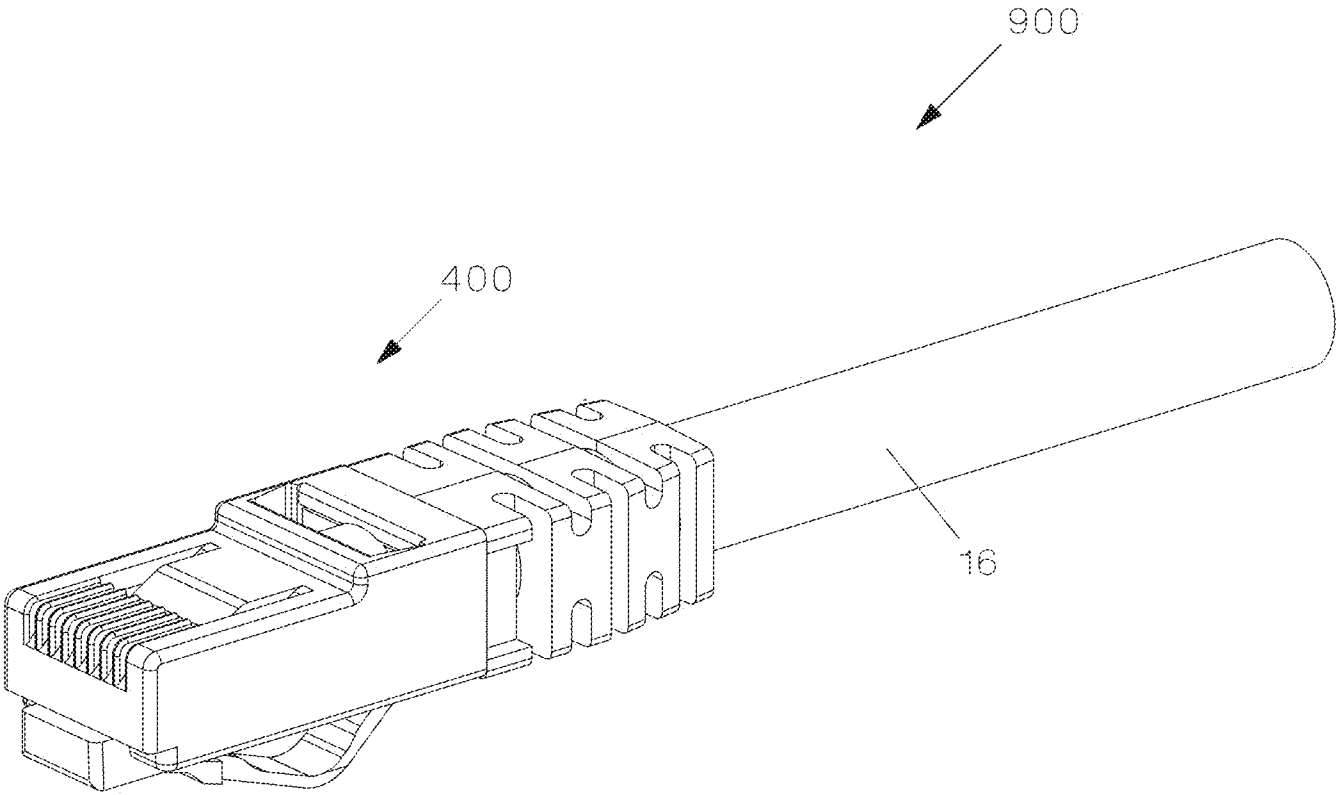
FIG. 43 is a front perspective view of the cabling system shown in FIG. 42 with the plug in a fully assembled state.

FIG. 41 shows the cabling system 900 where the plug 400 is shown in an exploded view. FIG. 42 shows the cabling system 900 that is rotate top to bottom from the view shown in FIG. 41. FIG. 43 shows the cabling system 900 where the plug 400 is in an assembled state. To complete the termination of the plug 400, IPCs 440 are inserted down into their respective IPC openings 433. This insertion step causes the IPCs 440 to pierce insulation around the conductors that are held within the load bar 410 and create an electrical contact between the IPCs 440 and the conductors held in the load bar 410. The insertion of the IPCs may be implemented by a tool, or in some embodiments a manual process.

In the views provided by FIGS. 41-42, the twisted pairs 31-34 are shown to guide over and under the divider 431. For example, FIG. 41 shows twisted pairs 31-33 being guided over a top surface of the divider 431. In FIG. 42, the fourth twisted pair 34 is shown to be guided over a bottom surface of the divider 431. Other combinations for guiding the twisted pairs over and/or under the divider 431 are within the scope of the conductor manager assembly 420 design.

Figure 44:
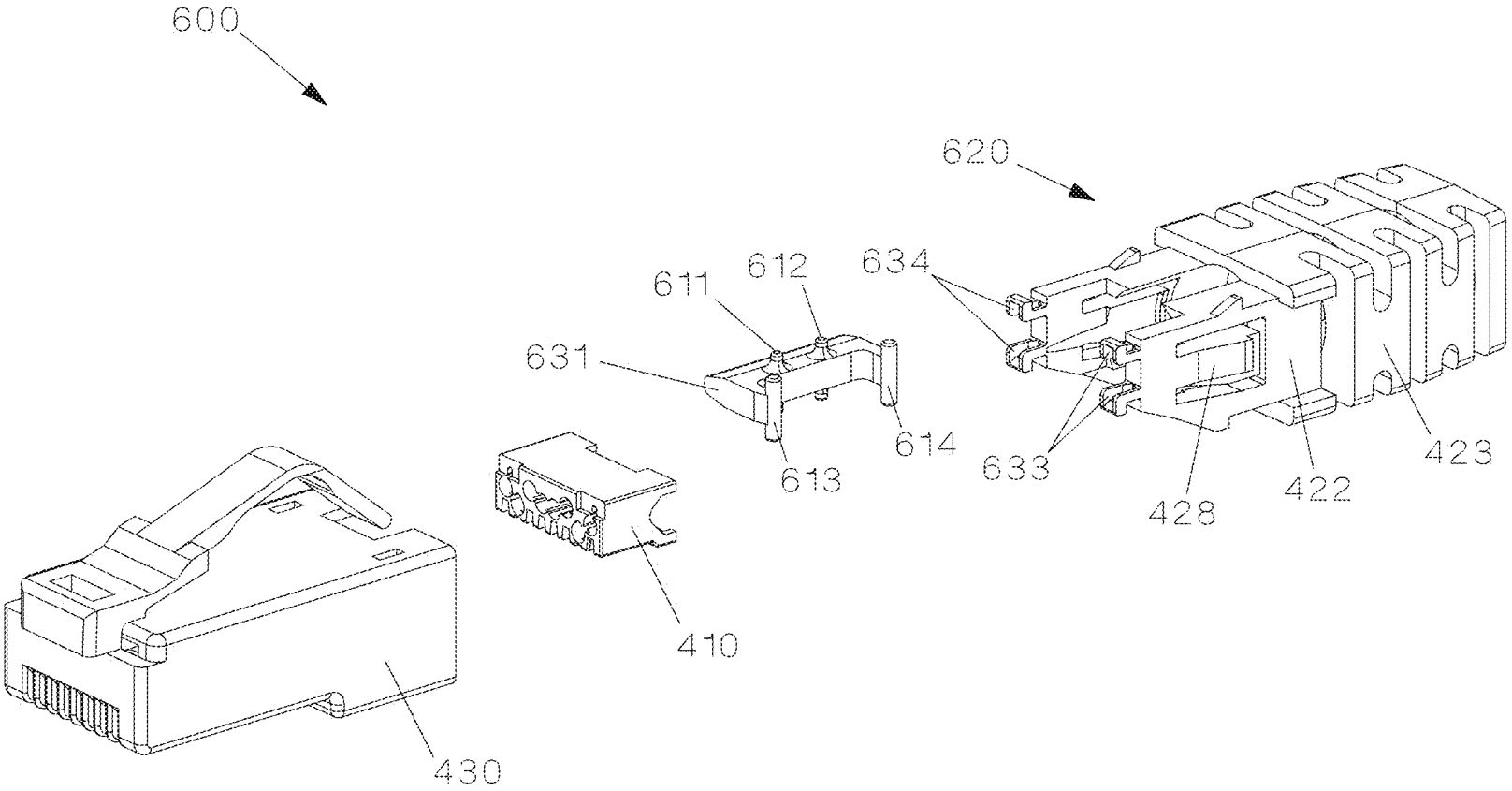
FIG. 44 is an exploded view of a plug including a conductor manager assembly, according to another embodiment.
Figure 45:
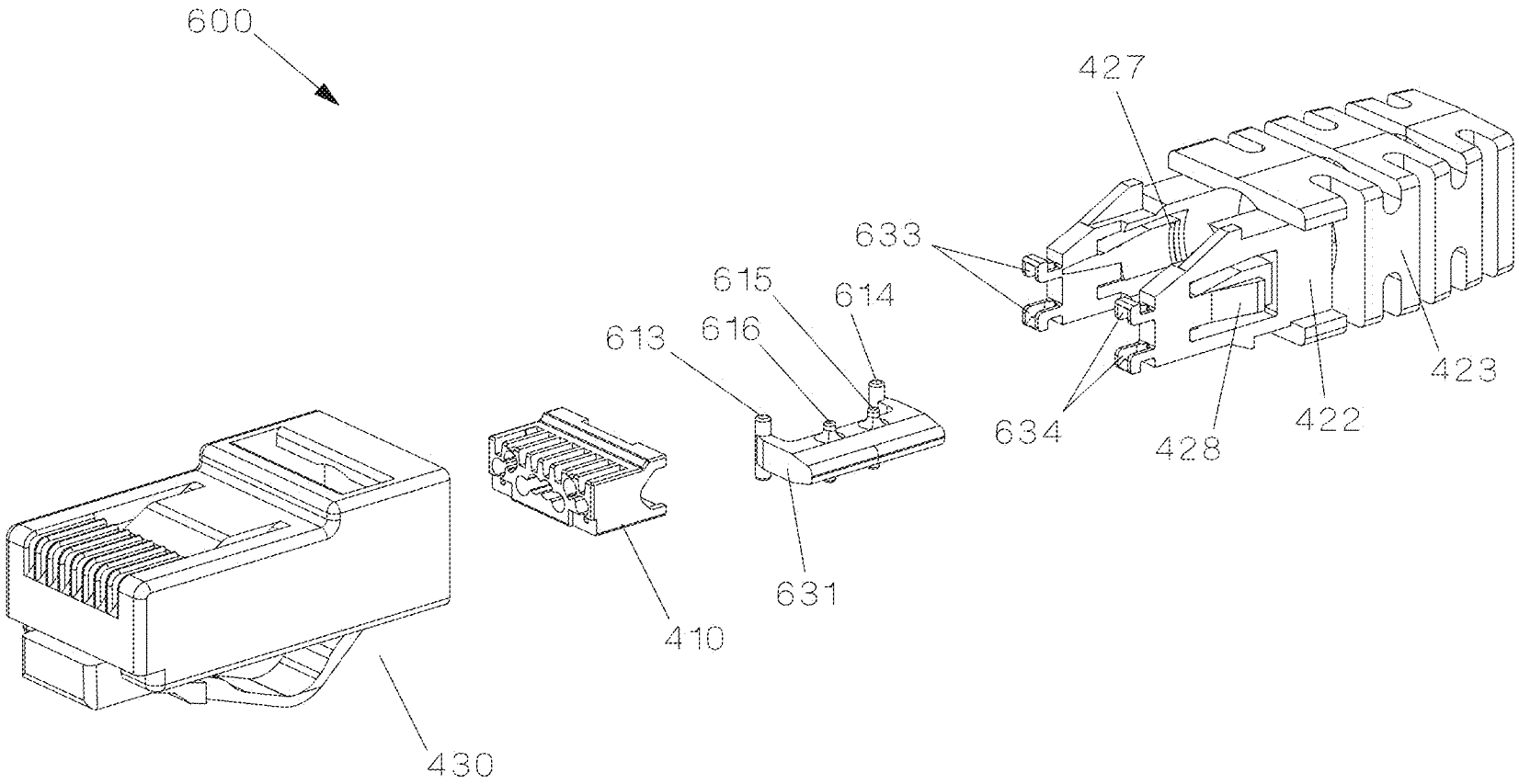
FIG. 45 is an exploded view of the plug shown in FIG. 44 that is rotated top to bottom from the view shown in FIG. 44.

FIG. 44 shows an alternative embodiment conductor manager assembly 620 that is part of plug 600. The conductor manager assembly 620 may swap out and replace the conductor manager assembly design of conductor manager assembly 420 included in plug 400. In other words, the load bar 410 and plug housing 430 in plug 600 are the same as shown for plug 400, and the same part numbers are used where the parts are the same between plug 600 and plug 400. FIG. 45 shows the conductor manager assembly 620 from FIG. 44 that has been rotated top to bottom.

Figure 46:
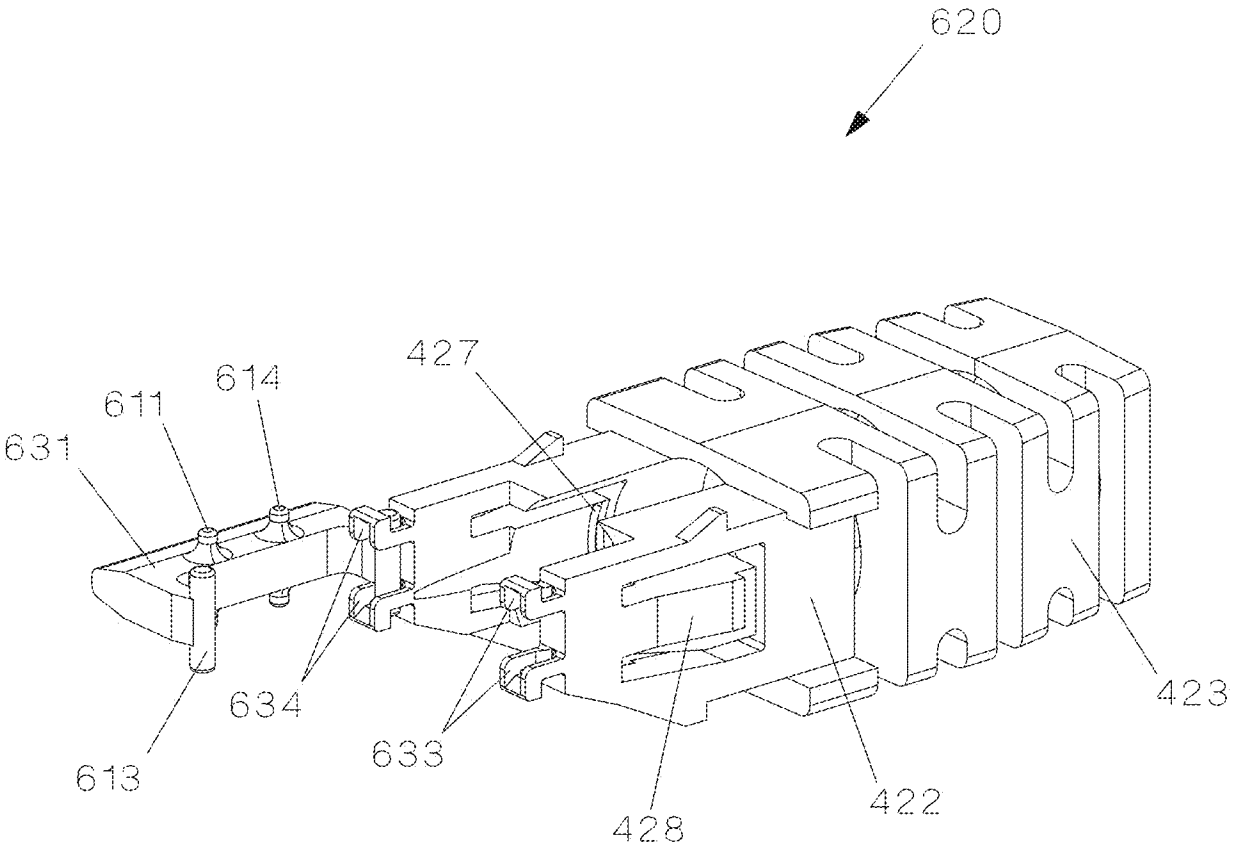
FIG. 46 is a front perspective view of a conductor manager assembly, according to another embodiment.

In the conductor manager assembly 620, the divider 631 is fully detachable. The divider 631 includes pins 613, 614 at opposite ends that are insertable into mounts 633, 634 included in the conductor manager assembly 620. When one of the pins 614 is inserted into one of the mounts 634 as shown in FIG. 46, the divider 631 is rotated about the inserted pin 614 to an open position. When the other pin 613 is inserted into the remaining mount 633, the divider 631 is secured shut into the closed position.

The divider 631 is also shown to include a plurality of protrusions 611, 612, 615, 616. Although the divider 631 is shown to include two protrusions 611, 612 on a top side, and two protrusions 615, 616 on an opposite bottom side of the divider 631, other combinations are within the scope of the divider 631 design. The protrusions 611, 612, 615, 616 may aid in routing the twisted pairs 31-34 over the top surface and/or bottom surface of the divider 631 as the twisted pairs 31-34 are guided towards the load bar 410.

Figure 47:
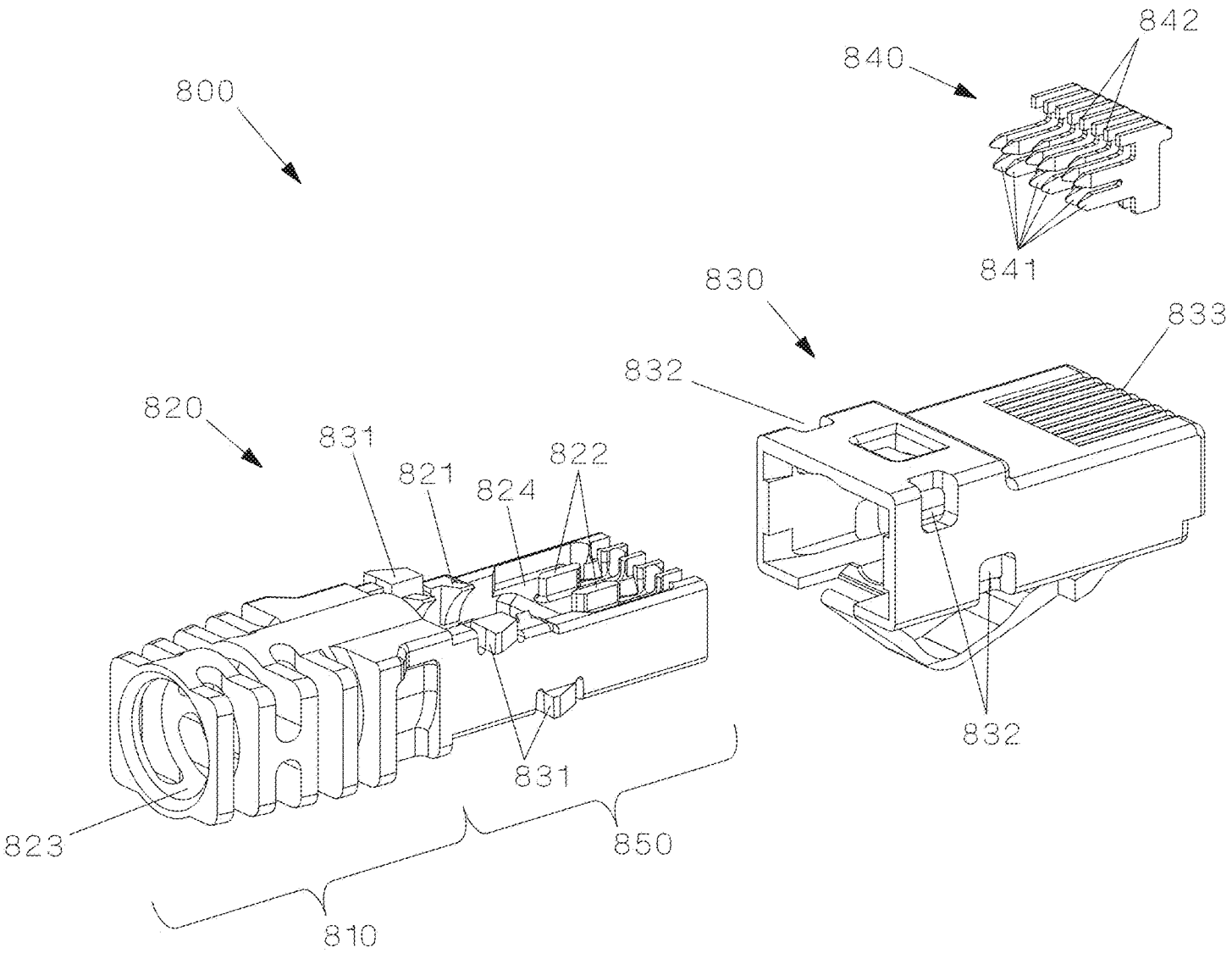
FIG. 47 is an exploded view of a plug, according to an alternative embodiment.
Figure 48:
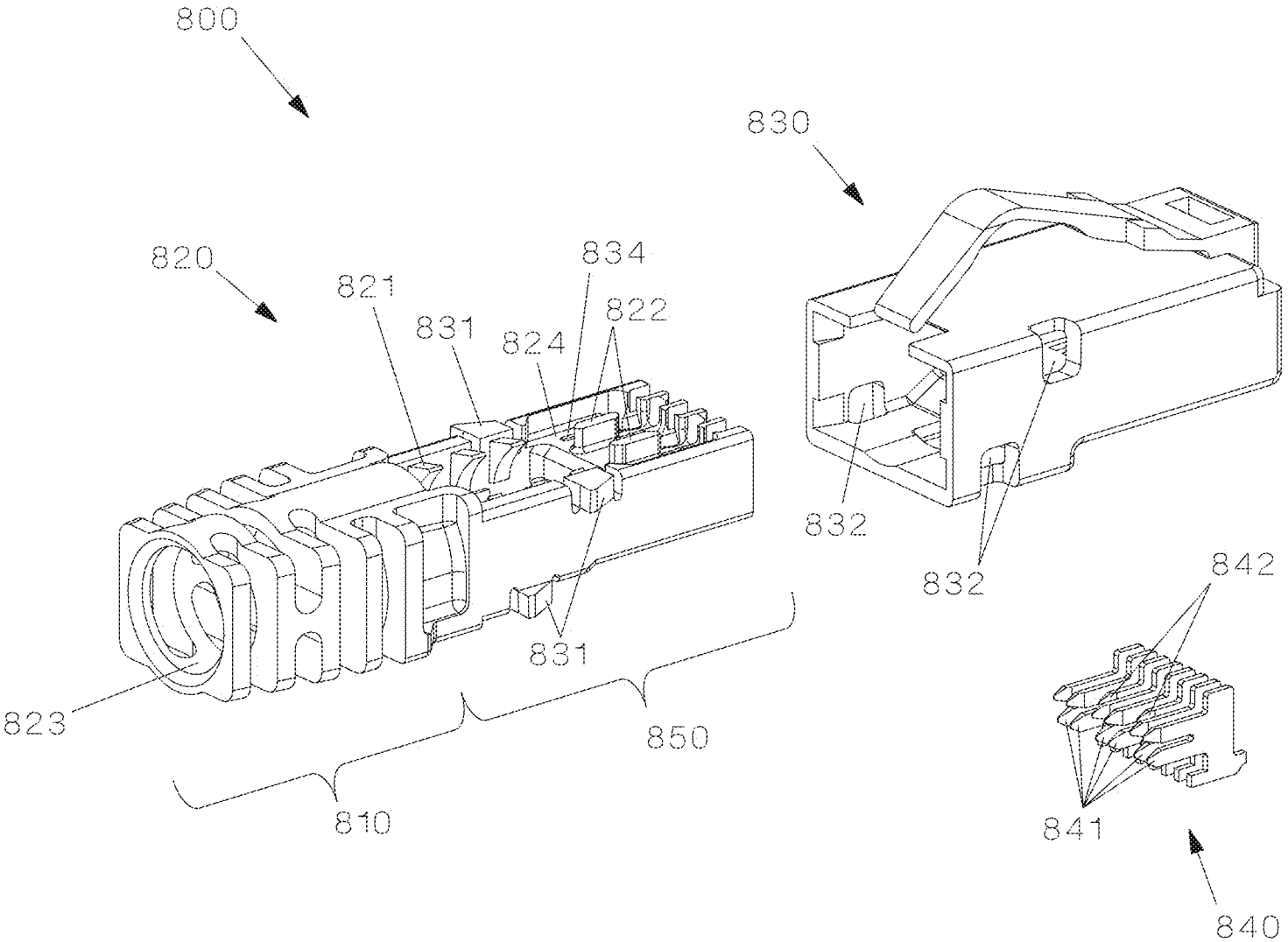
FIG. 48 is an exploded view of the plug shown in FIG. 47 that is rotated top to bottom from the view shown in FIG. 47.

FIG. 47 shows an alternative embodiment plug 800 for managing and terminating the twisted pairs of conductors in the cable 16. FIG. 48 shows the plug 800 that has been rotated top to bottom. The alternative plug 800 includes a conductor manager 820 and a plug housing 830. The plug housing 830 includes slots 833 for receiving and housing insulation piercing contacts (IPCs) 840, where the IPCs 840 include long tine IPCs 841 and short tine IPCs 842 for directly piercing an insulation layer covering the conductors included in the cable 16. The IPCs 840 may be press fit or stitched into their respective slots 833. The plug housing 830 also includes a number (e.g., 4) of windows 832 for engaging with respective latches 831 on the conductor manager 820. In order to secure the plug housing 830 and the conductor manager 820 together into their assembled state and prevent them from disengaging, the latches on the conductor manager 820 will engage and fit into their respective windows 832 on the plug housing.

Figure 49:
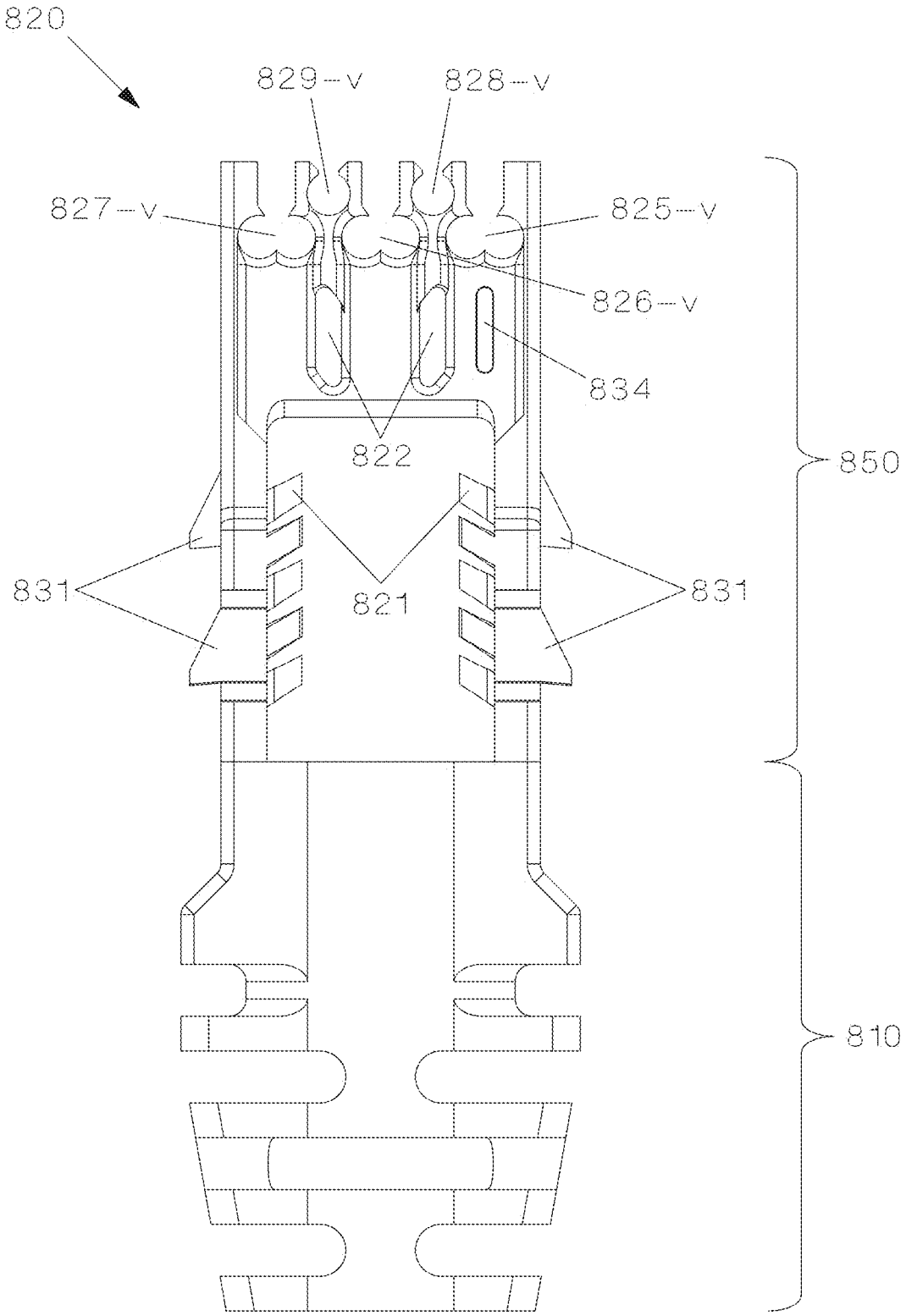
FIG. 49 is a top view of a conductor manager included in the plug shown in FIG. 47.

The conductor manager 820 is a single-piece design that integrates a flexible boot portion 810 and a conductor routing portion 850 together. The inner channel within the flexible boot portion 810 provides strain relief to the outer jacket 75 of cable 16 by having a smaller inner diameter than the opening 823 of the flexible boot portion 810. In assembling the plug 800 and cable 16, the cable 16 is inserted through the opening 823. Upon entering through the opening 823, the insulation jacket covering the cable 16 is gripped by support ribs 821 within the conductor routing portion 850, as shown in FIG. 49. The support ribs 821 are positioned and sized to create the channel within the conductor routing portion 850 to grip the cable 16 circumferentially. The support ribs 821 are angled forwards towards a front of the conductor routing portion 850 and away from the opening 823. This angled orientation of the support ribs 821 allows for easy insertion of the cable 16 into the inner channel of the plug 800 while also providing resistance against the cable 16 being pulled back out the opening 823 of the conductor manager 820.

At some position after the cable is inserted through the flexible boot portion 810 and enters into the conductor routing portion 850, the outer jacket 75 of the cable 16 may be stripped to expose the four twisted pairs 31-34. As illustrated in FIG. 49, the conductor routing portion 850 includes a platform 824 that provides pathways for the twisted pairs 31-34 to be lead to their respective vertical channels **825-*v*, 826-*v*, 827-*v*, 828-*v*, and 829-*v*. After the twisted pairs 31-34 have been installed into their respective vertical channels 825-*v* to 829-*v*, the twisted pairs 31-34 are in position to be pierced by their respective IPCs 840, as described in more detail below. Two dividers 822 are included on the platform to create more defined pathways for the twisted pairs 31-34. An indicator 834 may also be included on the platform 824 to identify a specific pathway for a single twisted pair of conductors to be placed. The indicator 834 is an opening through the platform 824, or other visual marker (e.g., color coded) placed on the platform 824, for identifying the pathway on which a predetermined twisted pair will be positioned to lead it into vertical channel 825-*v***.

Figure 50:
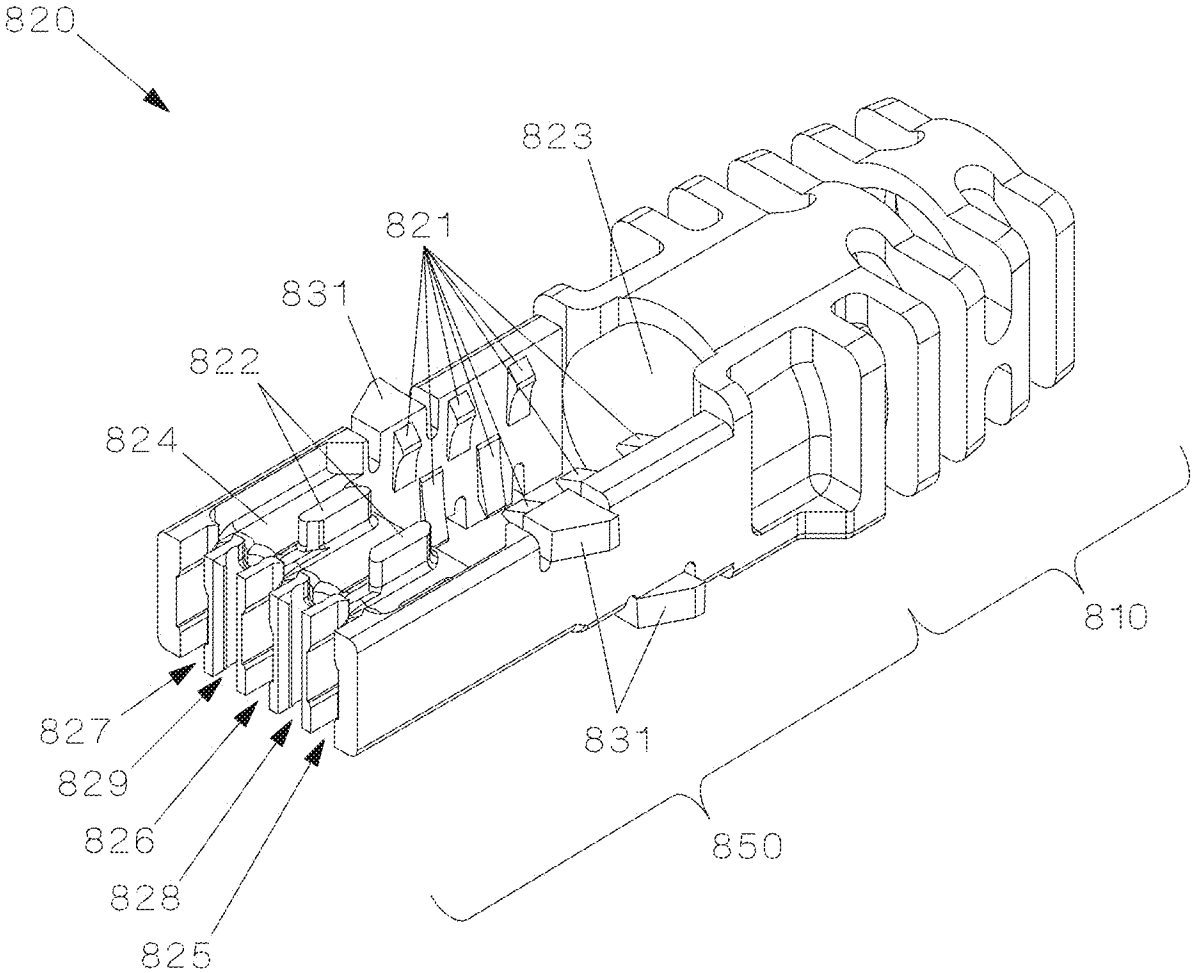
FIG. 50 is a front perspective view of the conductor manager shown in FIG. 49.

FIG. 50 shows a front perspective view of the conductor manager 820. From this front perspective view, the support ribs 821 are shown to be positioned in a staggered configuration going from top to bottom. Other configurations for the support ribs 821 may be applied to the conductor manager while still remaining within the scope of the conductor manager 820. A plurality of insertion openings 825-829 are included at the front of the conductor manager 820, where the insertion openings 8 provide openings for the IPCs to pierce and make electrical contact with conductors being held within their respective vertical channels **825-*v* to 829-*v***.

Figure 51:
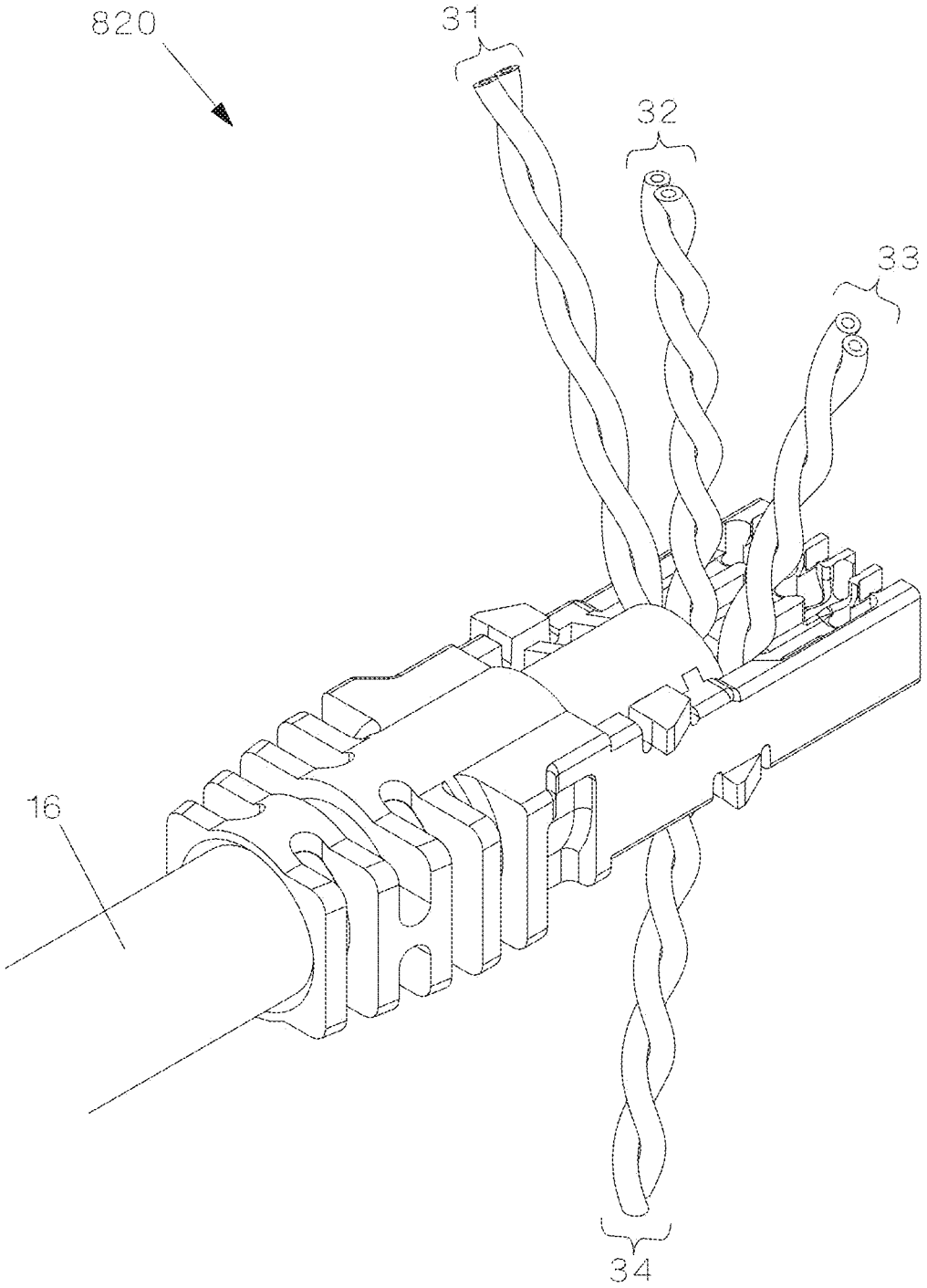
FIG. 51 is a perspective view of the conductor manager shown in FIG. 49 with the cable installed and having twisted pairs of wires exposed at a first cable end for a first configuration.
Figure 52:
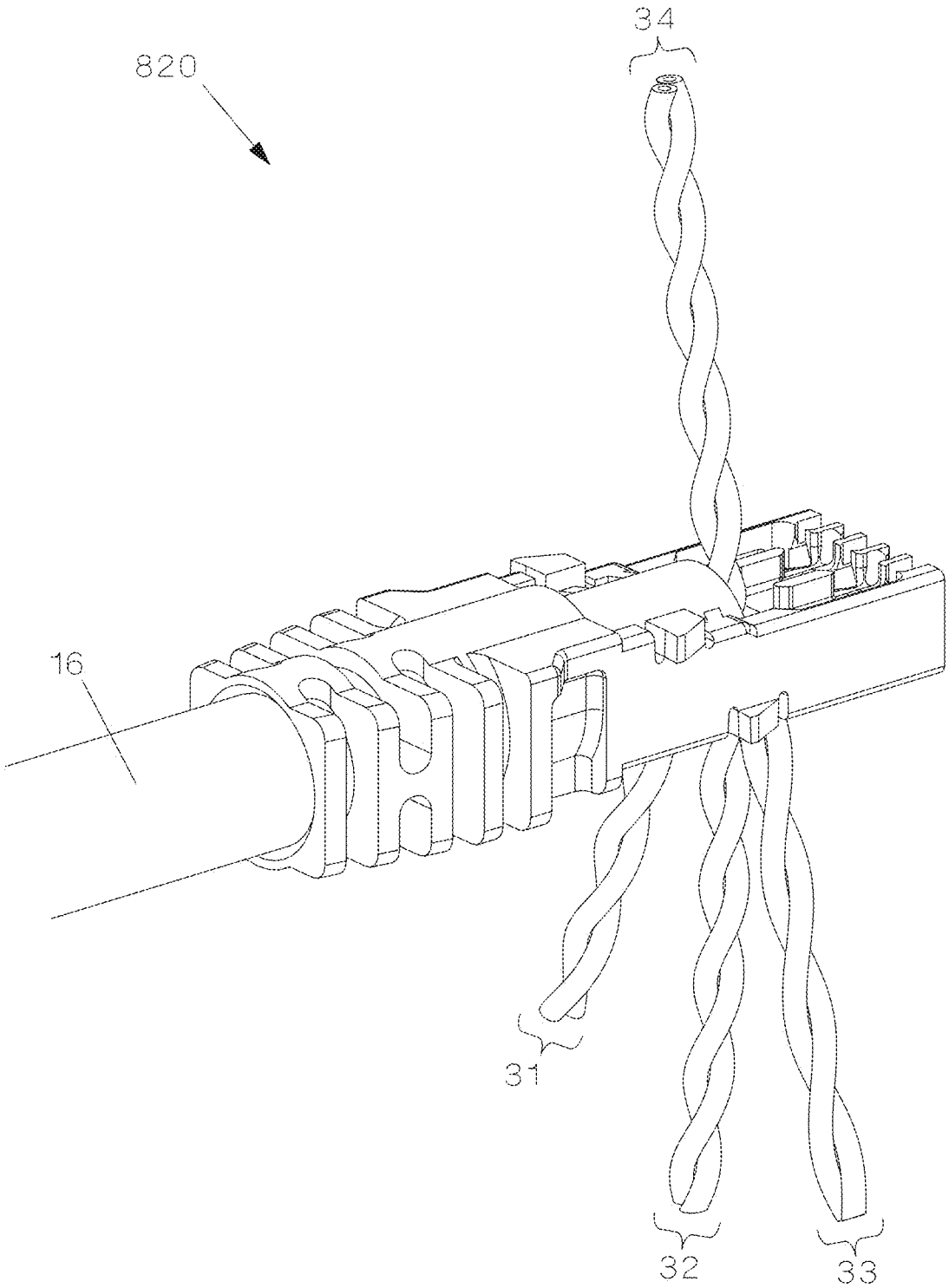
FIG. 52 is a perspective view of the conductor manager shown in FIG. 49 with the cable installed and having twisted pairs of wires exposed at a second cable end for the first configuration.

FIG. 51 shows a perspective view of the conductor manager 820 at a first end (e.g., cable end A) of the cable 16, where the cable 16 has been inserted into the conductor manager 820 and the twisted pairs 31-34 have been exposed according to a first configuration (e.g., configuration A). The exposed twisted pairs 31-34 shown in FIG. 51 are positioned for inserting into the vertical channels **825-*v* to 829-*v* of the conductor manager 820 in configuration A at cable end A. FIG. 52 shows a perspective view of the conductor manager 820 at a second end (e.g. cable end B) of the cable 16 in configuration A, where the arrangement of the twisted pairs 31-34 at cable end B is flipped top to bottom compared to the arrangement seen at cable end A. The exposed twisted pairs 31-34 shown in FIGS. 51-52 are positioned for inserting into the vertical channels 825-*v* to 829-*v* of the conductor manager 820** in configuration A at cable ends A and B.

Figure 53:
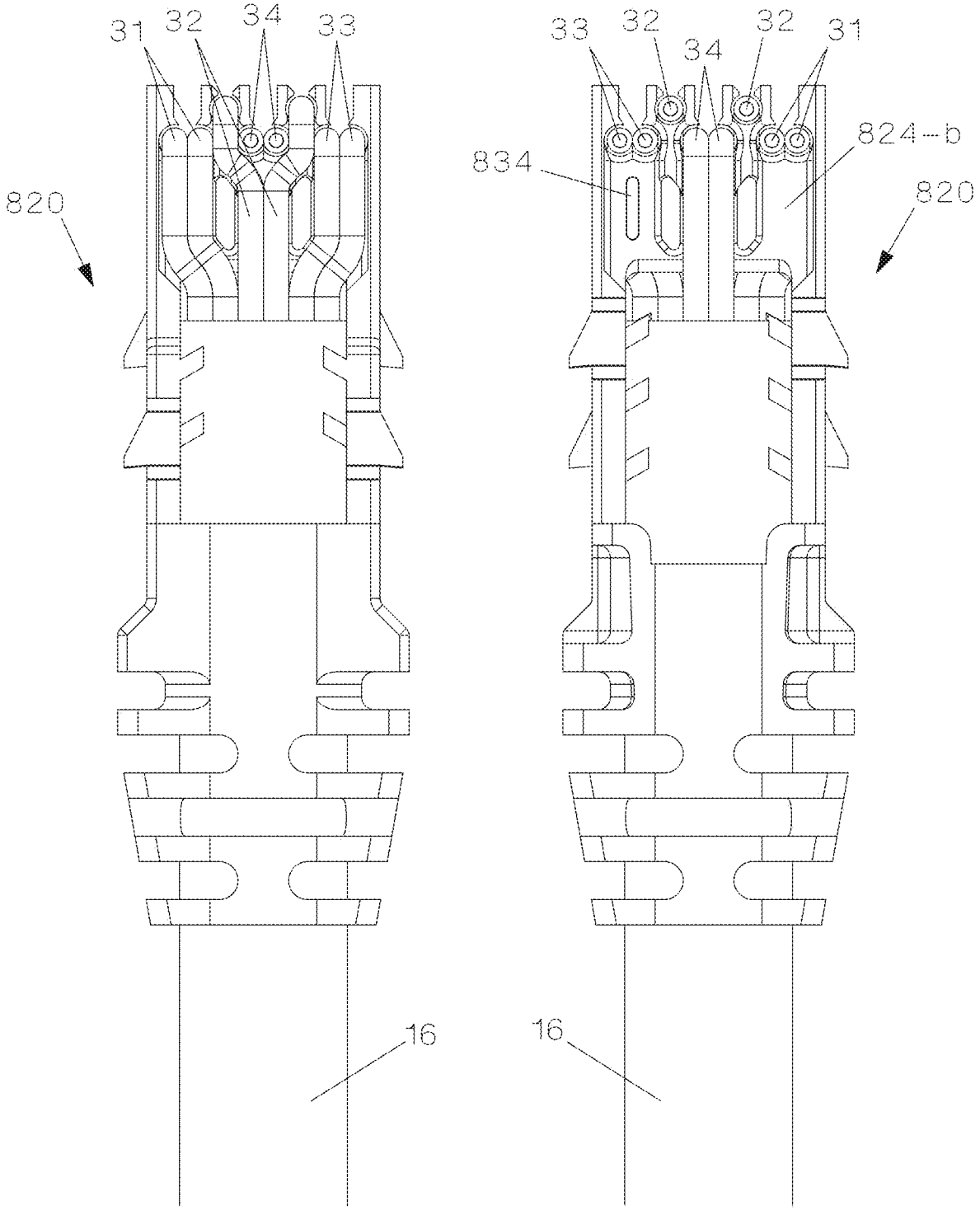
FIG. 53 is a top and bottom view of the conductor manager shown in FIG. 51 with the twisted pairs of wires routed in the first configuration at the first cable end.
Figure 54:
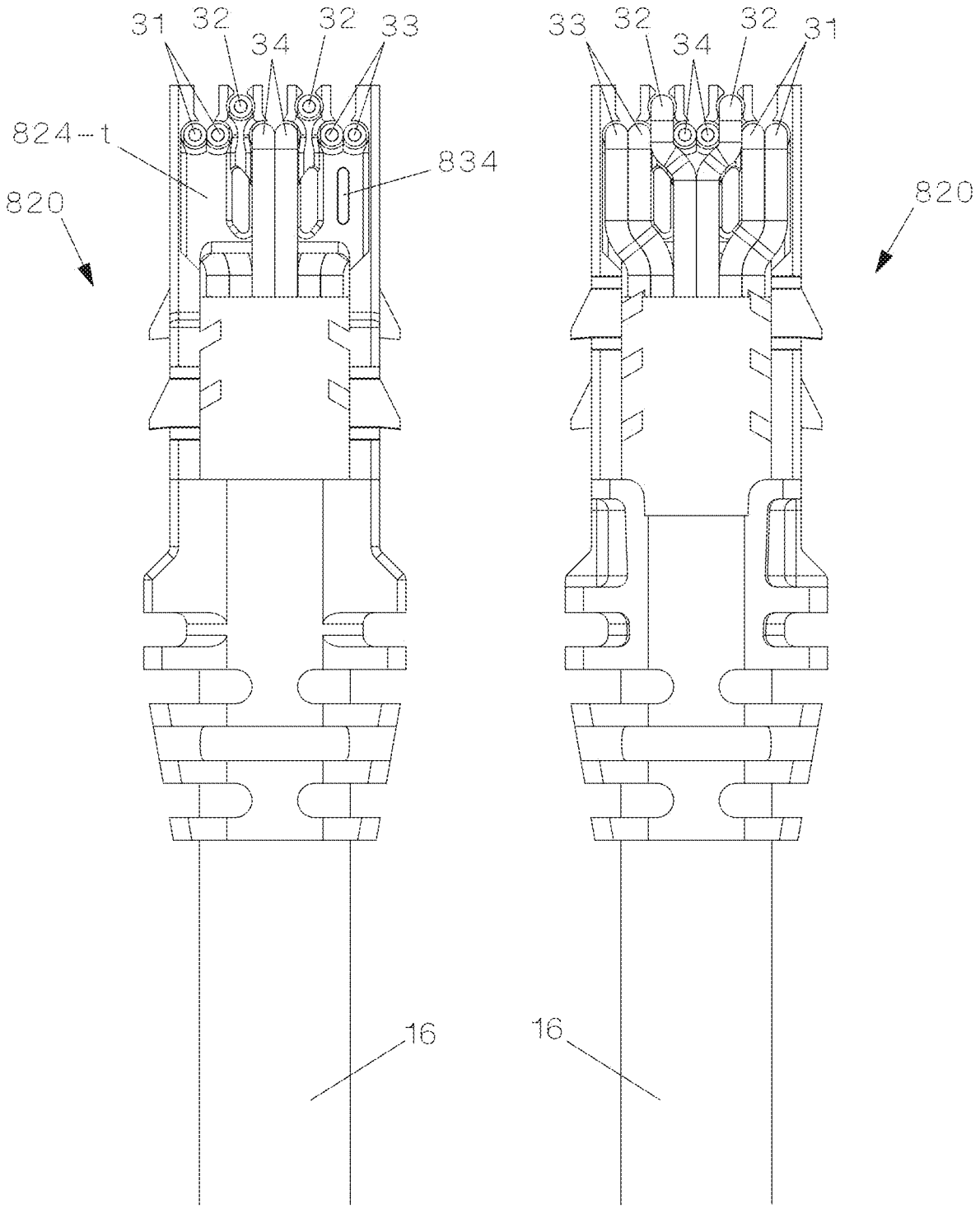
FIG. 54 is a top and bottom view of the conductor manager shown in FIG. 52 with the twisted pairs of wires routed in the first configuration at the second cable end.

For example, FIG. 53 shows an embodiment where the twisted pairs 31-34 have been installed into the vertical channels **825-*v* to 829-*v* of the conductor manager 820 at the cable end A in configuration A, while FIG. 54 shows the twisted pairs 31-34 installed into the vertical channels 825-*v* to 829-*v* of the conductor manager 820 at the cable end B in the same configuration A. In configuration A, twisted pairs 31, 32, 33 are routed on the top-side platform 824-*t* at cable end A, while twisted pair 34 is routed on the bottom-side platform 824-*b*. Also in configuration A, twisted pair 32 is separated so that each individual conductor in twisted pair 32 is routed into the two vertical channels 828-*v* and 829-*v* at the front end of the conductor routing portion 850. As shown in FIGS. 53-54, the conductor manager 820 has the same mirroring layout from the top half to the bottom half. The top to bottom mirroring layout of the conductor manager 820 allows the same conductor manager 820** to be used for terminating twisted pairs in either layout configuration A or B at either cable ends A or B.

Figure 55:
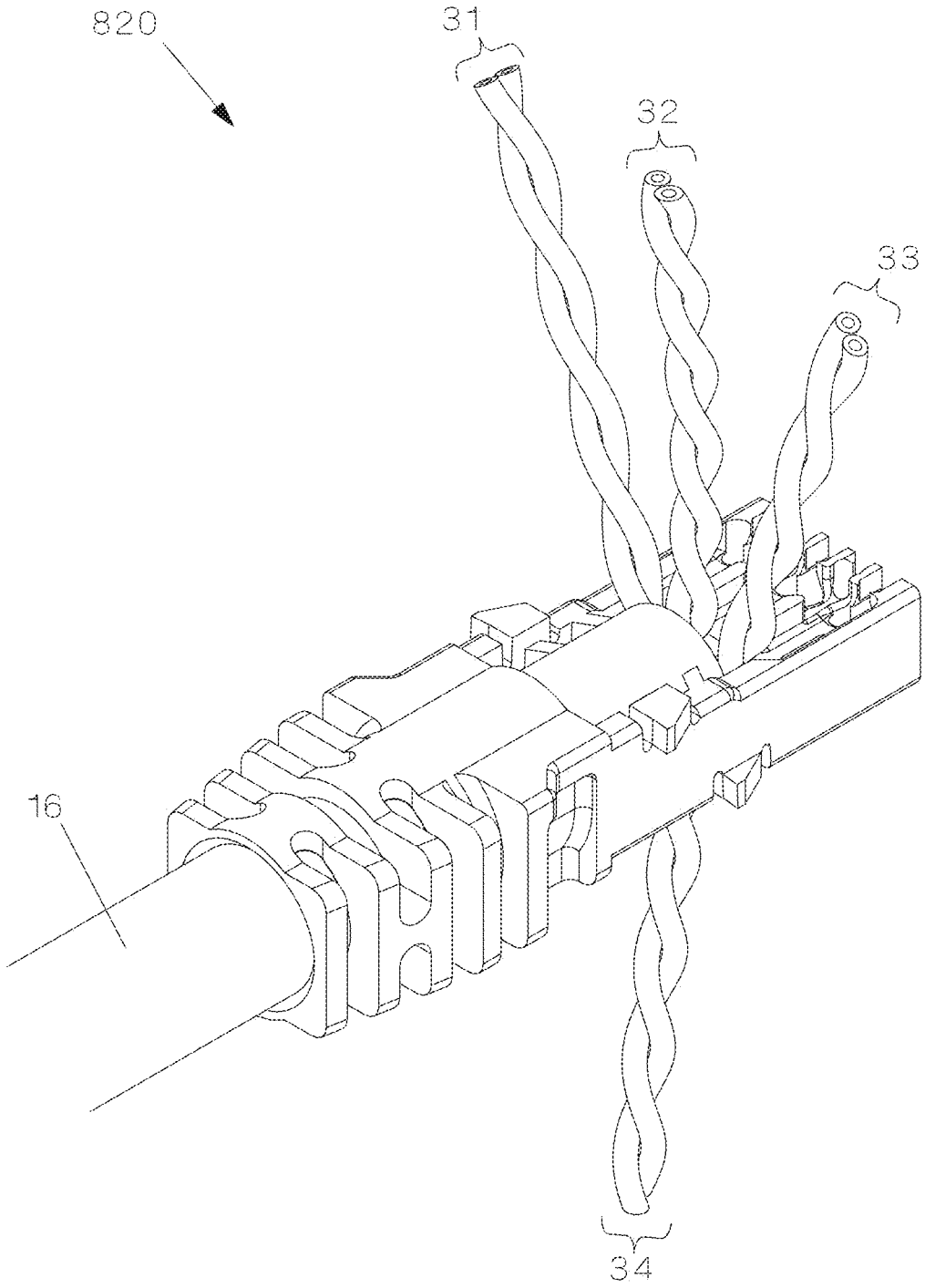
FIG. 55 is a perspective view of the conductor manager shown in FIG. 49 with the cable installed and having twisted pairs of wires exposed at the first cable end for a second configuration.
Figure 56:
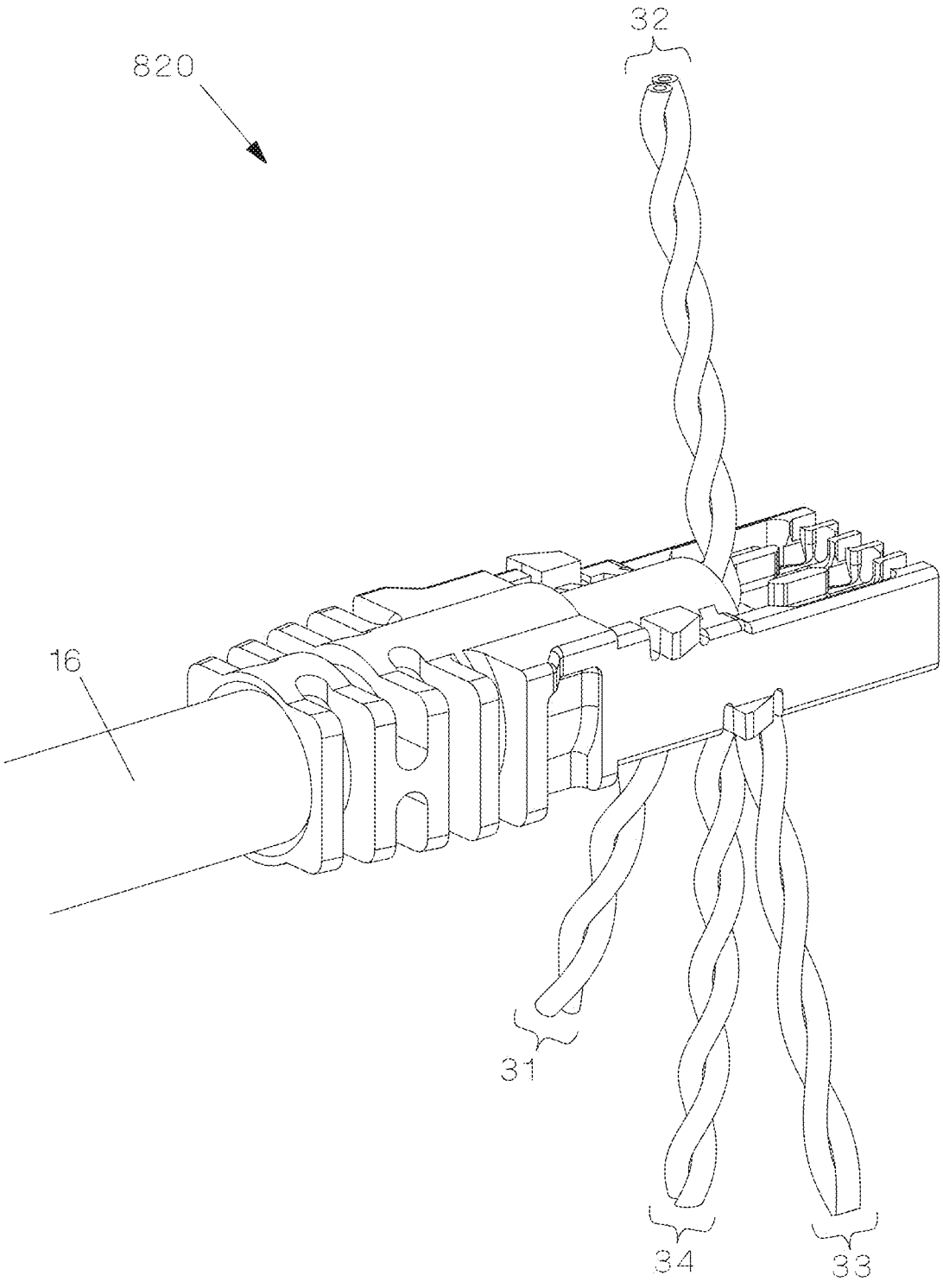
FIG. 56 is a perspective view of the conductor manager shown in FIG. 49 with the cable installed and having twisted pairs of wires exposed at the second cable end for the second configuration.

FIG. 55 shows a perspective view of the conductor manager 820 at cable end A of the cable 16, where the cable 16 has been inserted into the conductor manager 820 and the twisted pairs 31-34 have been exposed according to a second configuration (e.g., configuration B). The exposed twisted pairs 31-34 shown in FIG. 55 are positioned for inserting into the vertical channels **825-*v* to 829-*v* of the conductor manager 820 in configuration B at cable end A. FIG. 56 shows a perspective view of the conductor manager 820 at cable end B of the cable 16 in configuration B, where the arrangement of the twisted pairs 31-34 at cable end B is flipped top to bottom compared to the arrangement seen at cable end A. The exposed twisted pairs 31-34 shown in FIGS. 55-56 are positioned for inserting into the vertical channels 825-*v* to 829-*v* of the conductor manager 820** in configuration B at cable ends A and B.

Figure 57:
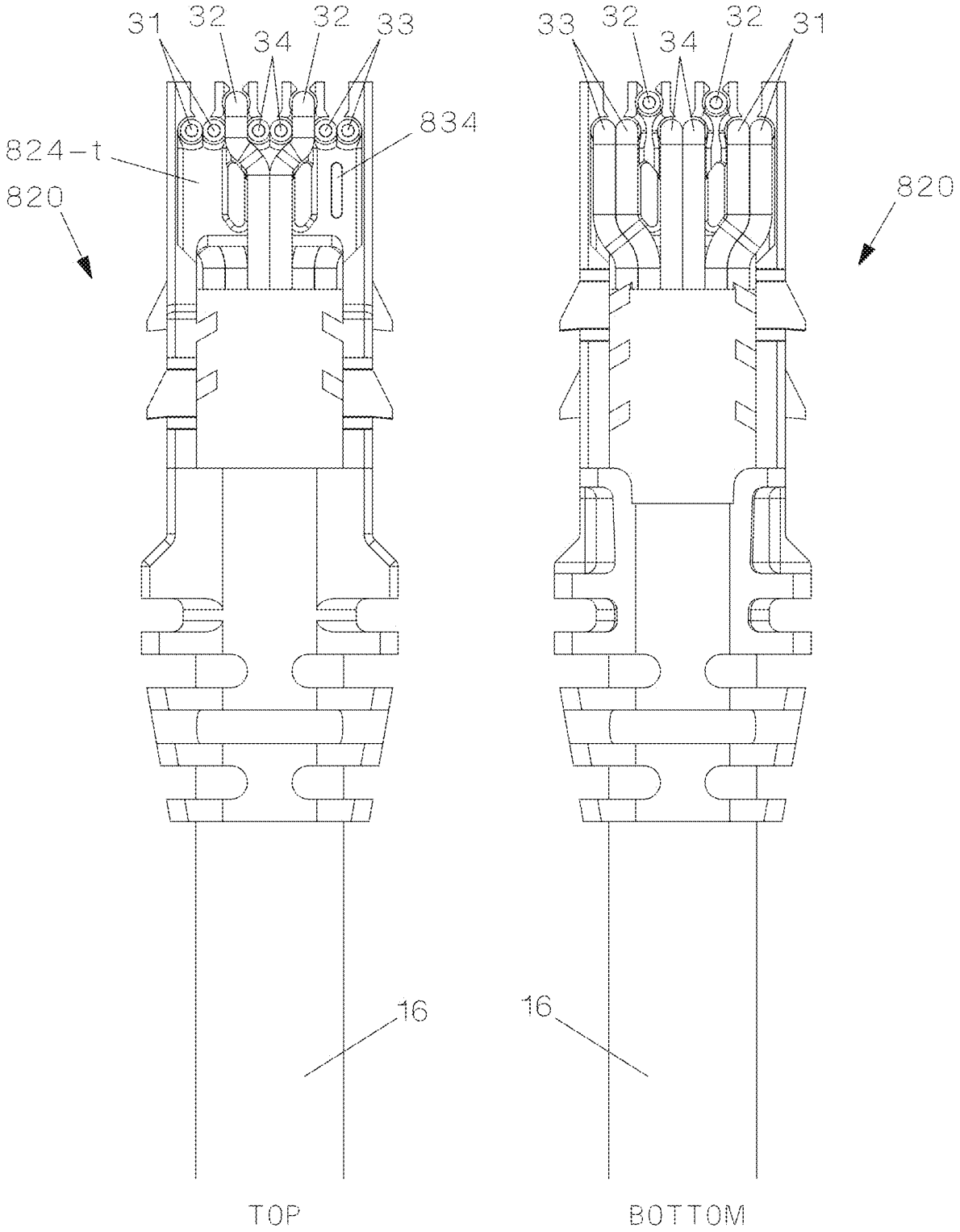
FIG. 57 is a top and bottom view of the conductor manager shown in FIG. 55 with the cable installed and having the twisted pairs of wires routed in the second configuration at the first cable end.
Figure 58:
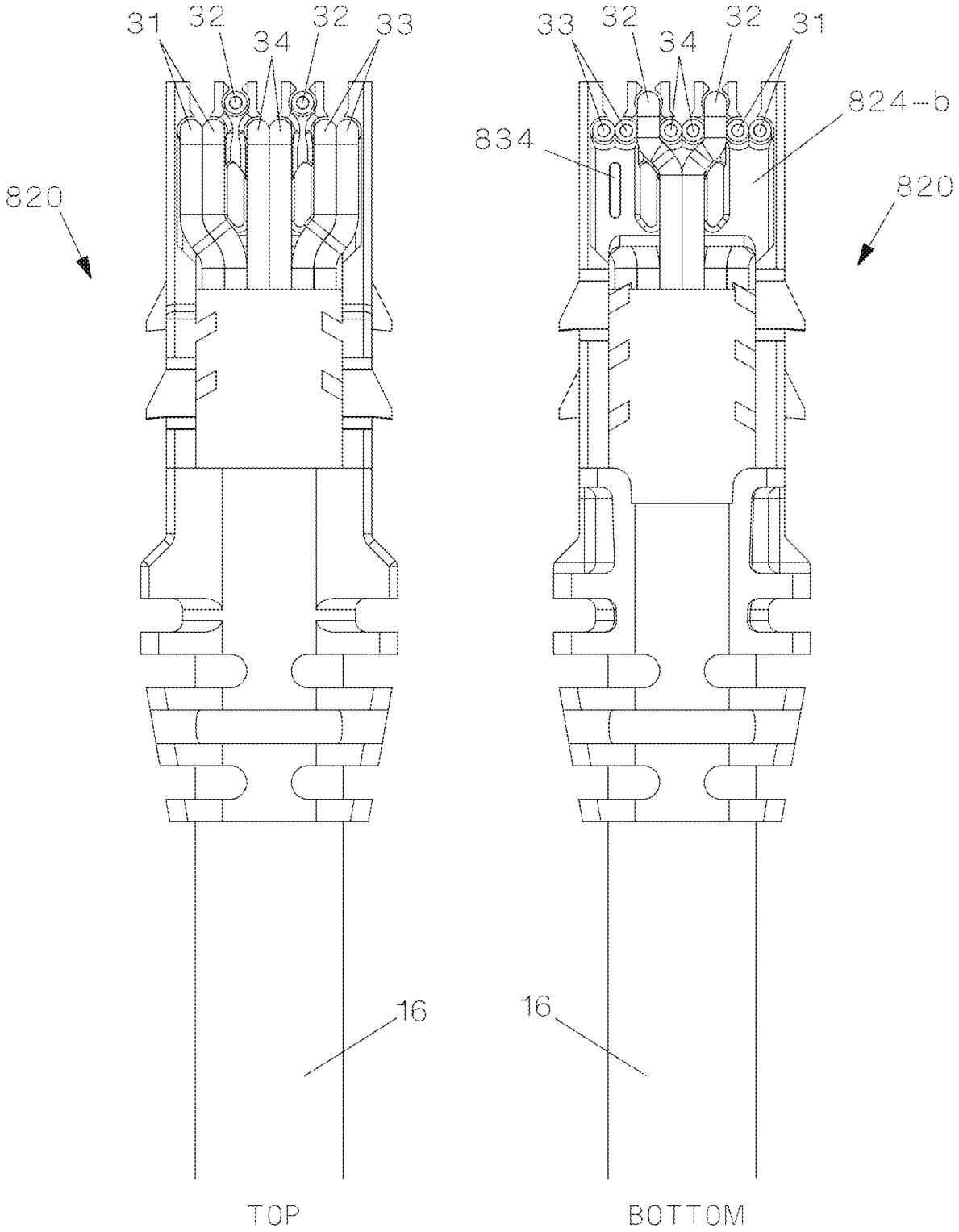
FIG. 58 is a top and bottom view of the conductor manager shown in FIG. 56 with the cable installed and having the twisted pairs of wires routed in the second configuration at the second cable end.

For example, FIG. 57 shows an embodiment where the twisted pairs 31-34 have been installed into the vertical channels **825-*v* to 829-*v* of the conductor manager 820 at the cable end A in configuration B, while FIG. 58 shows the twisted pairs 31-34 installed into the vertical channels 825-*v* to 829-*v* of the conductor manager 820 at the cable end B in the same configuration B. In configuration B, twisted pair 32 alone is routed on the top-side platform 824-*t* at cable end A, while twisted pairs 31, 33, 34 are routed on the bottom-side platform 824-*b*. Twisted pairs 31, 33, 34 are routed and held in vertical channels 825-*v* to 827-*v* that are on a same plane. Also in configuration A, twisted pair 32 is separated so that each individual conductor in twisted pair 32 is routed into the two vertical channels 828-*v* and 829-*v* at the front end of the conductor routing portion 850. As shown in FIGS. 57-58, the conductor manager 820 has the same mirroring layout from the top half to the bottom half. The top to bottom mirroring layout of the conductor manager 820 allows the same conductor manager 820** to be used for terminating twisted pairs in either layout configuration A or B at either cable ends A or B.

Figure 59:
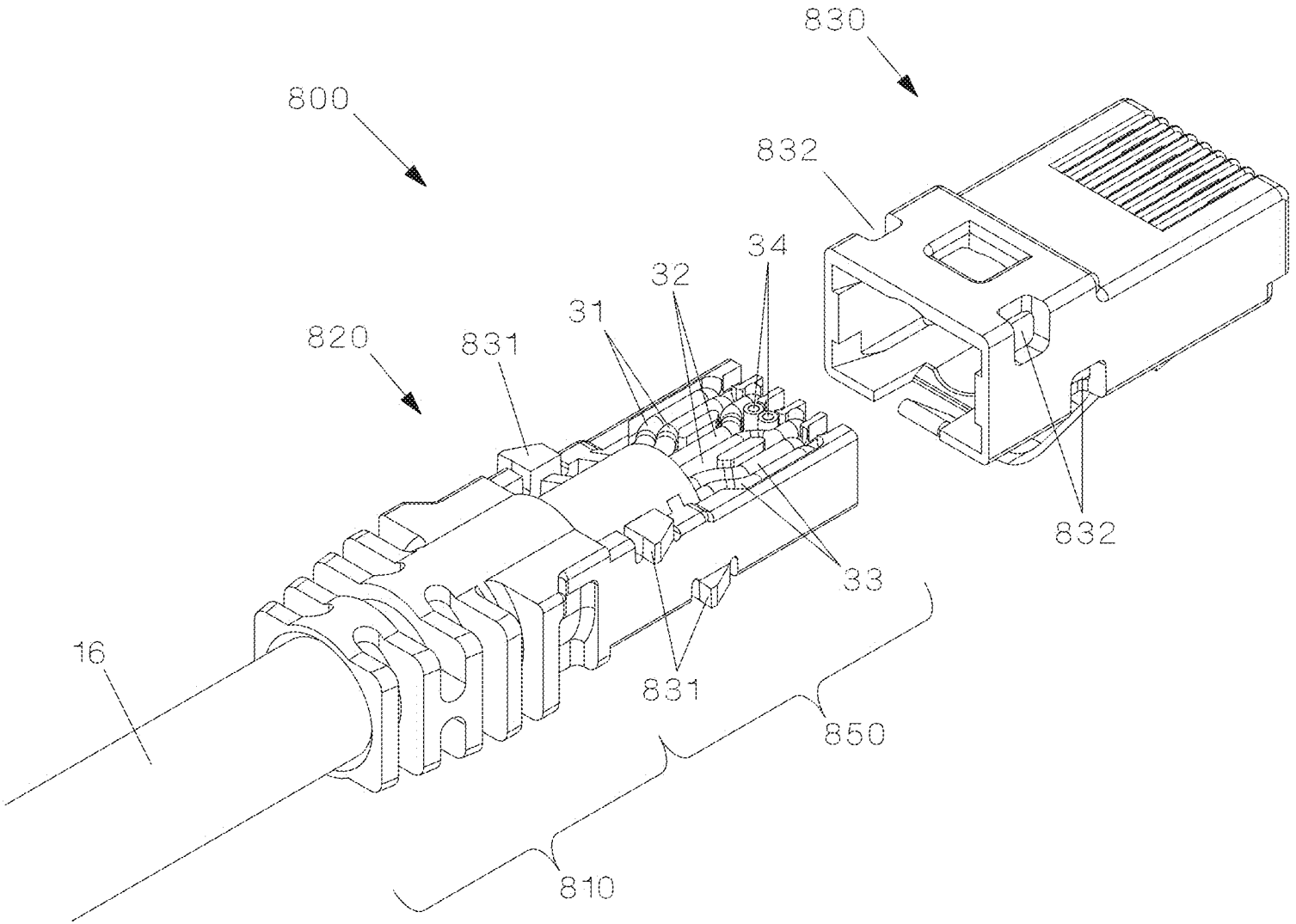
FIG. 59 is a perspective view of the plug shown in FIG. 49 in a partially assembled state.
Figure 60:
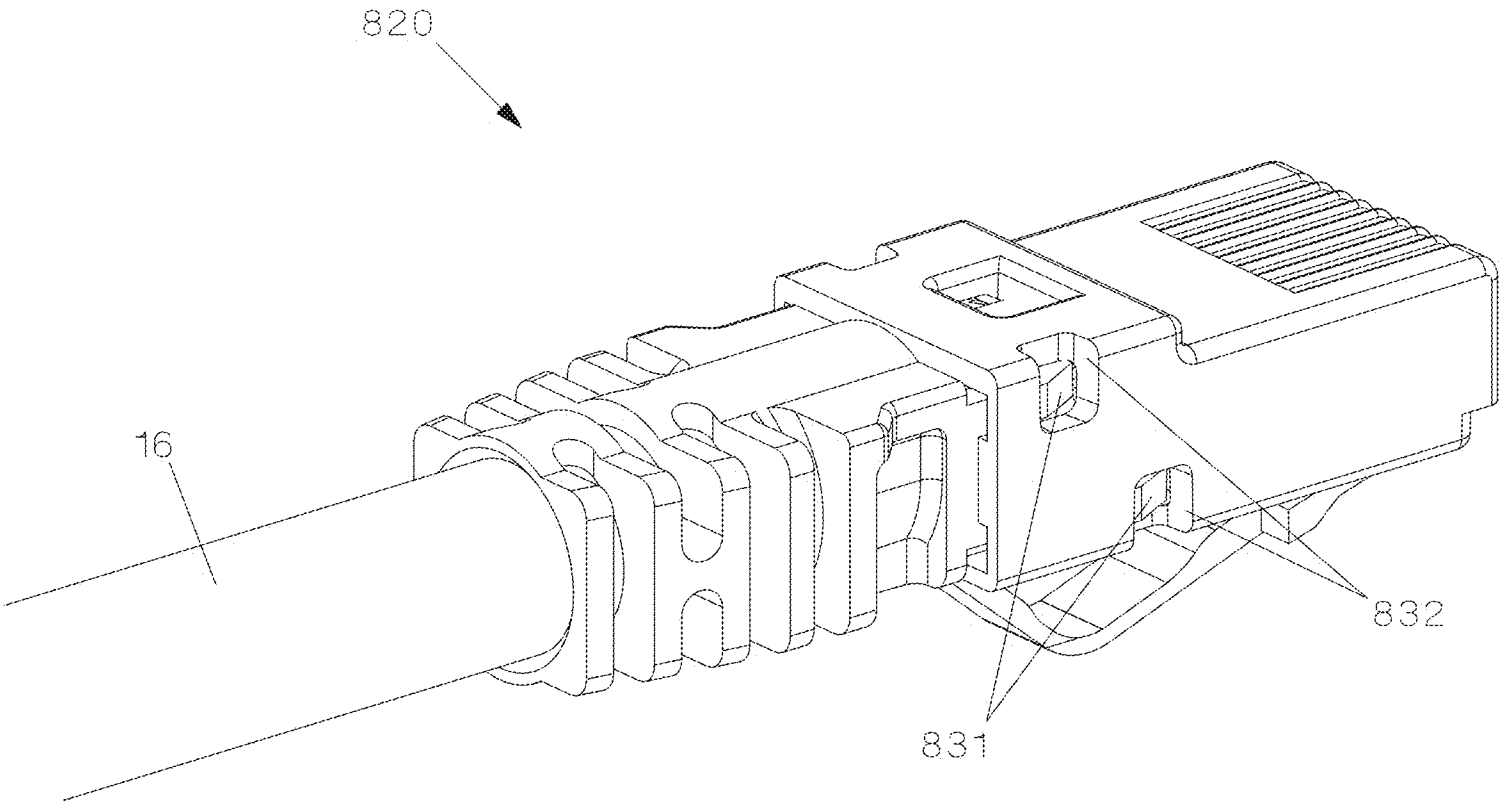
FIG. 60 is a perspective view of the plug shown in FIG. 49 in a fully assembled state.

FIG. 59 shows the plug 800 in a nearly assembled state where the twisted pairs 31-34 have been installed into the conductor manager 820, and the conductor manager is ready for secure attachment to the plug housing 830. FIG. 60 shows the plug 800 in the fully assembled state where the conductor manager 820 is securely attached to the plug housing by fitting the latches 831 of the conductor manager 820 into their respective windows 832 of the plug housing 830. The plug 800 may be assembled according to the same procedures of using the termination tool 80 to secure together the plug housing 830 to the conductor manager 820.

Figure 61:
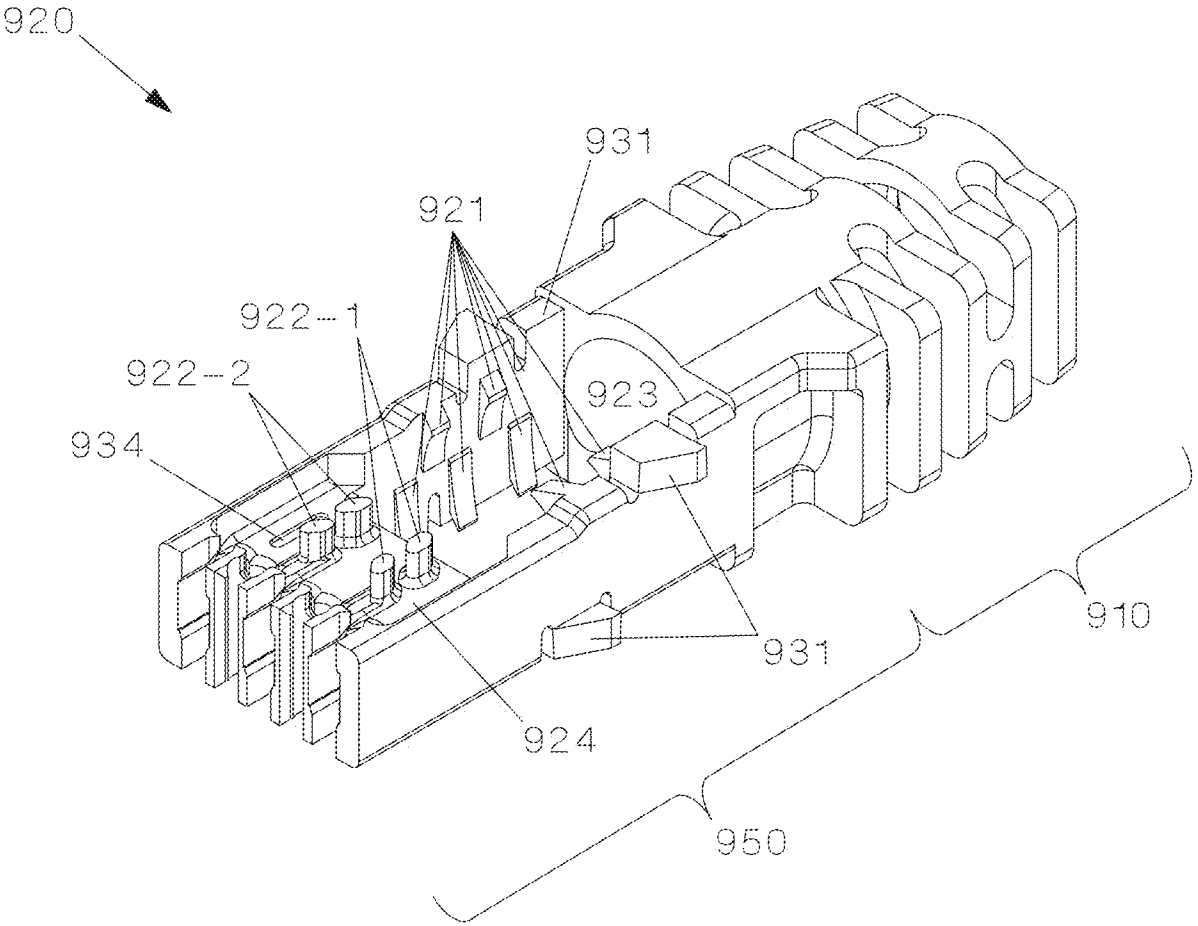
FIG. 61 is a perspective view of a conductor manager, according to an alternative embodiment.

FIG. 61 is a perspective view of an alternative conductor manager 920 according to an alternative embodiment. The conductor manager 920 may otherwise be securely attached to the same plug housing 830 as described herein.

The conductor manager 920 is designed to operate in much the same way as conductor manager 820. For example, the conductor manager 920 includes the flexible boot portion 910 and conductor routing portion 950 as a single piece construction, same as conductor manager 820. The conductor manager 920 also includes the same opening 923, latches 931, support ribs 921, platform 924, and vertical channels as included in the conductor manager 820. The updates provided in the conductor manager 920 relates to the multi-part segmented dividers 922-1 and 922-1. So compared to the two dividers 822 in conductor manager 820, the two dividers 922-1 and 922-2 are each segmented into two distinct parts separated by a spacing. By segmenting each dividers 922-1 and 922-2 into two distinct parts with spacing in-between, the conductor manager 920 may help to improve electrical performance by reducing the amount of capacitance coupling between the twisted pairs that run through the channels on the platform 924. Although the two dividers 922-1 and 922-2 are illustrated to be separated into two components, they may be separated into two or more components according to some embodiments. The conductor manager 920 also includes an indicator 934.

Figure 62:
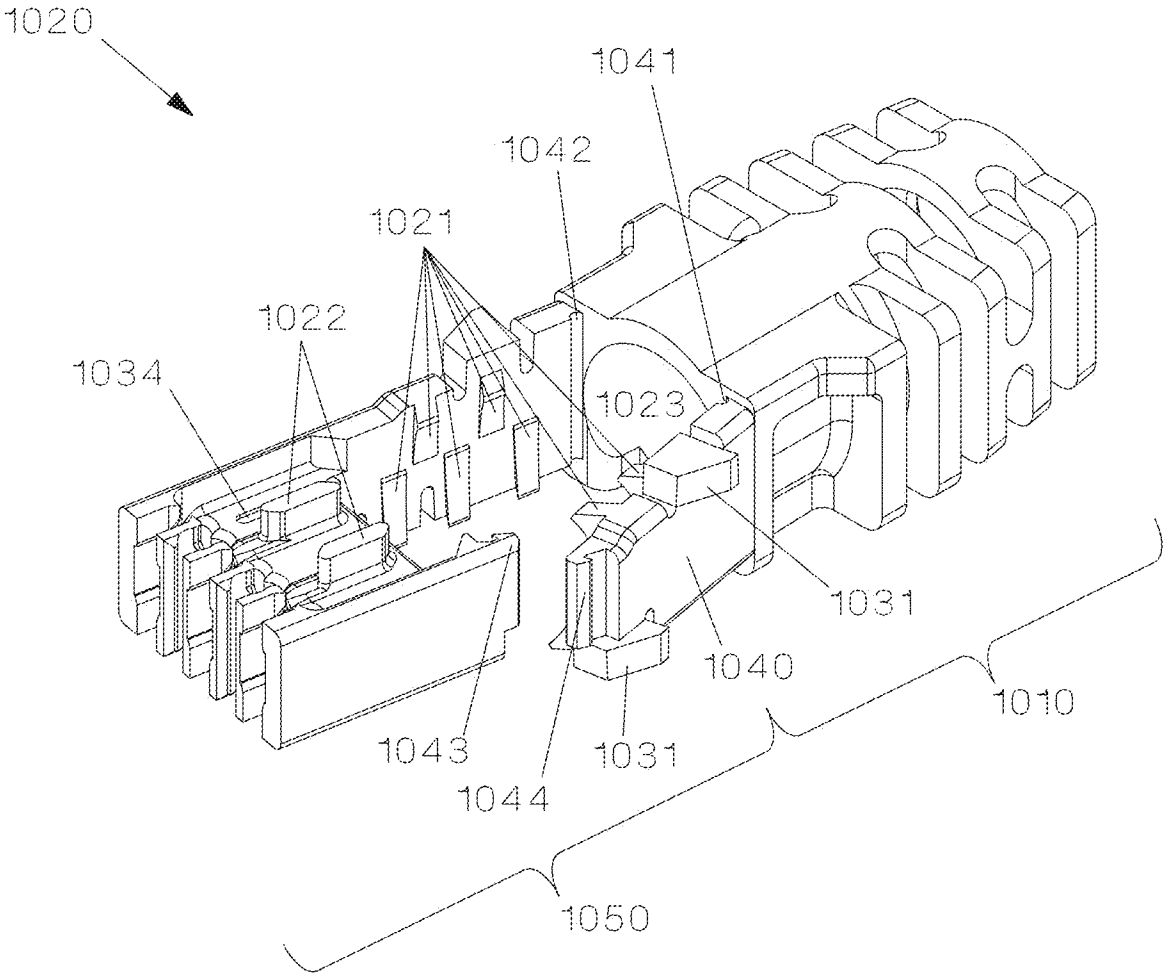
FIG. 62 is a perspective view of a conductor manager in an open state, according to an alternative embodiment.

FIG. 62 is a perspective view of an alternative conductor manager 1020 in an open state according to an alternative embodiment. The conductor manager 1020 shares many of the same components as conductor manager 820, and may otherwise be securely attached to the same plug housing 830 as described herein.

For example, the conductor manager 1020 includes the flexible boot portion 1010 and conductor routing portion 1050 as a single piece construction, same as conductor manager 820. The conductor manager 1020 also includes the same opening 1023, latches 1031, support ribs 1021, platform 1024, and vertical channels as included in the conductor manager 820. As an update to the conductor manager 820, the conductor manager 1020 includes a door 1040 that rotates into an open and closed state. FIG. 62 shows the door 1040 in the open state. The door 1040 rotates about a first knuckle 1041. The non-door portion of the conductor routing portion 1050 may rotate about a second knuckle 1042. By including the door 1040 and the rotational movement about the first knuckle 1041 and the second knuckle 1042, the conductor manager 1020 opens up additional room to more easily insert and manage the twisted pairs 31-34 as they are being routed through their respective pathways on the platform 1024 and inserted into their respective vertical channels on the conductor routing portion 1050. The conductor manager 1020 also includes an indicator 1034.

Figure 63:
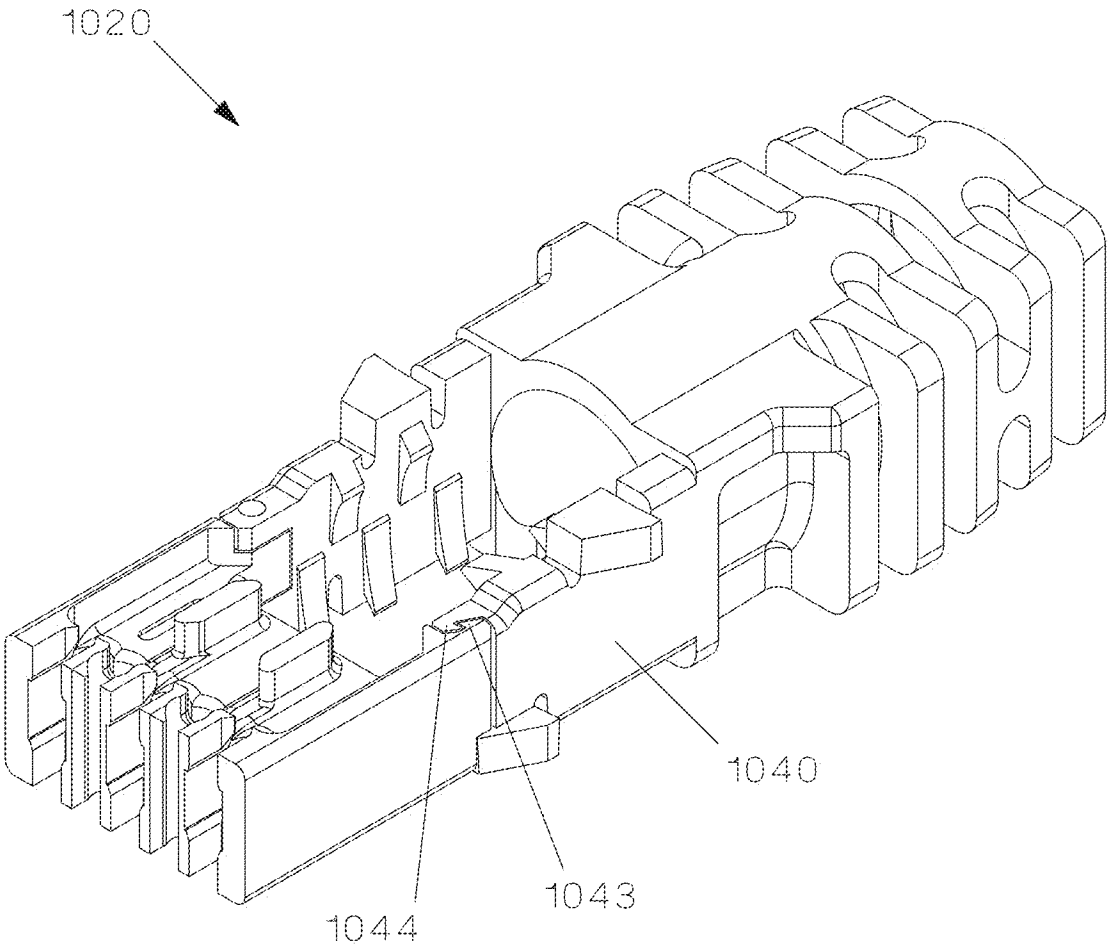
FIG. 63 is a perspective view of the conductor manager shown in FIG. 62 in a closed state.

FIG. 63 is a perspective view of the conductor manager 1020 in the closed state, where catch 1044 of the door 1040 is secured and attached to latch 1043. So FIG. 63 shows the door 1040 in the closed state. The rotation of the non-door portion of the conductor routing portion 1050 about the second knuckle 1042 allows for the attachment of the catch 1044 to the latch 1043.

Figure 64:
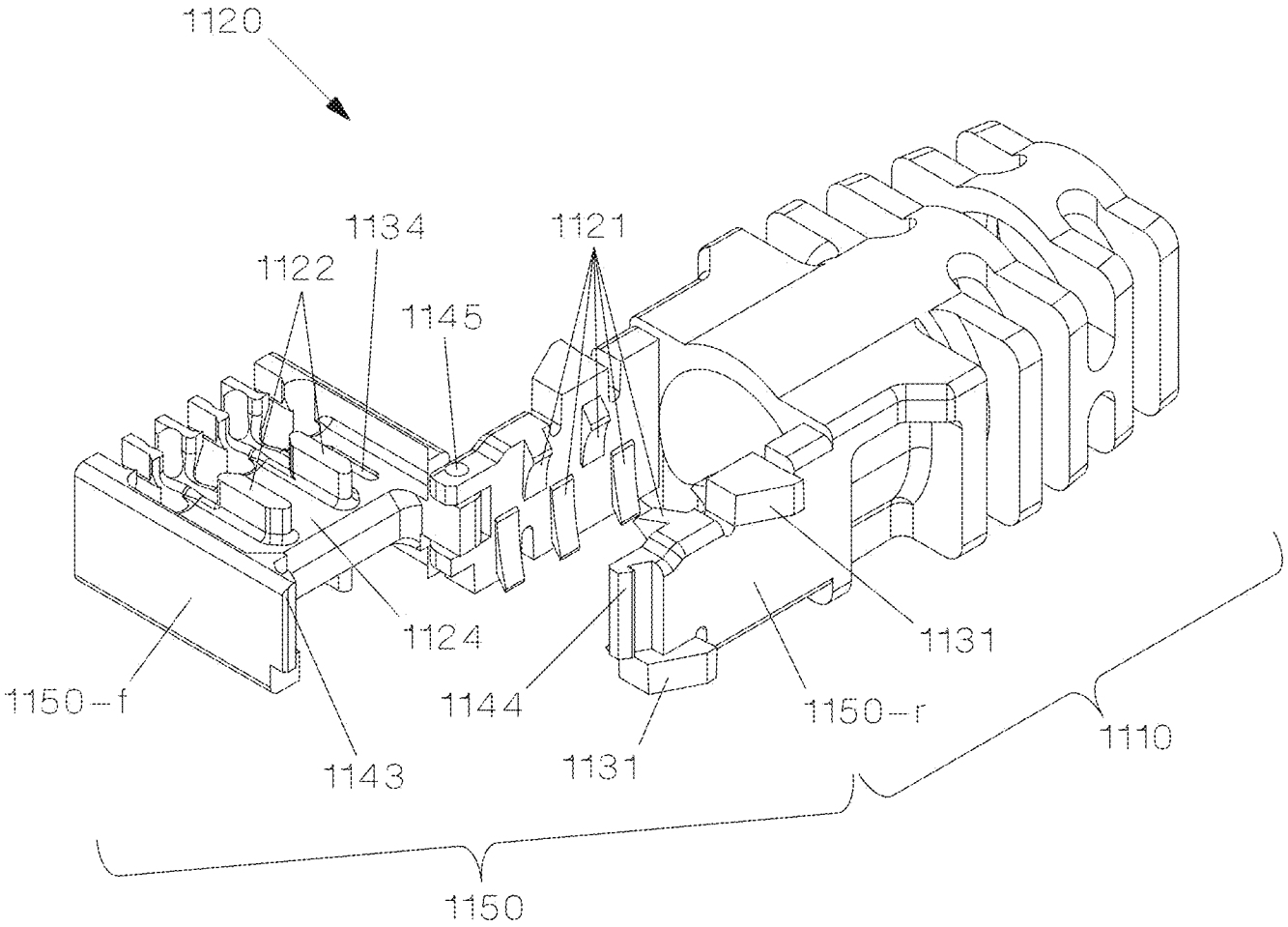
FIG. 64 is a perspective view of a conductor manager in an open state, according to an alternative embodiment.

FIG. 64 is a perspective view of an alternative conductor manager 1120 in an open state according to an alternative embodiment. The conductor manager 1120 shares many of the same components as conductor manager 820, and may otherwise be securely attached to the same plug housing 830 as described herein.

For example, the conductor manager 1120 includes the flexible boot portion 1110 and conductor routing portion 1150 sharing many of the same components as conductor manager 820 such as the same opening 1123, latches 1131, support ribs 1121, platform 1124, and vertical channels as included in the conductor manager 820. As an update to the conductor manager 820, the conductor routing portion 1150 is separated into two parts, the front routing portion **1150-*f* and the rear routing portion 1150-*r*. The front routing portion 1150-*f* and the rear routing portion 1150-*r* are secured together by a hinge 1145, such that the front routing portion 1150-*f* rotates about the hinge 1145 to open up the conductor manager 1120 into an open and closed state. FIG. 64 shows the front routing portion 1150-*f* in the open state. By including the front routing portion 1150-*f* to rotate open about the hinge 1145, the conductor manager 1120 opens up additional room to more easily insert and manage the twisted pairs 31-34 as they are being routed through their respective pathways on the platform 1124 and inserted into their respective vertical channels on the front routing portion 1150-*f* of the conductor routing portion 1150. The conductor manager 1120 also includes an indicator 1134**.

Figure 65:
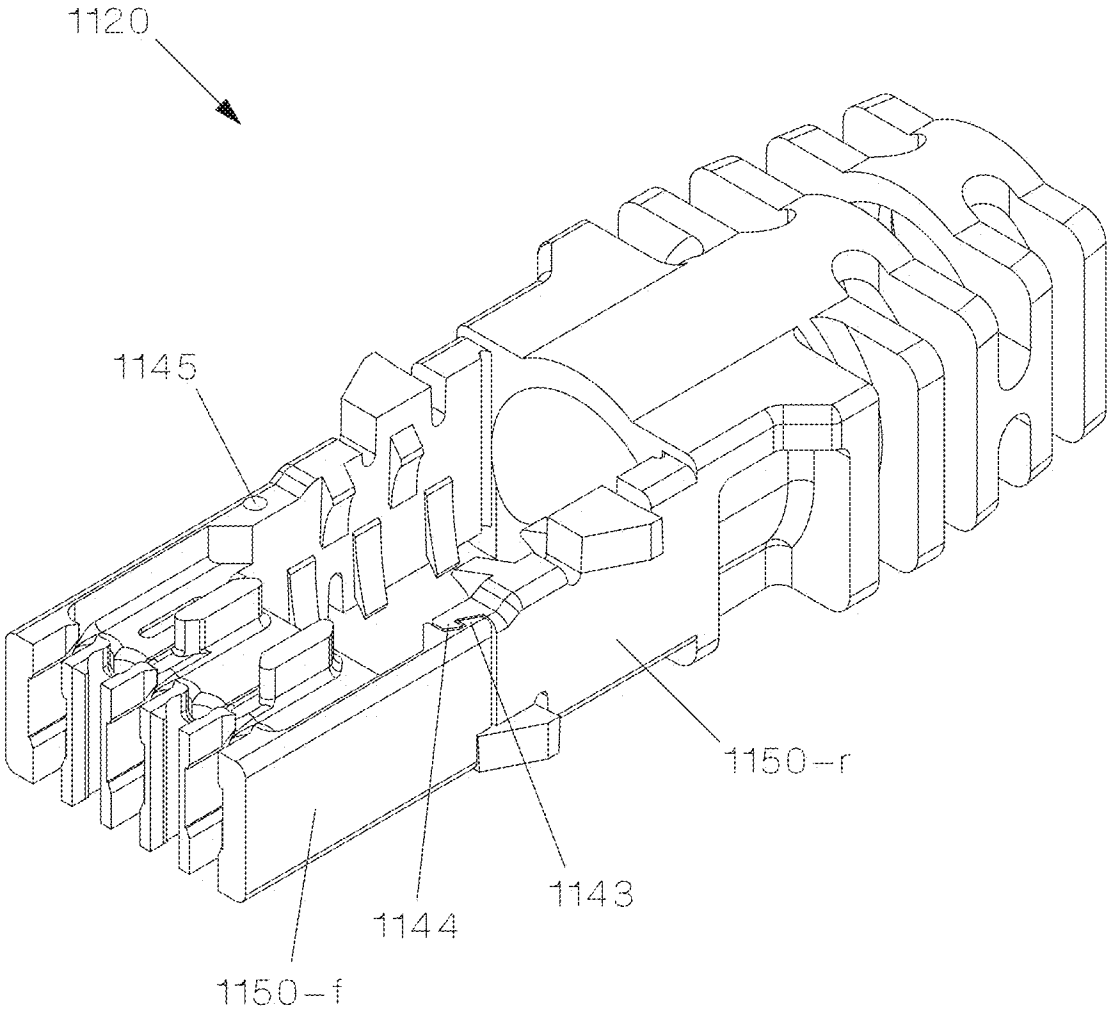
FIG. 65 is a perspective view of the conductor manager shown in FIG. 64 in a closed state.

FIG. 65 is a perspective view of the conductor manager 1120 in the closed state, where catch 1144 of the rear routing portion **1150-*r* is secured and attached to latch 1143 of the front routing portion 1150-*f*. So FIG. 65 shows the front routing portion 1150-*f* in the closed state. The hinge 1145 may be a pin that is inserted through hinge openings formed through both the front routing portion 1150-*f* and the rear routing portion 1150-*r* as shown in FIG. 65**.

Figure 66:
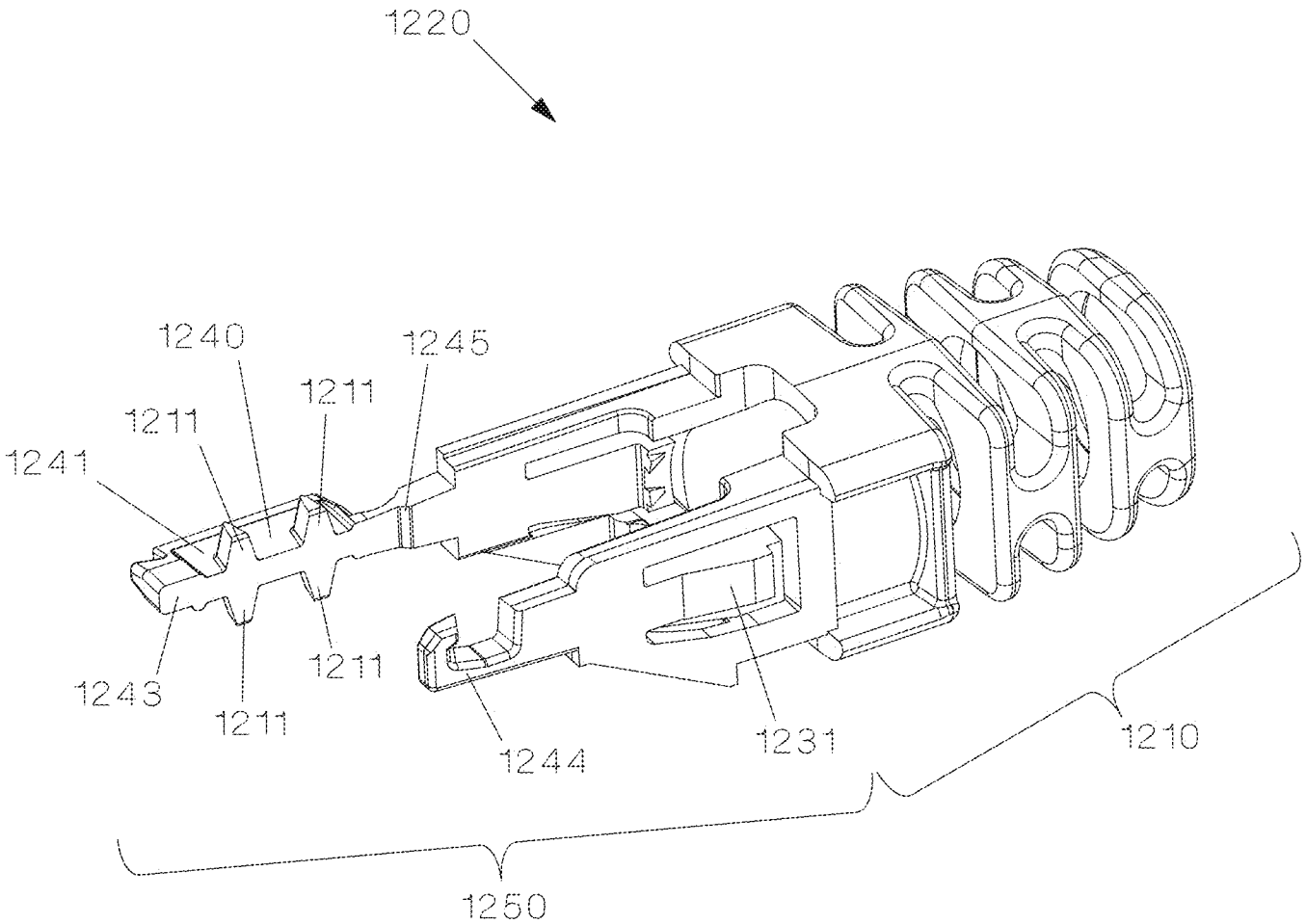
FIG. 66 is a perspective view of a conductor manager, according to an alternative embodiment.

FIG. 66 is a perspective view of an alternative conductor manager 1220 in an open state according to an alternative embodiment. The conductor manager 1220 may share some of the same, or similar, components as conductor manager 820 while also including certain different component designs. For example, a flexible boot portion 1210 may be similar to the flexible boot portion 810 included in the conductor manager 820, while the conductor routing portion 1250 is updated to have a different design from that found in the conductor routing portion 850 of the conductor manager 820, as described in more detail below.

The conductor routing portion 1250 includes a latch 1231 on two opposing arms, as shown in FIG. 66. Each latch 1231 is configured to engage and attach to a corresponding latch window included in a plug housing that has been modified to receive and be assembled with the conductor routing portion 1250. The conductor routing portion 1250 further includes a divider 1240 that includes a hook catch 1243 formed at one end of the divider 1240, and a hinge 1245 formed at the opposite end of the divider 1240. The hinge is connected to the arm of the conductor routing portion 1250. One of the arms includes a latch hook 1244 that is shaped for securely hooking and attaching to a hook catch 1243 at an end of the other arm in an assembled state where the cable 16 has been fitted through the flexible boot portion 1210 and the conductors from the cable 16 are being routed by the divider 1240. The divider 1240 is configured to include a flat platform 1241 and one or more protrusions 1211 for routing conductors that are coming out of the flexible boot portion 1210 (e.g., four protrusions 1211 are shown in FIG. 66). The protrusions 1211 are shown to have a trapezoidal shape, although other shapes are contemplated within the scope of these embodiments. The protrusions 1211 may be found on both a top and bottom surface of the platform, or on just one surface side according to other embodiments.

The plug design described herein provides a simplified modular design compared to previous plug design, and results in a more efficient termination and overall installation process. The plug design reduces the number of components from other plug designs.

Furthermore, while the particular preferred embodiments described herein have been shown and described, it will be obvious to those skilled in the art that changes and modifications may be made without departing from the teaching of the embodied features described in this disclosure. The matter set forth in the foregoing description and accompanying drawings is offered by way of illustration only and not as limitation. The actual scope of the disclosure is intended to be defined in the following claims when viewed in their proper perspective.

What is claimed is:

1. A plug for terminating a cable including a twisted pair of conductors, the plug comprising:
- a plug housing comprising:
  - a cavity;
  - a latch window; and
  - a plurality of contact openings configured to hold a plurality of contacts;
- a load bar comprising:
  - a plurality of conductor holes for holding the conductors included in the twisted pair of conductors; and
  - a plurality of contact slots for receiving the plurality of contacts and coupling to the conductors held in the conductor holes; and
- a conductor manager assembly comprising:
  - a flexible boot positioned at a rear end of the conductor manager assembly, the flexible boot including a boot tunnel in a cylindrical shape and configured to receive the cable, wherein the cable comprises an outer jacket surrounding the twisted pair of conductors;
  - a conductor manager body including a body passage configured to receive the cable routed through the boot tunnel, the conductor manager body further including a latch configured to engage the latch window when the conductor manager assembly is inserted into the cavity along an insertion axis in an assembled state; and
  - a divider positioned at a front end of the conductor manager assembly that is opposite to the rear end, the divider configured to route the twisted pair of conductors routed from the body passage.

2. The plug of claim 1, wherein the plurality of contacts are inserted into their respective contact slots along a non-parallel axis to the insertion axis.

3. The plug of claim 1, wherein the divider includes a plurality of protrusions to route the conductors.

4. The plug of claim 3, wherein the plurality of protrusions include at least one protrusion on a top surface of the divider and at least one protrusion on a bottom surface of the divider.

5. The plug of claim 1, wherein the divider includes:
- a first side attached to the conductor manager body; and
- a second side removably attached to the conductor manager body.

6. The plug of claim 5, wherein the second side includes an engagement member for attaching to a hook latch on the conductor manager body.

7. The plug of claim 1, wherein the divider includes:
- a first side removably attached to the conductor manager body; and
- a second side removably attached to the conductor manager body.

8. The plug of claim 1, wherein each contact slot opens into a portion of their corresponding conductor hole.

9. A plug for terminating a cable including a twisted pair of conductors, the plug comprising:
- a plug housing comprising:
  - a cavity; and
  - a plurality of contact openings configured to hold a plurality of contacts; and
- a conductor manager configured for insertion into the cavity along an insertion axis, the conductor manager comprising:
  - a flexible boot portion positioned at a rear end of the conductor manager, the flexible boot portion including a boot tunnel in a cylindrical shape and configured to receive the cable, wherein the cable comprises an outer jacket surrounding the twisted pair of conductors; and
  - a conductor routing portion positioned at a front end of the conductor manager that is opposite to the rear end, the conductor routing portion comprising:
    - a plurality of holding posts configured to hold a respective conductor from the twisted pair of conductors, wherein each holding post includes a front side opening facing towards the plurality of contacts held by the plug housing when the conductor manager has been inserted into the cavity along the insertion axis to a termination state.

10. The plug of claim 9, wherein the conductor routing portion further comprises:
- a platform including a plurality of dividers configured to route the conductors to their respective holding posts.

11. The plug of claim 9, wherein the conductor manager further comprises:
- a plurality of support ribs lining an inner channel through which the cable is received.

12. The plug of claim 9, wherein the plurality of holding posts are configured to route the conductors in a direction that is non-parallel to the insertion axis.

13. The plug of claim 9, wherein the plurality of contacts are configured to be inserted into the plurality of contact openings along the insertion axis to make contact with the conductors held by the plurality of holding posts.

14. The plug of claim 9, wherein the conductor routing portion includes a door configured to rotate about a knuckle at a first end of the door and releasably attach via a latch at a second end of the door.

15. The plug of claim 9, wherein the conductor routing portion includes a hinge at a first end and a latch at a second end, wherein the conductor routing portion is configured to rotate about the hinge and releasably open and close via the latch.

16. The plug of claim 9, wherein the conductor routing portion further comprises:
- a platform including an indicator placed on the platform for identifying a corresponding conductor routing path.

17. A plug for terminating a cable including a twisted pair of conductors, the plug comprising:

a plug housing comprising:

a cavity; and a plurality of contact openings configured to hold a plurality of contacts; and a conductor manager configured for insertion into the cavity along an insertion axis, the conductor manager comprising:

a flexible boot portion positioned at a rear end of the conductor manager, the flexible boot portion including a boot tunnel in a cylindrical shape and configured to receive the cable, wherein the cable comprises an outer jacket surrounding the twisted pair of conductors; and a conductor routing portion comprising:

a body portion including a body passage configured to receive the cable routed through the boot tunnel and transition the cable to remove the outer jacket to expose the twisted pair of conductors; and a plurality of holding posts configured to hold a respective conductor from the twisted pair of conductors routed from the body passage, wherein each holding post includes a front side opening facing the plurality of contacts held by the plug housing when the conductor manager has been inserted into the cavity along the insertion axis to a termination state.

18. The plug of claim 17, wherein the plurality of contacts are configured to be inserted into the plurality of contact openings along the insertion axis to make contact with the conductors held by the plurality of holding posts.

19. The plug of claim 17, wherein the plurality of holding posts are configured to route the conductors in a direction that is non-parallel to the insertion axis.

20. The plug of claim 17, wherein at least one side of the conductor routing portion is releasably attached to the conductor manager to transition from an open state to a closed state.

* * * * *